US010529280B2

(12) United States Patent
Yamashita et al.

(10) Patent No.: US 10,529,280 B2
(45) Date of Patent: Jan. 7, 2020

(54) DISPLAY DEVICE

(71) Applicant: Sony Corporation, Tokyo (JP)

(72) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/444,602

(22) Filed: Jun. 18, 2019

(65) Prior Publication Data

US 2019/0304360 A1 Oct. 3, 2019

Related U.S. Application Data

(63) Continuation of application No. 13/767,899, filed on Feb. 15, 2013, now Pat. No. 10,373,552, which is a (Continued)

(30) Foreign Application Priority Data

Jan. 16, 2008 (JP) ..... 2008-006735

(51) Int. Cl.
*G09G 3/3225* (2016.01)
*G09G 3/30* (2006.01)
(Continued)

(52) U.S. Cl.
CPC ..... *G09G 3/3225* (2013.01); *G09G 3/30* (2013.01); *G09G 3/3233* (2013.01); *G09G 3/3266* (2013.01); *G09G 2300/0426* (2013.01); *G09G 2300/0439* (2013.01); *G09G 2300/0465* (2013.01); *G09G 2300/08* (2013.01); *G09G 2300/0819* (2013.01); *G09G 2300/0842* (2013.01); *G09G 2300/0866* (2013.01);
(Continued)

(58) Field of Classification Search
None
See application file for complete search history.

(56) References Cited

U.S. PATENT DOCUMENTS 6,072,450 A 6/2000 Yamada et al.
6,380,672 B1 * 4/2002 Yudasaka ..... H01L 27/3246 313/504
(Continued)

FOREIGN PATENT DOCUMENTS

JP 05-299177 11/1993
JP 11-168383 A 6/1999
(Continued)

OTHER PUBLICATIONS

Japanese Office Action dated Aug. 30, 2011 for related Japanese Application No. 2009-128292.
(Continued)

*Primary Examiner* — Matthew Yeung
(74) *Attorney, Agent, or Firm* — Michael Best & Friedrich LLP

(57) ABSTRACT

Any one of a write scanning line, a power source supply line, and a video signal line is structured as a subsidiary wiring disposed in the same layer as that having a lower electrode disposed therein. The subsidiary wiring is used in the power source supply line through which a power source drive pulse to be pulse-driven is transmitted, or other wirings (such as the write scanning line and the video signal line).

3 Claims, 21 Drawing Sheets

Related U.S. Application Data continuation of application No. 12/314,315, filed on Dec. 8, 2008, now Pat. No. 8,599,112.

(51) Int. Cl.
*G09G 3/3233* (2016.01)
*G09G 3/3266* (2016.01)

(52) U.S. Cl.
CPC ..... *G09G 2310/027* (2013.01); *G09G 2310/0256* (2013.01); *G09G 2310/06* (2013.01); *G09G 2320/043* (2013.01); *G09G 2320/045* (2013.01)

(56) References Cited

U.S. PATENT DOCUMENTS

| | | | | |
|---|---|---|---|---|
| 6,525,704 | B1 * | 2/2003 | Kondo | G09G 3/3233 315/169.3 |
| 7,026,754 | B2 | 4/2006 | Nakanishi | |
| 2002/0140343 | A1 * | 10/2002 | Hirabayashi | H01L 27/3246 313/493 |
| 2003/0168992 | A1 | 9/2003 | Noguchi et al. | |
| 2004/0061231 | A1 | 4/2004 | He et al. | |
| 2004/0121523 | A1 | 6/2004 | Nakanishi | |
| 2004/0151041 | A1 * | 8/2004 | Lee | G11C 7/02 365/200 |
| 2004/0164929 | A1 | 8/2004 | Ide et al. | |
| 2005/0012694 | A1 | 1/2005 | Park et al. | |
| 2005/0073619 | A1 | 4/2005 | Chen et al. | |
| 2005/0179374 | A1 | 8/2005 | Kwak | |
| 2005/0258771 | A1 | 11/2005 | Kang et al. | |
| 2005/0264228 | A1 | 12/2005 | Kim | |
| 2006/0054894 | A1 | 3/2006 | Miyake et al. | |
| 2006/0145606 | A1 | 7/2006 | Lee | |
| 2006/0170628 | A1 | 8/2006 | Yamashita et al. | |
| 2006/0208977 | A1 | 9/2006 | Kimura | |
| 2006/0226788 | A1 | 10/2006 | Ogawa | |

FOREIGN PATENT DOCUMENTS

| | | | |
|---|---|---|---|
| JP | 2002-232291 | A | 8/2002 |
| JP | 2003-316291 | | 11/2003 |
| JP | 2004-341513 | A | 12/2004 |
| JP | 2005-158583 | | 6/2005 |
| JP | 2005-197202 | | 7/2005 |
| JP | 2005-227788 | A | 8/2005 |
| JP | 2006-113376 | | 4/2006 |
| JP | 2006-215213 | | 8/2006 |
| JP | 2007-258189 | A | 10/2007 |
| JP | 2007-310311 | A | 11/2007 |

OTHER PUBLICATIONS

Japanese Office Action dated Apr. 10, 2012 for corresponding Japanese Application No. 2008-006735.

* cited by examiner

FIG. 6A NO THRESHOLD CORRECTION NO MOBILITY CORRECTION
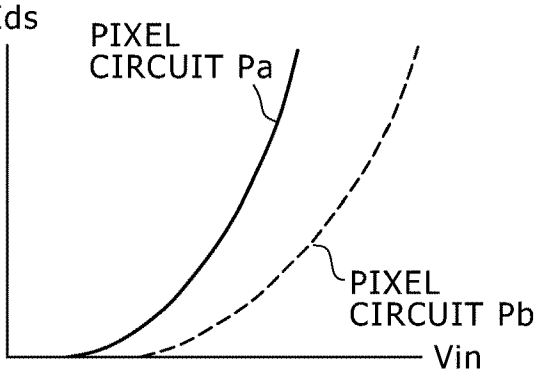
FIG. 6B THRESHOLD CORRECTION IS DONE NO MOBILITY CORRECTION
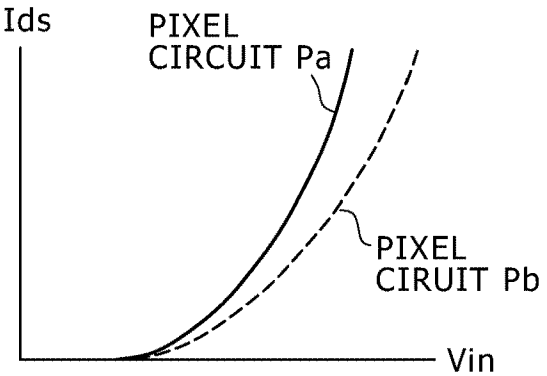
FIG. 6C THRESHOLD CORRECTION IS DONE MOBILITY CORRECTION IS DONE
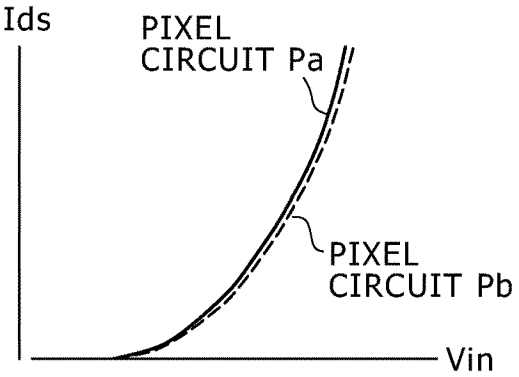
FIG. 6D THRESHOLD CORRECTION IS INSUFFICIENT MOBILITY CORRECTION IS DONE
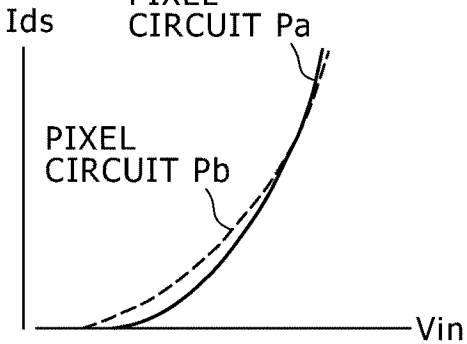

FIRST TECHNIQUE

SECOND TECHNIQUE

THIRD TECHNIQUE

FOURTH TECHNIQUE

LAYOUT OF FIRST EMBODIMENT: ONLY SUBSIDIARY WIRING 515 FOR POWER SOURCE SUPPLY LINE 105DSL IS PROVIDED IN ANODE LAYER L3

LAYOUT OF SECOND EMBODIMENT: SUBSIDIARY WIRING 515 FOR POWER SOURCE SUPPLY LINE 105DSL IS PROVIDED IN PARALLEL WITH ANODE LAYER L3

LAYOUT OF SECOND EMBODIMENT: SUBSIDIARY WIRING 515 FOR POWER SOURCE SUPPLY LINE 105DSL IS PROVIDED IN PARALLEL WITH ANODE LAYER L3

DISPLAY DEVICE

CROSS REFERENCES TO RELATED APPLICATIONS

This is a Continuation Application of U.S. patent application Ser. No. 13/767,899, filed Feb. 15, 2013, which is a Continuation Application of U.S. patent application Ser. No. 12/314,315, filed Dec. 8, 2008, now U.S. Pat. No. 8,599,112, issued on Dec. 3, 2013, which in turn claims priority from Japanese Application No. 2008-006735 filed in the Japan Patent Office on Jan. 16, 2008, the entire contents of which being incorporated herein by reference.

BACKGROUND OF THE INVENTION

1. Field of the Invention

The present invention related to a display device including a pixel array portion in which pixel circuits (referred to as "pixels" as well) each having an electro-optic element (referred to as either "a display element" or "a light emitting element" as well) are disposed in a matrix. More particularly, the invention relates to an active matrix type display device in which pixel circuits each having an electro-optic element as a display element having a luminance adapted to change depending on a magnitude of a drive signal are disposed in a matrix, and which includes an active element every pixel circuit, display drive being carried out in units of pixels by the active elements.

2. Description of the Related Art

A display device using electro-optic elements as display elements of pixels is known. In this case, a luminance of the electro-optic element is adapted to change depending on a voltage applied thereto or a current caused to flow therethrough. For example, the electro-optic element having a luminance adapted to change depending on the applied voltage is typified by a liquid crystal display element. On the other hand, the electro-optic element having a luminance adapted to change depending on the flowing current is typified by an Organic Electro Luminescence (an organic EL or an Organic Light Emitting Diode (OLED) which will be referred hereinafter to as "an organic EL") element. An organic EL display device using the latter organic EL element is a so-called self emission type display device using the electro-organic element, as a self emission element, as the display element of the pixel.

The organic EL element is an electro-optic element utilizing a phenomenon that when an electric field is applied to an organic thin film, the organic thin film emits a light. The organic EL element has the less power consumption because it can be driven by a relatively low applied voltage (for example, 10 V or less). In addition, the organic EL element is a self emission element which self-emits a light, which results in that weight-lightening and thinning are readily carried out because a subsidiary illumination member such as a backlight necessary for the liquid crystal display device is not required for the organic EL display device. Moreover, no residual image occurs in a phase of display of a moving image because a response speed of the organic EL element is very high (for example, about several micron-seconds). In recent years, planar self emission type display devices each using the organic EL element as the electro-optic element have been actively developed.

Now, in the display devices each using the electro-optic element, including the liquid crystal display device using the liquid crystal display element, and the organic EL display device using the organic EL element, a passive matrix system and an active matrix system can be adopted as the system for driving the same. However, although the display device utilizing the passive matrix system has a simple structure, it involves a problem that it is difficult to realize a large and high definition display device, and so forth.

For this reason, in recent years, the active matrix system has been actively developed. In this case, in the active matrix system, a pixel signal which is supplied to a light-emitting element provided inside a pixel is controlled by using an active element similarly provided inside the pixel, for example, an insulated gate field-effect transistor (in general, a Thin Film Transistor (TFT)) as a switching transistor.

Here, when the electro-optic element within provided a pixel circuit is caused to emit a light, an input image signal which is supplied through a video signal line is fetched in a storage capacitor (referred to as "a pixel capacitor" as well) provided in a gate terminal (control input terminal) of a drive transistor by a switching transistor (referred to as "a sampling transistor"). Also, a drive signal corresponding to the input image signal thus fetched in is supplied to the electro-optic element.

In the liquid crystal device using the liquid crystal element as the electro-optic element, since the liquid crystal display element is an element of a voltage drive type, the liquid crystal display element is driven by using a voltage signal itself corresponding to an input image signal fetched in the storage capacitor. On the other hand, in the organic EL display device using an element such as the organic EL element as the electro-optic element, a drive signal (voltage signal) corresponding to the input image signal fetched in the storage capacitor is converted into a current signal (drive current) by using a drive transistor, and the resulting drive current is supplied to the organic EL element or the like.

In the electro-optic element of the current drive type typified by the organic EL element, when a drive current value differs, an emission luminance differs accordingly. Therefore, in order to cause the electro-optic element to emit a light with a stable luminance, it is important to supply a stable drive current to the electro-optic element. For example, the drive system for supplying the drive current to the organic EL element can be roughly classified into a constant current drive system and a constant voltage drive system. Since both the constant current drive system and the constant voltage drive system are the well known techniques, there is given none of the known literary documents describing the constant current drive system and the constant voltage drive system.

The organic EL element has voltage vs. current characteristics having a large gradient. Thus, when the constant voltage drive is carried out, a slight dispersion of the voltages or a dispersion of the element characteristics causes a large dispersion of current, thereby causing a large dispersion of luminance. Therefore, in general, there is used the constant current drive in which a drive transistor is used in a saturated region. Of course, with the constant drive as well, a current fluctuation causes a luminance dispersion. However, a small current dispersion only causes a small luminance dispersion.

Conversely, even with the constant current drive system, in order to hold the emission luminance of the electro-optic element constant, it is important that a drive signal written to and held in a storage capacitor is constant in correspondence to an input image signal. For example, in order to hold the emission luminance of the organic EL element constant, it is important that the drive current corresponding to the input image signal is constant.

However, a threshold voltage of an active element (drive transistor) for driving the electro-optic element, and a mobility of a carrier therein disperse due to the process fluctuation. In addition, the characteristics of the electro-optic element such as the organic EL element fluctuate with time. In general, when a low-temperature polysilicon TFT substrate or the like is used, the threshold characteristics and mobility characteristics of the transistor largely disperse. Even with the constant current drive system, such a dispersion of the characteristics of the driving active element, and such a fluctuation of the characteristics of the electro-optic element exert an influence on the emission luminance.

In order to cope with such a situation, for the purpose of uniformly controlling the emission luminance over the entire picture of the display device, various mechanisms for correcting the luminance fluctuation due to the fluctuation of the characteristics of the driving active element and electro-optic element described above within each of pixel circuits are investigated. One of these mechanisms, for example, is described in Japanese Patent Laid-Open No. 2006-215213 (hereinafter referred to as Patent Document 1).

For example, in the mechanism described in Patent Document 1, a threshold correcting function, a mobility correcting function, and a bootstrap function are proposed for a pixel circuit for an organic EL element. In this case, the threshold correcting function is provided for holding a drive current constant even when there are the dispersion and the temporal change in threshold voltage of a drive transistor. The mobility correcting function is provided for holding the drive current constant even when there are the dispersion and the temporal change in mobility of the drive transistor. Also, the bootstrap function is provided for holding the drive current constant even when there is the temporal change in current vs. voltage characteristics of the organic EL element.

In order to realize the threshold correcting function, the mobility correcting function, and the bootstrap function, a sampling transistor or each of transistors added for the threshold correction and the mobility correction needs to be turned ON or OFF at a predetermined timing by using a pulse signal.

It is noted that at the realization of the threshold correcting operation and the mobility correcting operation, the various mechanisms are devised for a configuration of a pixel circuit or a drive timing. Sometime a time period of threshold correction, and a time period for mobility correction are determined based on only an ON time period or an OFF time period of one transistor, otherwise they are determined based on an overlap time period of ON time periods, OFF time periods or an ON time period and an OFF time period of two transistors.

In addition, with regard to mechanisms described in Japanese Patent Laid-Open Nos. 2005-197202, Hei 05-299177, 2006-113376, 2005-158583, and 2003-316291, respectively, various techniques about a pixel layout are proposed.

SUMMARY OF THE INVENTION

Moreover, in order to cause the threshold correcting function, the mobility correcting function and the bootstrap function to operate, it is necessary to ON/OFF control the various kinds of transistors. In order to attain this, it is necessary to form longitudinally and transversely the various kinds of scanning lines in a pixel array portion. For this reason, there is encountered a problem that, for example, an increase in number of circuit elements, and an increase in capacitance value are not readily carried out, or they become an obstacle to promotion of high definition.

In addition, the mechanism described in Patent Document 1 requires a wiring through which a correcting potential is supplied, a correcting switching transistor, and a switching pulse in accordance with which the correcting switching transistor is driven. Thus, that mechanism adopts a 5TR drive configuration using five transistors, including a driving transistor and a sampling transistor. As a result, the configuration of the pixel circuit is complicated. Many constituent elements of the pixel circuit are used, which becomes an obstacle to the promotion of the high definition in the display device. As a result, it becomes difficult to apply the 5TR drive configuration to the display device used in a compact electronic apparatus such as a portable appliance (mobile apparatus).

For this reason, there is a request for the development of the mechanism for causing the increase in number of circuit elements and the increase in capacitance value, or the promotion of the high definition to be readily carried out while the pixel circuit is simplified. In this case, it should be taken into consideration that a problem which is not caused in the 5TR drive configuration is prevented from being newly caused along with causing the increase in number of circuit elements and the increase in capacitance value, or the promotion of the high definition to be readily carried out, and the simplification of the pixel circuit.

The present invention has been made in the light of the circumstances described above, and it is therefore desirable to provide a display device having a mechanism which is capable of firstly relaxing a restriction to an increase in number of circuit elements and an increase in capacitance value or an obstacle to promotion of high definition owing to a layout of scanning lines, thereby enhancing a display quality.

It is also desirable to provide a display device having a mechanism which is capable of promoting high definition of the display device by simplifying a pixel circuit.

It is further desirable to provide a display device having a mechanism which is capable of suppressing a change in luminance due to a dispersion of characteristics of drive transistors and electro-optic elements at simplification of a pixel circuit.

In order to attain the desire described above, according to an embodiment of the present invention, there is provided a display device including: a pixel array portion having pixel circuits disposed in a matrix, each of the pixel circuits including a drive transistor for generating a drive current, an electro-optic element connected to an output terminal of the drive transistor, a storage capacitor for holding therein information corresponding to a signal potential of a video signal, and a sampling transistor for writing the information corresponding to the signal potential of the video signal to the storage capacitor, a drive current based on the information held in the storage capacitor being generated in the drive transistor to be caused to flow through the electro-optic element, so that the electro-optic element emits a light.

The display device further including a control portion including a write scanning portion for outputting a write scanning pulse to the sampling transistors, the sampling transistors being successively controlled with a horizontal period to scan the pixel circuits in a line sequential manner, thereby writing the information corresponding to the signal potential of the video signal to each of the storage capacitors for one row in accordance with the write scanning pulse, a drive scanning portion for supplying a power source drive pulse in accordance with which a first potential and a second potential different from the first potential are selectively switched over to each other to corresponding ones of power source supply terminals of the drive transistors, and a horizontal driving portion for supplying video signals for one row to the video signal line in accordance with the line sequential scanning in the write scanning portion.

The display devise further including a write scanning line through which the write scanning pulse is supplied from the write scanning portion to the sampling transistor; a power source supply line through which the power source drive pulse is supplied from the drive scanning portion to the power source supply terminal of the drive transistor; and a video signal line through which the video signal is supplied from the horizontal driving portion to the sampling transistor; in which the electro-optic element has a lower electrode connected to the drive transistor, and an organic layer and an upper electrode laminated on the lower electrode in order.

In the display device of any one of the write scanning line, the power source supply line, and the video signal line is structured in a form of a subsidiary wiring wired in the same layer as that having the lower electrode wired therein; and remainders of the write scanning line, the power source supply line, and the video signal line are wired in a wiring layer different from the layer having the lower electrode wired therein.

In the embodiment of the present invention, the subsidiary wiring is wired in the same layer as that having the lower electrode wired therein. Also, the subsidiary wiring, for example, is used in the power source supply line through which the power source drive pulse pulse-driven between the first potential and the second potential is transmitted, or other wirings (the write scanning line for write drive pulse and the video signal line for the video signal).

The subsidiary wiring wired in the same layer as that having the lower electrode wired therein is utilized as the scanning line through which the drive pulse and the video signal are transmitted. As a result, it is unnecessary to wire the scanning line concerned in the existing general wiring layer, or it is possible to narrow the wiring width in the existing general wiring layer.

According to an embodiment of the present invention, the scanning line which is heretofore wired in the general wiring layer is structured in the form of the subsidiary wiring wired in the same layer as that having the lower electrode wired therein. Therefore, it is possible to reduce the wiring in the existing general wiring layer (including, the perfect removal of the same).

As a result, the reduction in layout area for the scanning line makes it possible to reduce the layout area of the entire pixel.

As a result, when the previous pixel pitch (pixel size) is maintained, the increase in number of circuit elements and the increase in capacitance value can be readily carried out. In addition, when the element size is maintained in the previous state, the high definition promotion for the pixel can be carried out because the pixel pitch (pixel size) can be made smaller than that in the previous case.

Here, at the realization of the threshold correcting function, and the threshold correction preparing function (initializing function) and the mobility correcting function prior thereto, the potential at the power supply terminal of the drive transistor is made to transit between the first potential and the second potential, that is, the using of the power source voltage as the switching pulse effectively functions. In other words, since the threshold correcting function and the mobility correcting function are incorporated in the display device, when the power source voltage supplied to each of the drive transistors of the pixel circuits is used as the switching pulse, it becomes unnecessary to wire the scanning line for controlling the correcting switching transistor, and the control input terminal of the correcting switching transistor.

As a result, the timings at which the transistors are driven, respectively, and the like have only to be changed with the 2TR drive configuration as a base. Thus, it is possible to largely reduce the number of constituent elements of the pixel circuit, and the number of wirings, and it is possible to shrink the pixel array portion. As a result, it is easy to carry out the promotion of the high definition for the display device. A part of the scanning line is structured in the form of the subsidiary wiring wired in the same layer as that having the lower electrode of the electro-optic element wired therein while the pixel circuit is simplified, thereby making it possible to more readily carry out the promotion of the high definition for the panel. It is possible to readily realize a compact display device which is suitable for the promotion of the high definition because of the less number of elements and the less number of wirings, and for which display having high definition is required.

BRIEF DESCRIPTION OF THE DRAWINGS

FIGS. 6A to 6D are respectively graphs explaining a technique for improving the influence which the dispersion of the characteristics of the drive transistors exerts on the drive current;

DETAILED DESCRIPTION OF THE PREFERRED EMBODIMENTS

Preferred embodiments of the present invention will be described in detail hereinafter with reference to the accompanying drawings.

Outline of Entire Display Device

Figure 1:
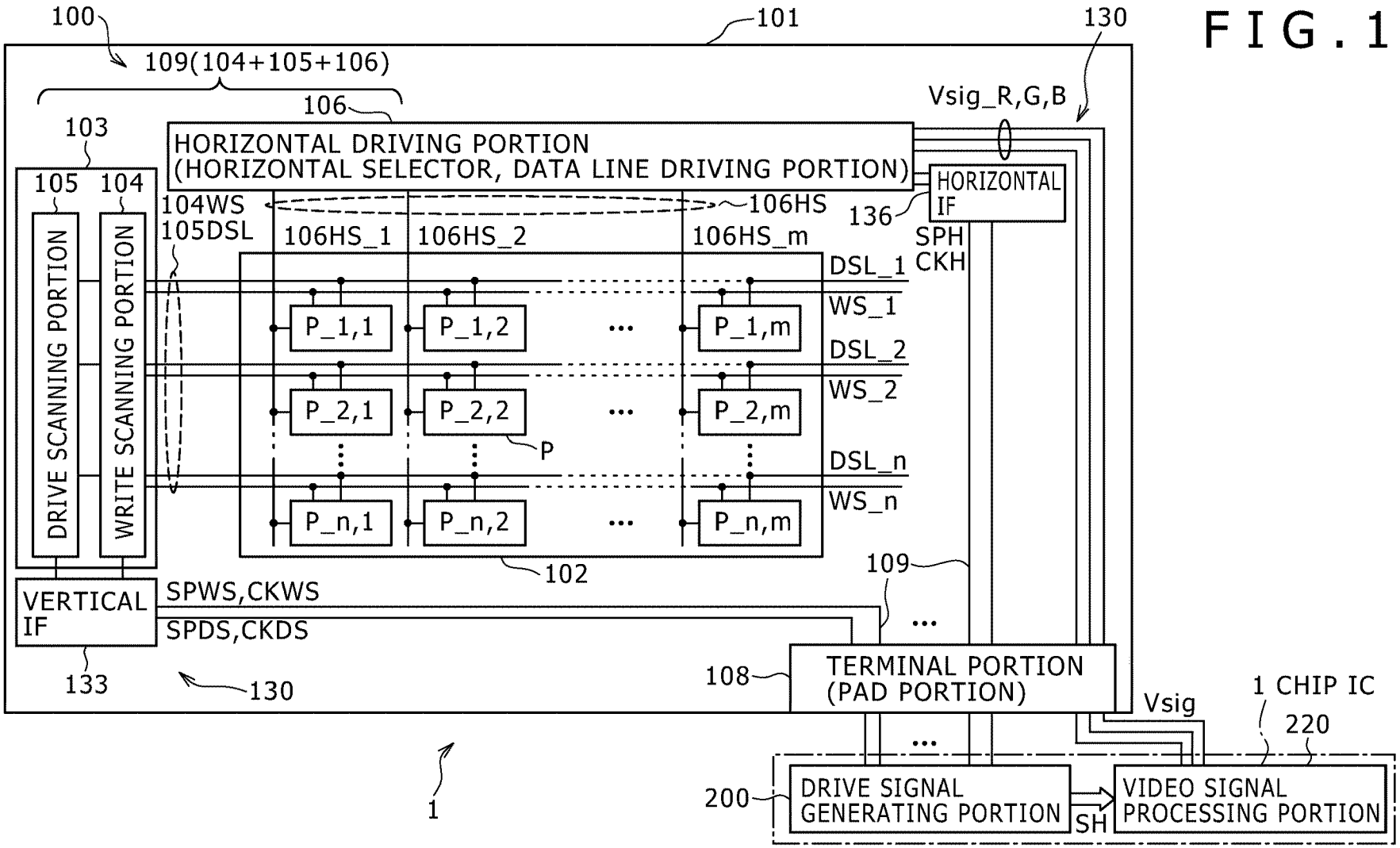
FIG. 1 is a block diagram showing a schematic configuration of an active matrix type display device as an embodiment of a display device according to the present invention.
Figure 2:
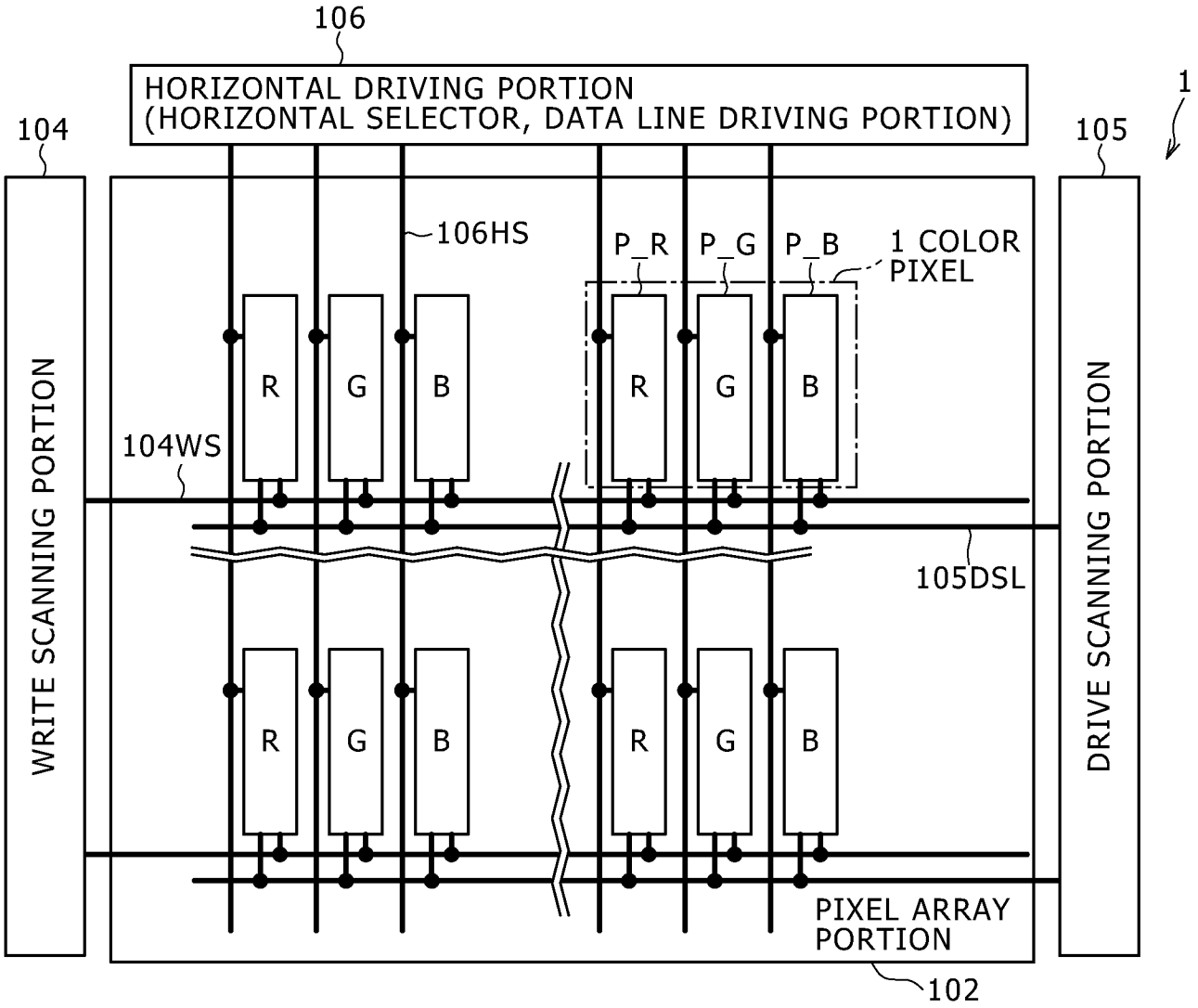
FIG. 2 is a block diagram showing a schematic configuration of the active matrix type display device as the embodiment of the display device according to the present invention (in the case of a color display form)

FIGS. 1 and 2 are respectively a block diagram and a block diagram, partly in cross section, each showing an outline of a configuration of an active matrix type display device as an embodiment of a display device according to the present invention. Here, FIG. 1 is a block diagram showing an outline of a configuration of a general active matrix type display device. Also, FIG. 2 is a block diagram, partly in cross section, showing an outline of a configuration of the general color image display adaptive active matrix type display device.

For configurations shown in FIGS. 1 and 2, a description will now be given by taking the case where the present invention is applied to an active matrix type organic EL display device (hereinafter referred to as "an organic EL display device") as an example. In this case, in the organic EL display device, for example, an organic EL element is used as a display element (called either an electro-optic element or a light emitting element) of a pixel, a polysilicon Thin Film Transistor (TFT) transistor is used as an active element, and an organic EL element is formed on a semiconductor substrate having the polysilicon thin film transistor formed therein.

It is noted that although the following description of the entire configuration is given by taking the organic EL element as the display element of the pixel, it is merely an example, and the objective display element is by no means limited to the organic EL element. That is to say, all examples which will be described later in order can be similarly applied to all the display elements each of which generally emits a light in accordance with current drive.

As shown in FIG. 1, a display device 1 includes a display panel portion 100, a drive signal generating portion (a so-called timing generator) 200, and a video signal processing portion 220. In this case, in the display panel portion 100, pixel circuits (called pixels as well) P having organic EL elements (not shown) as a plurality of display elements are disposed so as to form an effective video area in which a horizontal to vertical ratio as a display aspect ratio is X:Y (for example, 9:16). Also, the drive signal generating portion 200 is an example of a panel controlling portion for generating various pulse signals in accordance with which the display panel portion 100 is drive-controlled. Both the drive signal generating portion 200 and the video signal processing portion 220 are built in one chip-Semiconductor Integrated Circuit (IC). Both the drive signal generating portion 200 and the video signal processing portion 220 are disposed outside the display panel portion 100.

It is noted that it is not limited that there is provided the display device 1 having a module (composite parts), as shown in the figures, including all the display panel 100, the drive signal generating portion 200 and the video signal processing portion 220 as a product form. For example, only the display panel portion 100 can be provided as the display device 1.

In addition, the display device 1 includes one as well having a module shape having a sealed structure. For example, a display module formed by sticking a counter portion such as a transparent glass to a pixel array portion 102 corresponds to the display device 1 having the module shape. The transparent counter portion may be provided with a color filter, a protective film, a light shielding film, and the like. Also, the display module may be provided with a circuit portion for transmitting a video signal Vsig and various drive pulses between the outside and the pixel array portion 102, a flexible printed circuit (FPC), and the like.

In addition, the display device 1 as described above can be applied to display portions, of electronic apparatuses in all the fields, in each of which a video signal inputted to the electronic apparatus, or a video signal generated in the electronic apparatus is displayed in the form of a still image or a moving image (image). These electronic apparatuses, for example, are typified by various electronic apparatuses such as a portable music player utilizing a recording medium such as a semiconductor memory, a mini disc (MD) or a cassette tape, a notebook-size personal computer, mobile terminal equipment such as a mobile phone, and a video camera.

A pixel array portion 102, a vertical driving portion 103, a horizontal driving portion (called either a horizontal selector or a data line driving portion as well) 106, an interface (IF) portion 130, a terminal portion (pad portion) 108 for external connection, and the like are integrated on the substrate 101 of the display panel portion 100. In this case, the pixel circuits P are disposed in a matrix of n×m in the pixel array portion 102. The vertical driving portion 103 vertically scans the pixel circuits P. The horizontal driving portion 106 horizontally scans the pixel circuits P. Also, each of the vertical driving portion 103 and the horizontal driving portion 106, and an external circuit interface with each other through the interface portion 130. That is to say, a peripheral driving circuits such as the vertical driving portion 103, the horizontal driving portion 106, and the interface portion 130 are formed on the same substrate 101 as that having the pixel array portion 102 formed thereon.

The interface portion 130 includes a vertical IF portion 133 and a horizontal IF portion 136. In this case, the vertical driving portion 103 and the external circuit interface with each other through the vertical IF portion 133. Also, the horizontal driving portion 106 and the external circuit interface with each other through the horizontal IF portion 136.

A control portion 109 is composed of the vertical driving portion 103 (including a write scanning portion 104 and a drive scanning portion 105), and the horizontal driving portion 106. In this case, the control portion 109 controls an operation for writing a signal potential to a storage capacitor, a threshold correcting operation, a mobility correcting operation and a bootstrap operation. A drive circuit for driving the pixel circuits P of the pixel array portion 102 is configured, including the control portion 109 and the interface portion 130 (including the vertical IF portion 133 and the horizontal IF portion 136).

The vertical driving portion 103, for example, includes the write scanning portion (a write scanner WS) 104 and the drive scanning portion (a drive scanner DS) 105. In this case, the drive scanning portion 105 functions as a power source scanner having a power source supplying capability. The pixel array portion 102, as an example, is adapted to be driven by the write scanning portion 104 and the drive scanning portion 105 from either one side or both sides in the horizontal direction illustrated in the figures, and is adapted to be driven by the horizontal driving portion 106 from either one side or both sides in the vertical direction illustrated in the figures.

Various kinds of pulse signals are supplied from the drive signal generating portion 200 disposed outside the display device 1 to the terminal portion 108. In addition, a video signal Vsig is supplied from the video signal processing portion 220 to the terminal portion 108 similarly to the above case. In the case of the color display adaptive display device, video signals Vsig R, Vsig G, and Vsig B for colors (the three primary colors of red (R), green (G) and blue (B) in this embodiment) are supplied from the video signal processing portion 220 to the terminal portion 108.

As an example, necessary pulse signals such as shift start pulses SPDS and SPWS, and vertical scanning clocks CKDS and CKWS (including vertical scanning clocks xCKDS and xCKWS as well having inverted phases as may be necessary) as an example of write start pulses in the vertical direction are supplied as pulse signals for vertical drive to the terminal portion 108. In addition, necessary pulse signals such as a horizontal start pulse SPH and a horizontal scanning clock CKH (including a horizontal scanning clock xCKH having an inverted phase as well) as an example of write start pulses in the horizontal direction are supplied as pulse signals for horizontal drive to the terminal portion 108.

Terminals of the terminal portion 108 are connected to the vertical driving portion 103 and the horizontal driving portion 106 through wirings, respectively. For example, after the pulses supplied to the terminal portion 108 are internally adjusted in voltage levels thereof in a level shift portion (not shown) as may be necessary, they are supplied to the write scanning portion 104 and the drive scanning portion 105 of the vertical driving portion 103, and the horizontal driving portion 106, respectively, through a buffer.

Although an illustration is omitted here (details thereof will be described later) for the sake of simplicity, the pixel circuits P in each of which a pixel transistor is provided for the organic EL element as the display element are two-dimensionally disposed in a matrix in the pixel array portion 102. In this pixel arrangement, a scanning line is wired every row, and a signal line is wired every column.

For example, the scanning lines (gate lines) 104WS, and the video signal lines (data lines) 106HS are formed in the pixel array portion 102. The organic EL elements (not shown) and the thin film transistors (not shown) for driving these organic EL elements, respectively, are formed in intersection portions between the scanning lines 104WS and the video signal lines 106HS, respectively. A combination of the organic EL element and the thin film transistor configures the pixel circuit P.

Specifically, for the pixel circuits P disposed in a matrix, write scanning lines 104WS_1 to 104WS_n for n rows which are driven with a write drive pulse WS by the write scanning portion 104, and power source supply lines 105DSL_1 to 105DSL_n for the n rows which are driven with a power source drive pulse DSL by the drive scanning line 105 are wired so as to correspond to pixels rows, respectively.

The write scanning portion 104 and the drive scanning portion 105 are configured based on combinations of logical gates (including a latch, a shift register and the like as well), respectively. Also, the write scanning portion 104 and the drive scanning portion 105 select the pixel circuits P of the pixel portion 102 in units of rows, that is, successively select the pixel circuits P through the write scanning lines 104WS and the power source supply line 105DSL in accordance with a pulse signal, used for the vertical driving system, and supplied from the drive signal generating portion 200.

The horizontal driving portion 106 is configured based on a combination of logical gates (including a latch, a shift resistor, and the like). Also, the horizontal driving portion 106 selects the pixel circuits P of the pixel array portion 102 in units of columns. That is to say, the horizontal driving portion 106 samples a predetermined potential in the video signal Vsig through the corresponding one of the video signal lines 106HS in accordance with a pulse signal, used for the horizontal driving system, and supplied from the drive signal generating portion 200, thereby writing the predetermined potential in the video signal Vsig thus sampled to a storage capacitor of the pixel circuit P selected.

The display device 1 of this embodiment can carry out either line-sequential drive or point-sequential drive. Thus, the write scanning portion 104 and the drive scanning portion 105 of the vertical driving portion 103 scan the pixel array portion 102 in a line-sequential manner (that is, in units of rows). Also, the horizontal driving portion 106 either simultaneously writes the video signals for one horizontal line (in the case of the line-sequential drive) to the pixel array portion 102, or simultaneously writes the video signals to the pixel array portion 102 in units of pixels (in the case of the point-sequential drive).

In order to obtain the color image display adaptive form, for example, as shown in FIG. 2, pixel circuits P R, P G, and P B as sub-pixels for the colors (the three primary colors of red (R), green (G) and blue (B) in this embodiment) are provided in a longitudinal stripe shape in the predetermined arrangement order. A color one pixel is composed of a set of sub-pixels (corresponding to the pixel circuits P R, P G, and P B) for the colors. Although in this case, the stripe structure in which the sub-pixels for the colors are disposed in the longitudinal stripe shape is shown as an example of the sub-pixel layout, the sub-pixel layout is by no means limited to such an arrangement example. That is to say, a form may also be adopted such that the sub-pixels are shifted in the vertical direction.

Note that, FIGS. 1 and 2 show a configuration in which the portions (such as the write scanning portion 104 and the drive scanning portion 105) of the vertical driving portion 103 are disposed only in one side of the pixel array portion 102. However, it is also possible to adopt a configuration in which the portions (such as the write scanning portion 104 and the drive scanning portion 105) of the vertical driving portion 103 are disposed on both sides of the pixel array portion 102 so as to hold the pixel array portion 102 between them. In addition, as shown in FIG. 2, it is also possible to adopt a configuration in which one and the other of the portions (such as the write scanning portion 104 and the drive scanning portion 105) of the vertical driving portion are disposed on the left-hand side and the right-hand side of the pixel array portion 102, respectively.

Likewise, although in FIGS. 1 and 2, the horizontal driving portion 106 is disposed only on one side of the pixel array portion 102, it is also possible to adopt a configuration that the horizontal driving portion 106 is vertically disposed on both sides of the pixel array portion 102 so as to hold the pixel array portion 102.

In this embodiment, a configuration is adopted such that the pulse signals such as the shift start pulses SPDS and SPWS, the vertical scanning clocks CKDS and CKWS, the horizontal start pulse SPH, and the horizontal scanning clock CKH are inputted from the outside of the display panel portion 100. However, the drive signal generating portion 200 for generating the various kinds of timing pulses can also be mounted on the display panel portion 100.

Pixel Circuit

Figure 3:
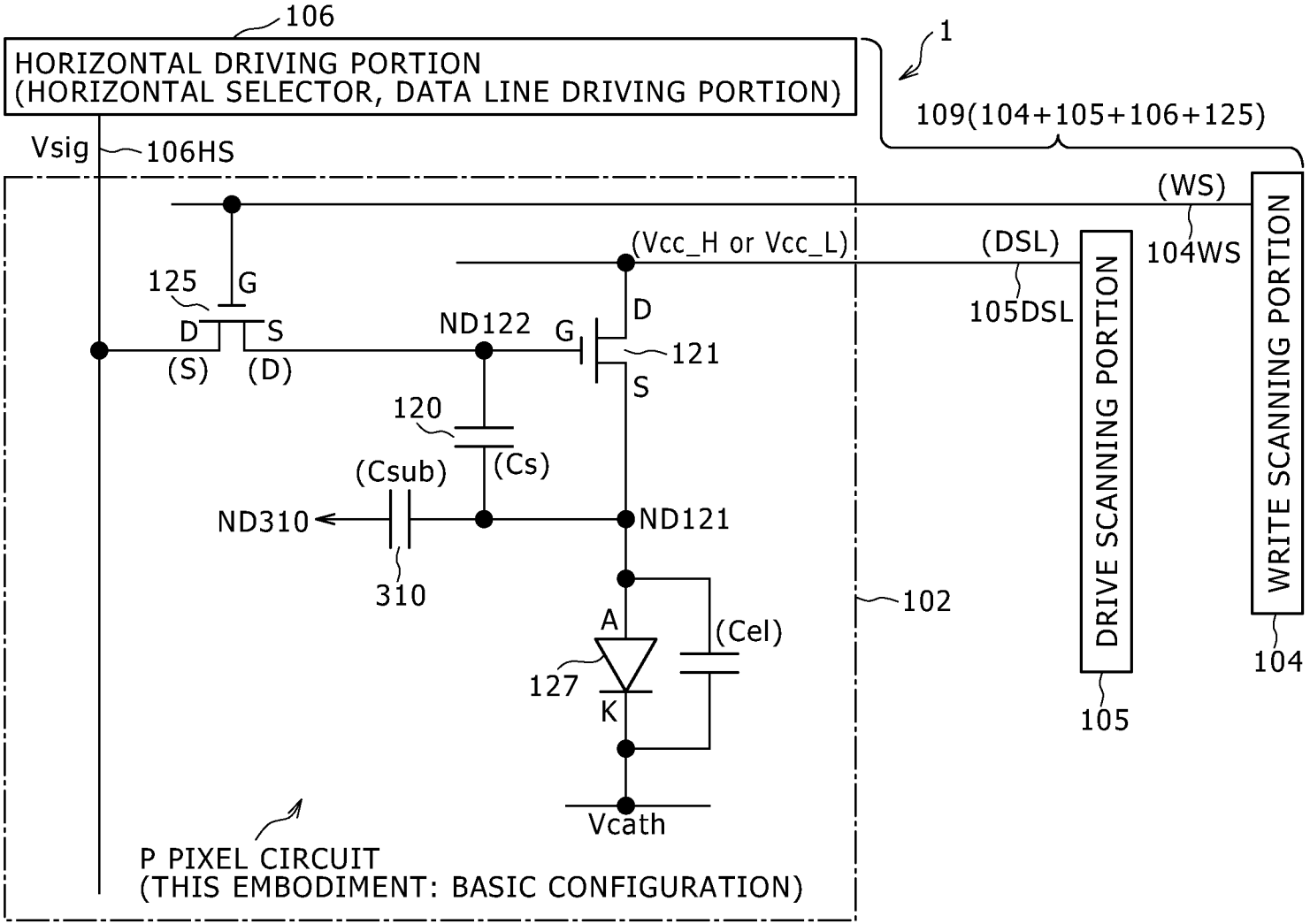
FIG. 3 is a circuit diagram, partly in block, showing a basic configuration of a pixel circuit of the active matrix type display device according to the embodiment of the present invention.
Figure 4:
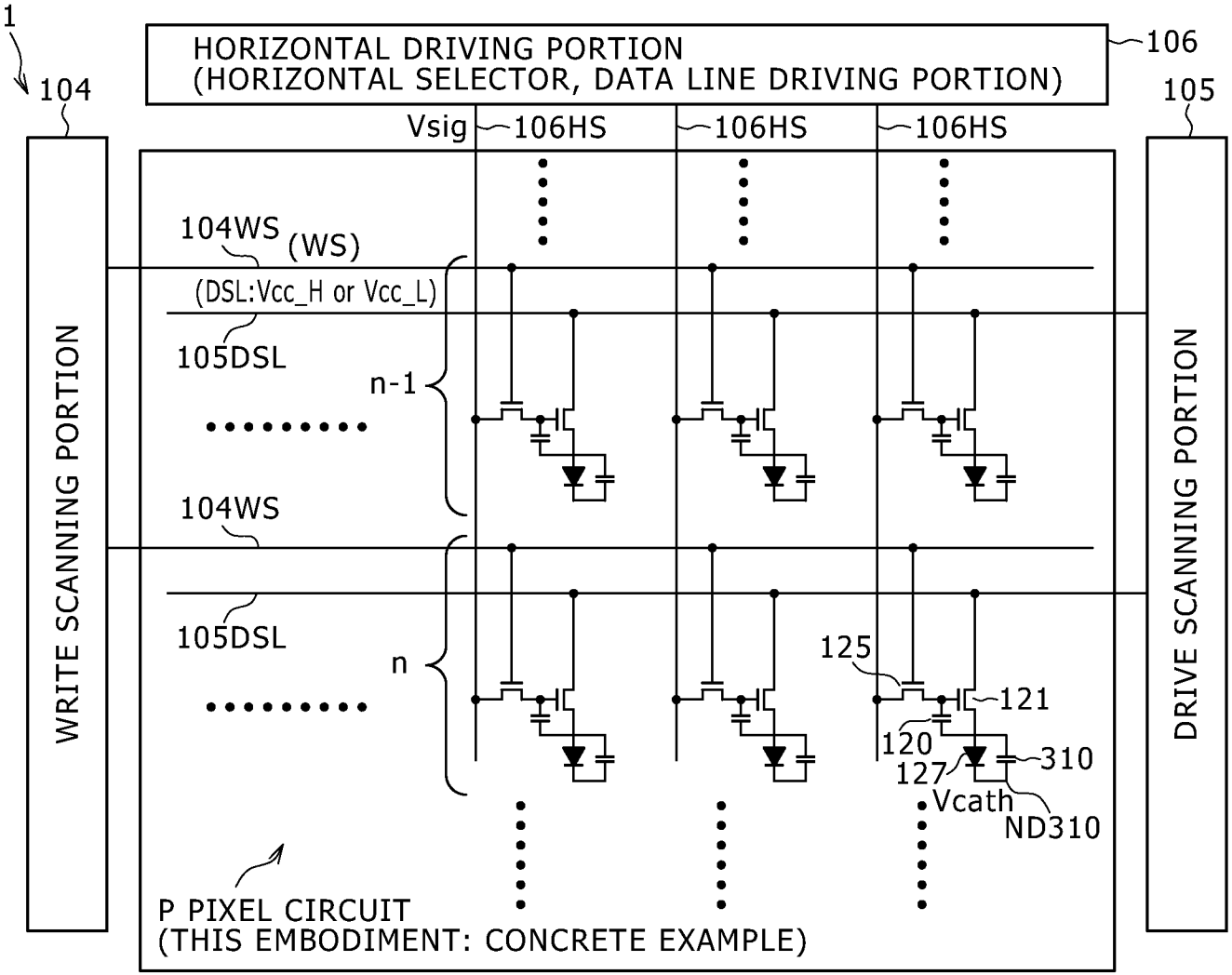
FIG. 4 is a circuit diagram, partly in block, showing a concrete configuration of the pixel circuit of the active matrix type display device according to the embodiment of the present invention.
Figure 5A:
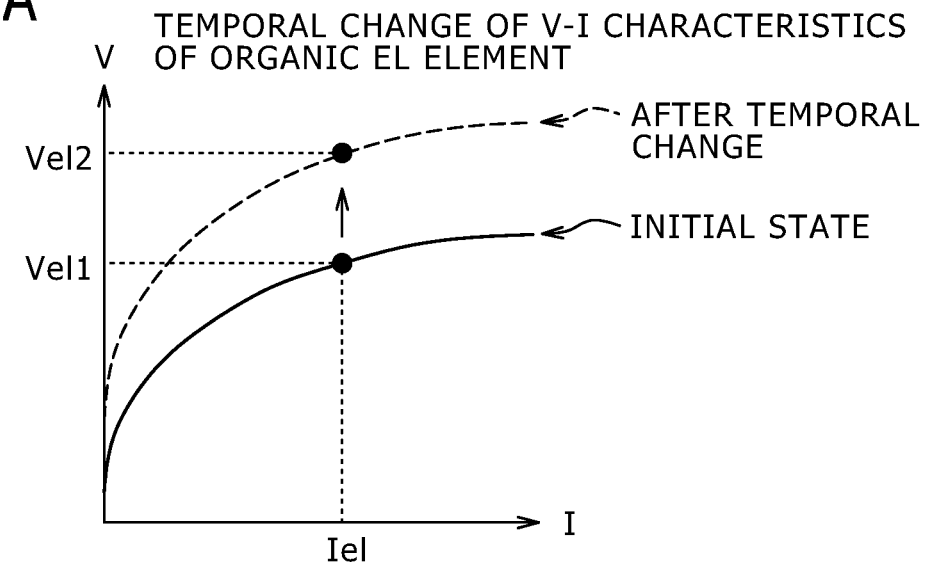
FIGS. 5A to 5C are respectively graphs explaining an influence which dispersions of characteristics of organic EL elements and drive transistors exert on a drive current.
Figure 5B:
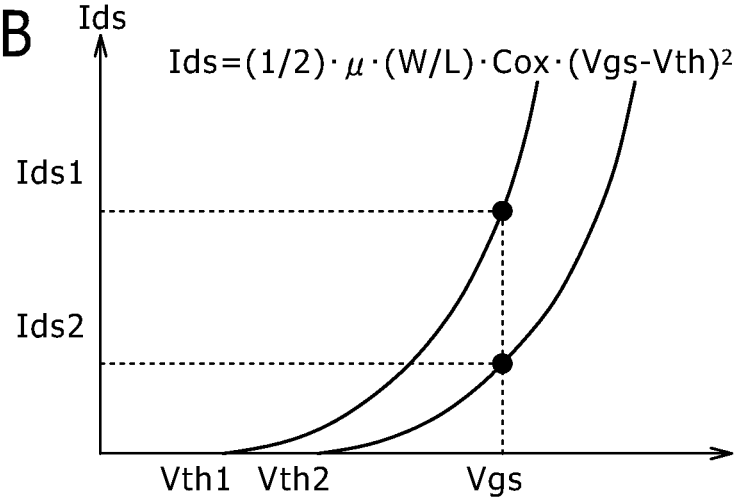
Figure 5C:
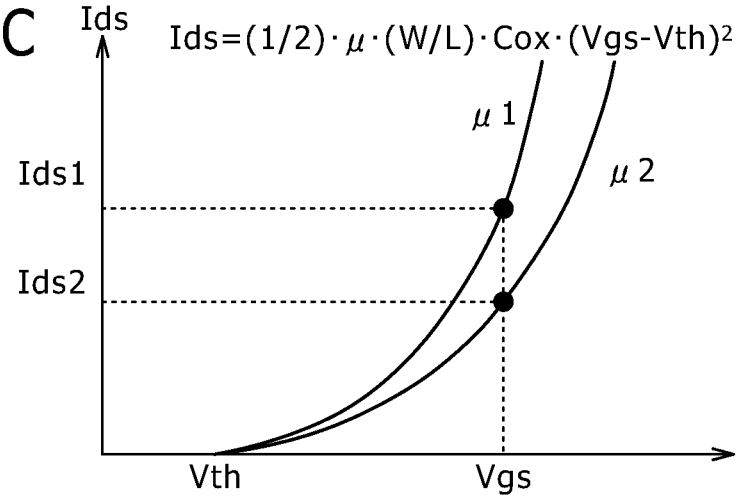

FIGS. 3 and 4 are respectively circuit diagrams, partly in blocks, showing the pixel circuit P having a basic configuration, and an organic EL display device including the pixel circuit P having a concrete configuration in this embodiment. The display device 1 including the pixel circuit P having the basic configuration in this embodiment is referred to as "the display device 1 having the basic configuration." Here, FIG. 3 shows the basic configuration, and FIG. 4 shows the concrete configuration. In these figures, the pixel circuit P is shown together with both the vertical driving portion 103 and the horizontal driving portion 106 provided in the peripheral portion of the pixel circuits P on the substrate 101 of the display panel portion 100. FIGS. 5A to 5C are respectively graphs explaining an influence which the dispersions of the characteristics of the organic EL elements 127 and the drive transistors 121 exerts on a drive current Ids. Also, FIGS. 6A to 6D are respectively graphs explaining a concept of a technique for impairing the influence shown in FIGS. 5A to 5C.

A form of the display device of this embodiment is the display device 1 in which an electro-optic element (an organic EL element 127 in this embodiment) disposed within the pixel circuit P is caused to emit a light based on the video signal Vsig. Firstly, at least a drive transistor 121, a storage capacitor 120, the organic EL element 127, and a sampling transistor 125 are provided inside each of the pixel circuits disposed in a matrix in the pixel array portion 102. In this case, the drive transistor 121 generates a drive current Ids, and the storage capacitor 120 is connected between a control input terminal (typified by a gate terminal) and an output terminal (typified by a source terminal) of the drive transistor 121. Also, the organic EL element 127 is an example of the electro-optic element having an anode connected to the output terminal of the drive transistor 121, and the sampling transistor 125 writes information corresponding to a signal amplitude Vin to the storage capacitor 120. In the pixel circuit P concerned, the drive current Ids based on the information held in the storage capacitor 120 is generated in the drive transistor 121, and is caused to flow through the organic EL element 127 as the example of the electro-optic element, thereby causing the organic EL element 127 to emit a light.

The sampling transistor 125 writes the information corresponding to the signal amplitude Vin to the storage capacitor 120. Thus, the sampling transistor 125 fetches a signal potential (Vofs+Vin) in the input terminal thereof (one of the source terminal or the drain terminal), and writes the information corresponding to the signal amplitude Vin to the storage capacitor 120 having one terminal connected to the output terminal thereof (the other of the source terminal or the drain terminal). Of course, the output terminal of the sampling transistor 125 is also connected to the control input terminal of the drive transistor 121.

It is noted that the connection configuration in the pixel circuit P shown in these figures shows the most basic one. Thus, the pixel circuit P has only to include at least the constituent elements described above, and also may include constituent elements other than these constituent elements (that is, other constituent elements). In addition, the wording "the connection" does not mean only the direct connection, and thus the connection made through other constituent elements may also be available.

For example, a change such as interposition of a switching transistor or a functioning portion having a certain function is added to the interconnection as may be necessary in some cases. Typically, in order to control dynamically a display time period (in other words, a time period for non-emission), a switching transistor may be disposed either between the output terminal of the drive transistor 121 and the anode electrode of the electro-optic element (the organic EL element 127), or between the power source supply terminal (typified by the drain terminal) of the drive transistor 121 and the power source line (the power source line 105DSL in this embodiment) as the wiring for the power source supply.

Even each of the pixel circuits of such changes is the pixel circuit realizing the display device according to the embodiment of the present invention as long as each of them can realize the constitution and the operation described in this embodiment.

In addition, the control portion 109, for example, including the write scanning portion 104 and the drive scanning portion 105 is provided in the peripheral portion for driving the pixel circuits P. In this case, the write scanning portion 104 scans the pixel circuits P in the line-sequential manner by successively controlling the sampling transistors 125 with the horizontal period, thereby writing the information corresponding to the signal amplitude Vin of the video signal Vsig to the storage capacitors for one row. Also, the drive scanning portion 105 outputs a scanning drive pulse (a power source drive pulse DSL), for control of the supply of the power source voltage, which is supplied to the power source supply terminals of the drive transistors 121 for one row in accordance with the line-sequential scanning made by the write scanning portion 104.

In addition, the horizontal driving portion 106 is provided in the control portion 109. In this case, the horizontal driving portion 106 carries out the control so that the video signal Vsig which is switched between a reference potential Vo and a signal potential (Vofs+Vin) within each of the horizontal periods in accordance with the line-sequential scanning made in the write scanning portion 104 is supplied to the sampling transistor 125.

Preferably, the control portion 109 carries out the control so as to perform the bootstrap operation in which the sampling transistor 125 is set in a non-conduction state at a time point when the information corresponding to the signal amplitude Vin is written to the storage capacitor 120 to stop the supply of the video signal Vsig to the control input terminal of the drive transistor 121, so that a potential at the control input terminal of the drive transistor 121 changes in conjunction with a change in potential at the output terminal of the drive transistor 121.

The control portion 109 preferably carries out the bootstrap operation even at the early phase of start of the light emission after completion of the sampling operation. That is to say, the sampling transistor 125 is set in the non-conduction state after the sampling transistor 125 is set in a conduction state while the signal potential (Vofs+Vin) is supplied to the sampling transistor 125, thereby maintaining a difference in potential between the control input terminal and the output terminal of the drive transistor 121 constant.

In addition, the control portion 109 preferably controls the bootstrap operation so as to realize an operation for correcting a temporal change of the electro-optic element (the organic EL element 127) in a time period for light emission. For this reason, it is better that the control portion 109 continuously sets the sampling transistor 125 in the non-conduction state for a time period for which the drive current Ids based on the information held in the storage capacitor 120 is caused to flow through the electro-optic element (the organic EL element 127) to make it possible to maintain the voltage developed across the control input terminal and the output terminal of the drive transistor 121, thereby realizing the operation for correcting a temporal change of the electro-optic element.

Even when the current vs. voltage characteristics of the organic EL element 127 change with time, the difference in potential between the control input terminal and the output terminal of the drive transistor 121 is held constant based on the bootstrap operation by the storage capacitor 120 at the time of the light emission, thereby usually holding the emission luminance constant.

In addition, preferably, the control portion 109 carries out the control so as to perform a threshold correcting operation for holding a voltage corresponding to a threshold voltage Vth of the drive transistor 121 in the storage capacitor 120 by causing the sampling transistor 125 to conduct in a time zone for which the reference potential Vo is supplied to the input terminal (typified by the source terminal) of the sampling transistor 125.

It is better that this threshold correcting operation is repetitively carried out with a plurality of horizontal periods prior to the operation for writing the information corresponding to the signal amplitude Vin to the storage capacitor 120 as may be necessary. Here, the wording "as may be necessary" is described to mean the case where the voltage corresponding to the threshold voltage of the drive transistor 121 cannot be sufficiently held in the storage capacitor 120 for a time period for the threshold correction within one horizontal period. The threshold correcting operation is carried out plural times, thereby reliably holding the voltage corresponding to the threshold voltage Vth of the drive transistor 121 in the storage capacitor 120.

In addition, more preferably, the control portion 109 carries out the control so that the sampling transistor 125 is caused to conduct in a time zone for which the reference potential Vo is supplied to the input terminal of the sampling transistor 125, thereby carrying out a preparation operation (such as a discharging operation or an initializing operation) for the threshold correction prior to the threshold correcting operation. That is to say, the potential developed across the control input terminal and the output terminal of the drive transistor 121 is initialized before the threshold correcting operation. More specifically, the storage capacitor 120 is connected between the control input terminal and the output terminal of the drive transistor 121, thereby making the setting so that the difference in potential between the both terminals of the storage capacitor 120 becomes equal to or larger than the threshold voltage Vth.

Note that, it is better that at the threshold correction with the 2TR drive configuration, the control portion 109 is provided with the drive scanning portion 105, and carries out the control so as to perform the threshold correcting operation. That is to say, in this case, the drive scanning portion 105 switches a first potential Vcc_H used to cause the drive current Ids to flow through the electro-optic element (the organic EL element 127), and a second potential Vcc_L different from the first potential Vcc_H over to each other, and outputs one of the first potential Vcc_H and the second potential Vcc_L selected through the switching. Also, the sampling transistor 125 is caused to conduct in a time zone for which a voltage corresponding to the first potential Vcc_H is supplied to the power source supply terminal of the drive transistor 121, and information corresponding to the signal amplitude Vin in the video signal Vsig is supplied to the sampling transistor 121, thereby performing the threshold correcting operation.

In addition, at the preparing operation for the threshold correction with the 2TR drive configuration, it is better to carry out the following operation. That is to say, the sampling transistor 125 is caused to conduct in a time zone for which a voltage corresponding to the second potential Vcc_L is supplied to the power source supply terminal of the drive transistor 121, and the signal potential (Vofs+Vin) is supplied to the sampling transistor 125. Also, the potential at the control input terminal, and the potential at the output terminal of the drive transistor 121 are initialized to the reference potential Vin and the second potential Vcc_L, respectively.

More specifically, the control portion 109 carries out the control so as to add information corresponding to correction for a mobility p to information to be written to the storage capacitor 120 when the sampling transistor 125 is caused to conduct, thereby writing the information corresponding to the signal amplitude Vin to the storage capacitor 120 in a time zone for which after completion of the threshold correcting operation, the voltage corresponding to the first potential Vcc_H is supplied to the sampling transistor 125 and the signal potential (Vofs+Vin) is supplied to the sampling transistor 125. In this case, it is better that in a predetermined position falling within a time zone for which the signal potential (Vofs+Vin) is supplied to the sampling transistor 125, the sampling transistor 125 is caused to conduct only for a time period shorter than the time zone. Hereinafter, an example of the pixel circuit P with the 2TR configuration will be concretely descried.

The feature of the pixel circuit P shown in FIGS. 3 and 4 is that the drive transistor is basically composed of an n-channel thin film field effect transistor. In addition, the feature of the pixel circuit P in this embodiment is that the pixel circuit P includes a circuit for suppressing a change in drive current Ids caused to flow through the organic EL element due to a temporal deterioration of the pixel circuit P, that is, a drive signal maintaining circuit (part 1) for maintaining the drive current Ids constant by correcting a change in current vs. voltage characteristics of the organic EL element as the example of the electro-optic element, and adopts a drive system for maintaining the drive current Ids constant by realizing a threshold correcting function and a mobility correcting function for preventing a change in drive current Ids due to a change in characteristics of the drive transistor (the dispersion of the threshold voltages and the dispersion of the mobilities).

With regard to a method of suppressing an influence which a change in characteristics of the drive transistor 121 (such as the dispersion and change in threshold voltage and mobility) exerts on the drive current Ids, coping with such a situation is made such that drive timings for the drive transistor 121 and the sampling transistor 125 are devised while the drive circuit with the 2TR configuration is directly adopted as the drive signal maintaining circuit (part 1).

Since the pixel circuit P in this example has the 2TR driving configuration, and thus has the less number of elements and the less number of wirings, the promotion of the high definition is made possible. In addition thereto, since the sampling can be made without deteriorating the video signal Vsig, the excellent image quality can be obtained.

In addition, the pixel circuit P in this embodiment has the feature in connection form of the storage capacitor 120. A bootstrap circuit as an example of a drive signal maintaining circuit (part 2) is configured as a circuit for preventing a change in drive current Ids due to a temporal deterioration of the organic EL element 127. The feature of the pixel circuit P in this embodiment is that the pixel circuit P includes the drive signal maintaining circuit (part 2) for realizing the bootstrap function of keeping the regular drive current (preventing the change in drive current Ids) even when there is a temporal change in current vs. voltage characteristics of the organic EL element.

Although details will be described later, the pixel circuit P in the embodiment includes a subsidiary capacitor relating to a write gain, a bootstrap gain, and a time period for mobility correction. However, it is not essential to include the subsidiary capacitor. The basic control operation in driving the pixel circuit P in this embodiment is similar to that in the pixel circuit P including as no subsidiary capacitor.

Metal oxide semiconductor (MOS) transistors are used as the transistors, respectively, including the drive transistor. In this case, a gate terminal of the drive transistor is treated as a control input terminal, one of a source terminal and a drain terminal (the source terminal in this case) is treated as an output terminal, and the other thereof is treated as a power source supply terminal (the drain terminal in this case).

Specifically, as shown in FIGS. 3 and 4, the pixel circuit P in this embodiment includes the n-channel drive transistor 121, the n-channel sampling transistor 125, and the organic EL element 127 as the example of the electro-optic element which emits a light by causing a current to flow through the organic EL element 127. The organic EL element 127 is represented by a symbol of a diode because in general, it has a rectifying property. It is noted that a parasitic capacitance Cel exists in the organic EL element 127. In FIGS. 3 and 4, the parasitic capacitance Cel is shown so as to be connected in parallel with the organic EL element 127 (the symbol thereof is represented by a symbol of the diode).

A drain terminal D of the drive transistor 121 is connected to a power source supply line DSL through which a first power source potential Vcc_H is supplied, and a source terminal (output terminal) S thereof is connected to an anode terminal A of the organic EL element 127 (a connection point between the source terminal S of the drive transistor 121, and the anode terminal A of the organic EL element 127 is a node ND121). Also, a cathode terminal K of the organic EL element 127 is connected to a grounding wiring Vcath (GND), common to all the pixels, through which the reference potential is supplied.

It is noted that the grounding wiring Vcath may be formed as only a wiring (upper layer wiring) having a single layer therefor, or for example, a subsidiary wiring for a cathode wiring may be provided to reduce a resistance value of the cathode wiring. The subsidiary wiring is wired in a lattice, in a column, or in a row within the pixel array portion 102 (display area) and each of them is at the same potential as that of the upper layer wiring, i.e., at the fixed potential.

A gate terminal G of the sampling transistor 125 is connected to the write scanning line 104WS extending from the write scanning portion 104, a drain terminal D thereof is connected to a video signal line 106HS, and a source terminal S thereof is connected to the gate terminal G of the drive transistor 121 (a connection point between the source terminal S of the sampling transistor 125, and the gate terminal G of the drive transistor 121 is a node ND122). A write drive pulse WS at an active H level is supplied from the write scanning portion 104 to the gate terminal G of the sampling transistor 125. For the sampling transistor 125, a connection form may also be adopted such that the source terminal S and the drain terminal D are replaced with each other.

The drain terminal D of the drive transistor 121 is connected to a power source supply line 105DSL extending from the drive scanning portion 105 functioning as a power source scanner. The feature of the power source supply line 105DSL is that the power source supply line 105DSL itself includes a power source supplying capability for the drive transistor 121.

The drive scanning portion 105 switches the first potential Vcc_H, on the high potential side, corresponding to the power source voltage, and the second potential Vcc_L (referred to as either "an initialization voltage" or "an initial voltage Vini" as well), on the low voltage side, which is utilized for a preparing operation prior to the threshold correction over to each other, and supplies one of them selected through the switching to the drain terminal D of the drive transistor 121.

The drain terminal D side of the drive transistor 121 is driven by using a power source drive pulse DSL adapted to take two values of the first potential Vcc_H and the second potential Vcc_L, thereby making it possible to perform the preparing operation prior to the threshold correcting operation. The second potential Vcc_L is set as a potential which is sufficiently lower than the reference potential Vo (referred to as "the offset voltage Vofs" as well) of the video signal Vsig on the video signal line 106HS. Specifically, the second potential Vcc_L, on the low potential side, on the power source supply line 105DSL is set so that a gate-to-source voltage Vgs (a difference between the gate potential Vg and the source potential Vs) of the drive transistor 121 becomes larger than the threshold voltage Vth of the drive transistor 121. It is noted that the reference potential Vo (Vofs) is utilized to previously precharge the video signal line 106HS as well as is utilized for the initializing operation prior to the threshold correcting operation.

In such a pixel circuit P, when the organic EL element 127 is driven, the first potential Vcc_H is supplied to the drain terminal D of the drive transistor 121, and the source terminal S is connected to the anode terminal A side of the organic EL element 127, thereby forming a source follower circuit as a whole.

The feature of adoption of such a pixel circuit P is described as follows. There is adopted the 2TR drive configuration using one switching transistor (the sampling transistor 125) for the scanning in addition to the drive transistor 121. Also, the influence which the temporal change of the organic EL element 127 and the change in characteristics of the drive transistor 121 (such as the dispersion and change in threshold voltage and mobility) exert on the drive current Ids is prevented based on the setting of the ON/OFF timing for the power source drive pulse DSL and the write drive pulse WS which are used to control the switching transistors.

In addition thereto, in the display device 1 of this embodiment, the subsidiary capacitor 310 as a capacitor having a capacitance value Csub is added to the node ND121 (the connection point among the source terminal S of the drive transistor 121, one terminal of the storage capacitor 120, and the anode terminal A of the organic EL element 127) every pixel circuit P. Also, a connection portion of the other terminal (referred to as "a node ND310") of the subsidiary capacitance 310 is made to correspond to the power source supply line 105DSL of the auto-row (auto-stage). As a result, the subsidiary capacitance 310 is connected in parallel with the organic EL element 127 (and the parasitic capacitance Cel thereof) in terms of an electrical circuit.

In this embodiment, as in the case of the concrete example shown in FIG. 4, the grounding wiring Vcath (may be either the upper layer wiring or the subsidiary wiring), common to all the pixels, to which the cathode terminals K of all the organic EL elements 127 are connected is connected to the node ND310. In this embodiment, the connection point of the node ND310 is made correspond to the cathode wiring for the organic EL element 127. In addition thereto, however, it is expected that for example, the connection point of the node ND310 is made correspond to the power source supply line 105DSL of the auto-stage (row) or is made correspond to the power source supply line 105DSL of the stage other than the auto-stage (row), or fixed potential (including the grounding potential) having an arbitrary value is set at the connection point of the node ND310. Although the advantages and the disadvantages are offered depending on which of the lines or the like the connection point of the node ND310 is made to correspond to, a description thereof is omitted here for the sake of simplicity.

The capacitance value Cs of the storage capacitor 120, and the capacitance value Cel of the parasitic capacitance Cel of the organic EL element 127 are determined so that a balance is struck between a write gain Ginput and a bootstrap gain Gbst, thereby causing each of the write gain Ginput and the bootstrap gain Gbst to become proper. Adjustment of the capacitance value Csub of the subsidiary capacitor 310 makes it possible to adjust the write gain Ginput and the bootstrap gain Gbst.

In addition, when the above is utilized, a white balance can also be obtained by relatively adjusting the capacitance value Csub of the subsidiary capacitor 310 among the three pixels for colors corresponding to R, G and B, respectively. That is to say, the emission efficiencies of the organic EL elements 127 for R, G and B are different from one another. Thus, since when there is no subsidiary capacitor 310, no white balance can be obtained in the case of the same drive current Ids (i.e., the same signal amplitude Vin), the signal amplitude Vin is made to differ so as to correspond to R, G and B, thereby obtaining the white balance. On the other hand, the capacitance value Csub of the subsidiary capacitor 310 is relatively adjusted among the pixels corresponding to R, G and B, respectively, which results in that the white balance is obtained even in the case of the same drive current Ids (i.e., the same signal amplitude Vin).

In addition thereto, the addition of the subsidiary capacitor 310 results in that a time period required for correction of the mobility p (a time period for mobility correction) can be adjusted without exerting the influence on the threshold correcting operation. The time period for mobility correction can be adjusted by utilizing the subsidiary capacitor 310, which results in that even when the driving speed for the pixel circuit P is speeded up, the mobility p can be sufficiently corrected.

Basic Operation

Firstly, although an illustration is omitted here for the sake of simplicity, an operation of a pixel circuit P which includes no subsidiary capacitor 310, and in which one terminal of the storage capacitor 120 is connected to the node ND122, and the other terminal thereof is connected to the grounding wiring Wcath (GND) common to all the pixels will be described as that of a comparative example when the feature of the pixel circuit P in this embodiment shown in FIGS. 3 and 4 is described. Hereinafter, such a pixel circuit P will be referred to as "the pixel circuit P of a first comparative example." In addition, although an illustration is omitted here for the sake of simplicity, a pixel circuit having a configuration in which the subsidiary capacitor 310 is removed from the pixel circuit P in this embodiment will be referred to as "a pixel circuit P of a second comparative example."

In the case where a 3TR drive configuration in which an emission controlling transistor for controlling an emission time period is added is adopted as a change of the pixel circuit P of the first comparative example, for example, a connection form is described as follows. That is to say, the source terminal of the drive transistor 121 is connected to a drain terminal D of an n-channel emission controlling transistor, and a source terminal S of the n-channel emission controlling transistor is connected to the anode terminal A of the organic EL element 127.

In the pixel circuit P of the first comparative example (including the change as well adopting the 3TR drive configuration), when the organic EL element 127 is driven irrespective of whether or not the emission controlling transistor is provided, the drain terminal D side of the drive transistor 121 is connected to the first power source potential, and the source terminal S side thereof is connected to the anode terminal A side of the organic EL element 127. As a result, a source follower circuit is formed as a whole.

Although an illustration of a timing chart when the pixel circuit P of the first comparative example is driven is omitted here for the sake of simplicity, the potential of the wide scanning line WS transits from the low level to the high level in a time zone for which the video signal line 106HS is held at the signal potential corresponding to an effective time period for the video signal Vsig. As a result, the n-channel sampling transistor 125 is turned ON, so that the storage capacitor 120 is charged with the electricity corresponding to the video signal line potential supplied from the signal line HS. This time period corresponds to a sampling time period for the video signal Vsig, and a time period following this time period corresponds to a hold time period. As a result, the potential (the gate potential Vg) at the gate terminal G of the drive transistor 121 starts to rise, thereby starting the drain current to be caused to flow through the drive transistor 121. For this reason, the anode potential of the organic EL element 127 rises to start to emit a light.

After that, when the write drive pulse WS transits from the high level to the low level, a video signal line potential at this time point, that is, a potential (signal potential), for the effective time period, of the potentials of the video signal Vsig is held in the storage capacitor 120. As a result, the gate potential Vg of the drive transistor 121 becomes constant, and the emission luminance is maintained constant until a next frame (or a field).

Here, in the pixel circuit P of the first comparative example, a potential (a source potential Vs) at the source potential S of the drive transistor 121 depends on an operating point between the drive transistor 121 and the organic EL element 127. Also, a voltage value of the potential (the source potential Vs) has different values depending on the gate potential Vg of the drive transistor 121.

In general, the MOS type drive transistor 121 is driven in a saturated region. Therefore, the drive transistor 121 serves as a constant current source having a value of a current Ids expressed by Expression (1):

$$Ids = \frac{1}{2}\mu\frac{W}{L}Cox(Vgs - Vth)^2 \quad (1)$$

where Ids is a current caused to flow between a drain terminal and a source terminal of a transistor operating in a saturated region, p is a mobility, W is a channel width (gate width), L is a channel length (gate length), Cox is a gate capacitance (a capacitance of a capacitor having a gate oxide film as an insulator per unit area), Vgs is a gate-to-source voltage, and Vth is a threshold voltage of the transistor.

As apparent from Expression (1), the drain current Ids of the transistor operating in the saturated region is controlled by the gate-to-source voltage Vgs.

I-V Characteristics of Organic EL Element

In current voltage (I-V) characteristics of the organic EL element shown in FIG. 5A, a curve indicated by a solid line represents characteristics in a phase of an initial state, and a curve indicated by a broken line represents characteristics after a temporal change. In general, the I-V characteristics of the organic EL element are deteriorated with time as shown in these graphs.

In the pixel circuit P of the first comparative example, the operating point changes due to this temporal change. Thus, even when the same gate potential Vg is applied to the gate terminal of the drive transistor 121, the source potential Vs of the drive transistor 121 changes accordingly. As a result, the gate-to-source voltage Vgs of the drive transistor 121 changes. As a result, from Expression (1), when the gate-to-source voltage Vgs changes, the drive current Ids changes accordingly even if the gate potential Vg is held constant, and at the same time, the current caused to flow through the organic EL element 127 also changes. When the I-V characteristics of the organic EL element 127 changes in such a way, in the pixel circuit P, of the first comparative example, having the source follower configuration shown in FIG. 3, the emission luminance of the organic EL element 127 changes with time.

In the simple circuit using the n-channel transistor as the drive transistor 121, the source terminal S is connected to the organic EL element 127 side. Thus, the gate-to-source voltage Vgs changes with the temporal change in characteristics of the organic EL element 127, so that an amount of current caused to flow through the organic EL element 127 changes. As a result, the emission luminance changes.

A change in anode potential of the organic EL element 127 due to a temporal change in characteristics of the organic EL element 127 as an example of the light emitting element appears in the form of a change in gate-to-source voltage Vgs of the drive transistor 121, thereby causing a change in drain current (the drive current Ids). A change in drive current owing to this cause appears in the form of the dispersion of the emission luminance every pixel circuit P, thereby causing the deterioration of the image quality.

On the other hand, although details will be described later, there are obtained the circuit configuration and drive timing for realizing the bootstrap function of causing the potential Vg at the gate terminal G to change in conjunction with the change in potential Vs at the source terminal S of the drive transistor 121. In this case, even when there is the change in anode potential (i.e., the change in source potential) of the organic EL element 127 due to the temporal change in characteristics of the organic EL element 127, the gate potential Vg is changed so as to cancel that change, thereby making it possible to ensure the uniformity of the picture luminance. Thus, the bootstrap function can enhance the temporal deterioration correcting capability of the current drive type light emitting element typified by the organic EL element.

Of course, in the course in which the emission current Iel starts to be caused to flow through the organic EL element 127 at a time point of start of the light emission, and continuously rises until the anode-to-cathode voltage Vel becomes stable, the bootstrap function also works when the source potential Vs of the drive transistor 121 changes along with the change in anode-to-cathode voltage Vel.

Vgs-Ids Characteristics of Drive Transistor

In addition, the characteristics such as the threshold voltage and the mobility change every pixel circuit P due to the dispersion of the manufacturing processes for the drive transistors 121. In the case as well where the drive transistor 121 is driven in the saturated region, even when the same gate potential is supplied to each of the drive transistors 121 of the pixel circuits P, the drain current (the drive current Ids) changes every pixel circuit P due to the change in characteristics, and the change in drain current appears in the form of the dispersion of the emission luminances.

For example, FIG. 5B is a graph showing voltage vs. current (Vgs–Ids) characteristics obtained by paying attention to the dispersion of the thresholds of the drive transistors 121. The characteristic curves are given with respect to the two drive transistor 121 having different thresholds Vth1 and Vth2.

As previously stated, the drain current Ids when the drive transistor 121 operates in the saturated region is expressed by Expression (1). As apparent from Expression (1), when the threshold voltage Vth changes, the drain current Ids changes accordingly even when the gate-to-source voltage Vgs is held constant. That is to say, if the measures are not taken to cope with the dispersion of the threshold voltages Vth at all, as shown in FIG. 5B, the drive current corresponding to the gate-to-source voltage Vgs is Ids1 when the threshold voltage is Vth1, whereas the drive current Ids2 corresponding to the same gate-to-source voltage Vgs when the threshold voltage is Vth2 is different from the drive current Ids1.

In addition, FIG. 5C is a graph showing voltage vs. current (Vgs–Ids) characteristics obtained by paying attention to the dispersion of the mobilities of the drive transistors 121. The characteristic curves are given with respect to the two drive transistors 121 having different mobilities μ1 and μ2.

As apparent from Expression (1), when the mobility p changes, the drain current Ids changes accordingly even when the gate-to-source voltage Vgs is held constant. That is to say, if the measures are not taken to cope with the dispersion of the mobilities μ at all as shown in FIG. 5C, the drive current corresponding to the gate-to-source voltage Vgs is Ids1 when the mobility is μ1, whereas the drive current Ids2 corresponding to the same gate-to-source voltage Vgs when the mobility is μ2 is different from Ids1.

Concept of Threshold Correction and Mobility Correction

On the other hand, by obtaining the drive timing (details will be described later) for realizing the threshold correcting function and the mobility correcting function, as can be understood from FIGS. 6A to 6D, influences of these changes can be suppressed, and thus the uniformity of the picture luminance can be ensured.

In the threshold correcting operation and the mobility correcting operation in this embodiment, although details will be described later, when a write gain is assumed to be 1 (ideal value), the gate-to-source voltage Vgs in the phase of the light emission is expressed by "Vin+Vth−ΔV." As a result, the drain-to-source current Ids is prevented from depending on the dispersion and change in threshold voltage Vth, and is also prevented from depending on the dispersion and change in mobility μ. As a result, even when the threshold voltage Vth and the mobility p change due to the manufacturing processes, no drive current Ids changes and also no emission luminance of the organic EL element 127 changes.

For example, in the current vs. voltage characteristics of the drive transistor 121 shown in FIGS. 6A to 6D, an axis of abscissa represents the signal amplitude Vin, and an axis of ordinate represents the drive current Ids. Also, in these figures, the characteristic curves are given with respect to a pixel circuit Pa (a curve indicated by a solid line), and a pixel circuit Pb (a curve indicated by a dotted line), respectively. In this case, the pixel circuit Pa is composed of the drive transistor 121 having the relatively low threshold Vth and the relatively large mobility μ. Conversely, the pixel circuit Pb is composed of the drive transistor 121 having the relatively high threshold Vth and the relatively small mobility μ.

FIG. 6A shows a graph in the case where none of the threshold correction and the mobility correction is carried out. In this case, since none of the threshold correction and the mobility correction is carried out at all for the pixel circuit Pa and the pixel circuit Pb, there is a large difference in Vin−Ids characteristics between the pixel circuit Pa and the pixel circuit Pb due to the difference in threshold voltage Vth and mobility p between them. Therefore, even when the same signal amplitude Vin is supplied, there is a difference in drive current Ids, that is, in emission luminance, and thus the uniformity of the picture luminance cannot be obtained.

FIG. 6B shows a graph in the case where the threshold correction is carried out, but no mobility correction is carried out. In this case, a difference in threshold voltage Vth between the pixel circuit Pa and the pixel circuit Pb is canceled. However, a difference in mobility p between the pixel circuit Pa and the pixel circuit Pb appears as it is. Therefore, a difference in mobility p between the pixel circuit Pa and the pixel circuit Pb remarkably appears in a region having the high signal amplitude Vin (that is, a region having a large luminance), and thus the luminance differs even in the same gradation. Specifically, in the same gradation (in the same signal amplitude Vin), the luminance (the direct current Ids) of the pixel circuit Pa having the large mobility p is high, and the luminance of the pixel circuit Pb having the small mobility p is low.

FIG. 6C shows a graph in the case where both the threshold correction and the mobility correction are carried out. A difference in threshold voltage Vth between the pixel circuit Pa and the pixel circuit Pb, and a difference in mobility p between the pixel circuit Pa and the pixel circuit Pb are both preferably corrected. As a result, the Vin−Ids characteristics of the pixel circuit Pa agree with those of the pixel circuit Pb. Therefore, in all the gradations (in all the signal amplitudes Vin), the luminances (drain current Ids) of the pixel circuit Pa have the same levels as those of the pixel circuit Pb, and thus the uniformity of the picture luminance is remarkably improved.

FIG. 6D shows a graph in the case where although both the threshold correction and the mobility correction are carried out, the correction for the threshold voltage Vin is insufficiently carried out. For example, the case where the voltage corresponding to the threshold voltage Vth of the drive transistor 121 cannot be sufficiently held in the storage capacitor 120 only in one threshold correcting operation corresponds to an example in this case. In this case, since no difference in threshold voltage Vth between the pixel circuit Pa and the pixel circuit Pb is removed, there is a difference in luminance (drive current Ids) between the pixel circuit Pa and the pixel circuit Pb in a region having a low gradation. As a result, when the correction for the threshold voltage Vth is insufficiently carried out, non-uniformity of the luminance appears in the low gradation, thereby impairing the image quality.

Operation of Pixel Circuit: Second Comparative Example

Figure 7:
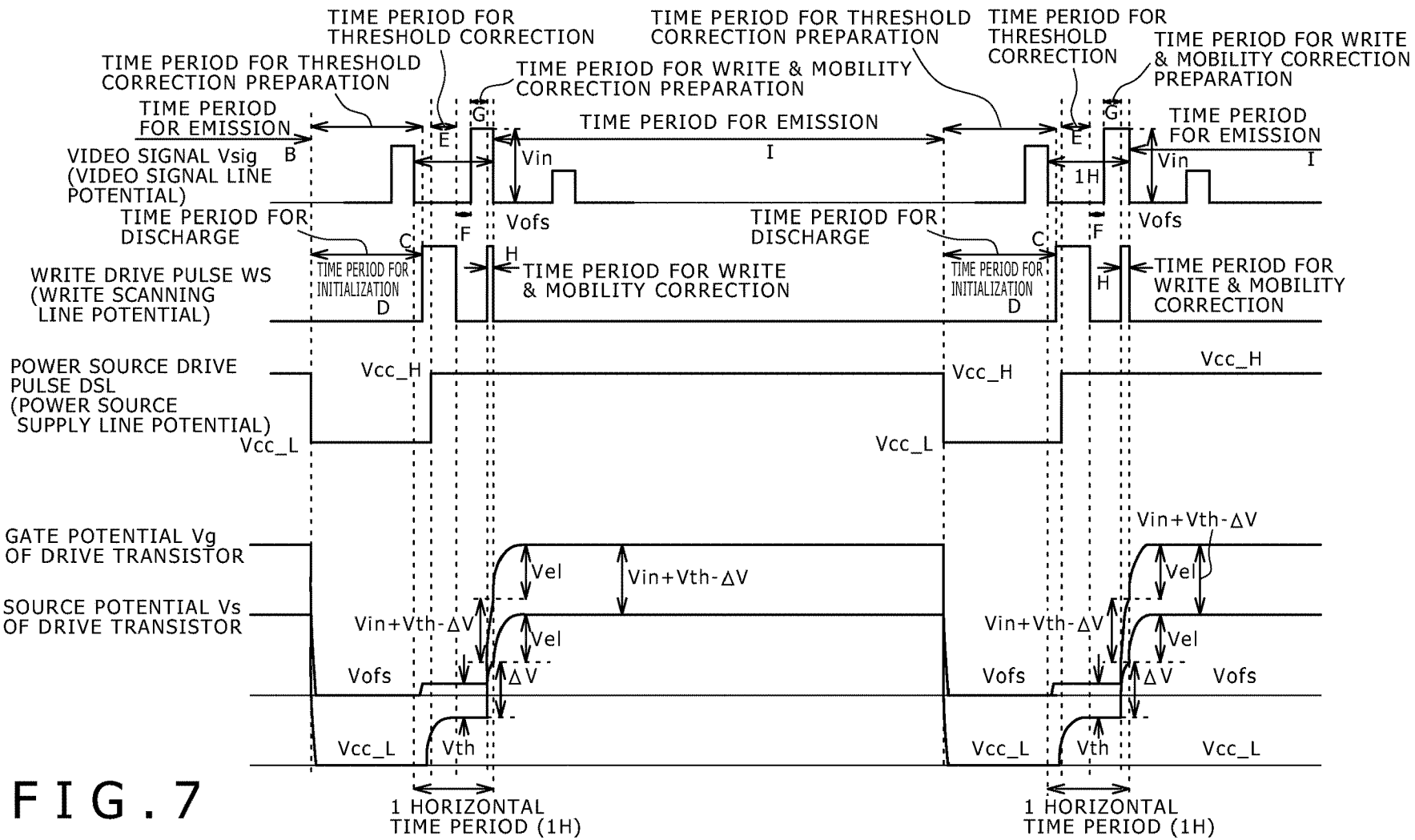
FIG. 7 is a timing chart explaining a basic example of a driving timing for pixel circuits of a second comparative example, and the pixel circuits of the embodiment of the present invention.

FIG. 7 is a timing chart explaining an operation when the information corresponding to the signal amplitude Vin is written to the storage capacitor 120 by utilizing the line-sequential system as an example of a drive timing relating to the pixel circuit P shown in the first comparative example, or shown in this embodiment of FIGS. 3 and 4.

FIG. 7 shows a change in potential of the write scanning line 104WS, a change in potential of the power source supply line 105DSL, and a change in potential of the video signal line 106HS with a time axis being common to them. Also, FIG. 7 shows changes in gate potential Vg and source potential Vs of the drive transistor 121 in parallel with these potential changes. Basically, the same driving operation is carried out with a delay by a time period for one horizontal scanning every one row of the write scanning line 104WS and the power supply line 105DSL.

The pixel circuit P in this embodiment shown in FIGS. 3 and 4, or in the second comparative example (having a configuration including no subsidiary capacitor 310) is loaded with a circuit (bootstrap circuit) and adopts the driving system. In this case, the circuit (bootstrap circuit) prevents a change in drive current due to the temporal deterioration of the organic EL element 127 in the pixel circuit P of the first comparative example. Also, the driving system is adopted in order to prevent a change in driving current due to a change in characteristics of the drive transistor 121 (the dispersion of the threshold voltages, and the dispersion of the mobilities).

In the pixel circuit P of the second comparative example (practically speaking, the pixel circuit P in this embodiment, and the drive timing alike), the drive timing is described as follows. Firstly, the sampling transistor 125 is caused to conduct in accordance with the write driving pulse WS supplied from the write scanning line 104WS to sample the video signal Vsig supplied from the video signal line 106HS, thereby holding the video signal Vsig thus sampled in the storage capacitor 120. This respect is basically identical to the case where the pixel circuit P of the first comparative example is driven.

Hereinafter, in order to facilitate the description and the understanding, unless otherwise noted, a description will be given on the assumption that the write gain is 1 (ideal value).

Here, the write gain means a rate of a magnitude of information, corresponding to the signal amplitude Vin, written to the storage capacitor 120. Specifically, in a capacitor series circuit of an entire capacitor C1, including the parasitic capacitance, disposed in parallel with the storage capacitor 120 in terms of the electrical circuit, and an entire capacitor C2 disposed in series with the storage capacitor 120 in terms of the electrical circuit, the write gain relates to an amount of electric charges allocated to the capacitor C1 when the information corresponding to the signal amplitude Vin is supplied to the capacitor series circuit. When the write gain is expressed in the form of an expression, the write gain Ginput=C2/(C1+C2)=1−C1/(C1+C2) is obtained.

It is noted that at the drive timing in the pixel circuit P of the second comparative example, the line-sequential driving for simultaneously transmitting the video signals for one row to the video signal lines 106HS corresponding to the columns, respectively, is carried out from a viewpoint of the sequential scanning when the information corresponding to the signal amplitude Vin of the video signal Vsig is written to the storage capacitor 120.

In the pixel circuit P with the 2TR drive configuration, in a basic way of thinking when both the threshold correction and the mobility correction are carried out at the drive timing in the pixel circuit P of the second comparative example, firstly, the video signal Vsig has the reference potential Vo (Vofs) and the signal potential (Vofs+Vin) for one H time period in a time division manner. Specifically, a time period for which the video signal Vsig is held at the reference potential Vo (Vofs) corresponding to a non-effective time period is set as a first half of the one horizontal time period, and a time period for which the video signal Vsig is held at the signal potential (Vofs+Vin) corresponding to an effective time period is set as a second half of the one horizontal time period.

In addition, the write drive pulse WS used for write of the signal is also used for the threshold correction and the mobility correction. The write drive pulse WS is made active twice for one H time period, thereby turning ON the sampling transistor 125. Also, the threshold correction is carried out at a first round of an ON timing, and both the signal voltage writing operation and the mobility correcting operation are simultaneously carried out at a second round of the ON timing. After that, the drive transistor 121 receives the current supplied from the power source supply line 105DSL at the first potential Vcc_H (on the high potential side), and causes the drive current Ids to flow through the organic EL element 127 in correspondence to the signal potential (the potential corresponding to the potential for the effective time period of the video signal Vsig) held in the storage capacitor 120.

For example, the vertical driving portion 103 outputs the write drive pulse WS as a control signal in accordance with which the sampling transistor 125 is caused to conduct in a time zone for which the power source supply line 105DSL is at the first potential Vcc_H, and the video signal line 106HS is at the reference potential Vo (Vofs) corresponding to the non-effective time period of the video signal Vsig. Also, the vertical driving portion 103 holds the voltage corresponding to the threshold voltage Vth of the drive transistor 121 in the storage capacitor 120. This operation realizes the threshold correcting function. The influence of the threshold voltage Vth of the drive transistor 121 which disperses every pixel circuit P can be canceled by the threshold correcting function.

With regard to the drive timing in the pixel circuit P of the second comparative example, it is better that the vertical driving portion 103 repetitively carries out the threshold correcting operation for a plurality of horizontal time periods prior to the sampling for the information corresponding to the signal amplitude Vin, and reliably holds the voltage corresponding to the threshold voltage Vth of the drive transistor 121 in the storage capacitor 120.

In the manner as described above, the threshold correcting operation is carried out plural times in the pixel circuit P of the second comparative example, thereby ensuring a sufficiently long write time period. As a result, the voltage corresponding to the threshold voltage Vth of the drive transistor 121 can be reliably, previously held in the storage capacitor 120.

The voltage, thus held, corresponding to the threshold voltage Vth is used to perform the canceling for the threshold voltage Vth of the drive transistor 121. Therefore, even when the hold voltage Vth of the drive transistor 121 disperses every pixel circuit P, the dispersion is perfectly canceled every pixel circuit P. As a result, the uniformity of the image, that is, the uniformity of the emission luminance over the entire picture of the display device is increased. In particular, it is possible to prevent the luminous non-uniformity which is ready to appear when the low gradation is provided based on the signal potential.

Preferably, the vertical driving portion 103 makes the write drive pulse WS active (at an H level in this embodiment) in a time zone for which the power source supply line 105DSL is at the second potential Vcc_L and the video signal line 106HS is set at the reference potential Vo (Vofs) corresponding to the non-effective time period of the video signal Vsig prior to the threshold correcting operation. After that, the vertical driving portion 103 sets the power source supply line 105DSL at the first potential Vcc_H while the write drive pulse WS is held at being active (at the H level).

As a result, the threshold correcting operation starts (for a time period E for threshold correction) after the source terminal S of the drive transistor 121 is set at the second potential Vcc_L sufficiently lower than the reference potential Vo (Vofs) (for a time period C for discharge), and the gate terminal G of the drive transistor 121 set at the reference potential Vo (Vofs) (for a time period D for initialization). Such an operation for resetting the gate potential and the source potential (initializing operation) of the drive transistor 121 is carried out, thereby making it possible to reliably carry out the threshold correcting operation following the initializing operation. It is noted that a combination of the time period C for discharge with the time period D for initialization is referred to as "a time period for preparation for threshold correction" as well for which both the gate potential Vg and the source potential Vs of the drive transistor 121 are initialized.

For the time period E for threshold correction, the potential of the power source supply line 105DSL transits from the second potential Vcc_L on the low potential side to the first potential Vcc_H on the high potential side. As a result, the source potential Vs of the drive transistor 121 starts to rise. That is to say, the gate terminal G of the drive transistor 121 is held at the reference potential Vo (Vofs) of the video signal Vsig. Thus, the drain current attempts to be caused to flow through the drive transistor 121 until the potential Vs at the source terminal S of the drive transistor 121 rises to cut off the drive transistor 121. After completion of the cutting-off, the source potential Vs of the drive transistor 121 becomes "Vo−Vth." It is noted that in order to exclusively cause the drain current Ids to flow through the storage capacitor 120 side (when Cs«Cel), and to prevent the drain current Ids from being caused to flow through the organic EL element 127 side for the time period E for threshold correction, the potential Vcath of the common grounding wiring cath is set so that the organic EL element 127 is cut off.

An equivalent circuit of the organic EL element 127 is represented in the form of a parallel circuit of the diode and the parasitic capacitance Cel. Therefore, the drain current Ids of the drive transistor 121 is used to charge both the storage capacitor 120 and the parasitic capacitor Cel with the electricity as long as s relationship of "Vel Vcath+VthEL" is established, that is, a leakage current from the organic EL element EL element 127 is considerably smaller than the current Ids caused to flow through the drive transistor 121.

As a result, when a current path of the drain current Ids caused to flow through the drive transistor 121 is cut, the voltage Vel at the anode terminal A of the organic EL element 127, that is, the potential at the node ND121 rises with time. Also, when a potential difference between the potential (the source potential Vs) at the node ND121 and the voltage (the gate potential Vg) at the node ND122 becomes just equal to the threshold voltage Vth, the drive transistor 121 is switched from the ON state over to the OFF state, so that no drain current Ids is caused to flow through the drive transistor 121, thereby completing the time period for threshold correction. That is to say, after a lapse of a given time, the gate-to-source voltage Vgs of the drive transistor 121 takes a value of the threshold voltage Vth.

Here, although the time period for threshold correction may be carried out only once, this operation is not essential to the present invention. The threshold correcting operation may be repetitively carried out plural times with one horizontal period as a processing cycle. For example, actually, the voltage corresponding to the threshold voltage Vth is written to the storage capacitor 120 connected between the gate terminal G and source terminal S of the drive transistor 121. However, the time period E for threshold correction ranges from a timing at which the write drive pulse WS is set as the active H level to a timing at which the write drive pulse WS is returned back to the inactive L level. Thus, when the time period E for threshold correction is not sufficiently ensured, it ends in and before completion of the above processing. In order to solve this problem, it is better to repetitively carry out the threshold correcting operation plural times. In this case, an illumination of the timing concerned is omitted here for the sake of simplicity.

It is noted that the reason that when the threshold correcting operation is repetitively carried out plural times, one horizontal time period becomes the processing cycle for the threshold correcting operation is because the threshold correcting operation is carried out after completion of the initializing operation. In this case, in the initializing operation, before the sampling transistor 125 samples the information corresponding to the signal amplitude Vin and holds the information thus sampled in the storage capacitor 120 every row, prior to the threshold correcting operation, the potential of the power source supply line 105DSL is set at the second potential Vcc_L, the gate potential of the drive transistor 121 is set at the reference potential Vin, and the source potential of the drive transistor 121 is set at the second potential Vcc_L. In addition, the sampling transistor 125 is caused to conduct, thereby holding the voltage corresponding to the threshold voltage Vth of the drive transistor 121 in the storage capacitor 120 in the threshold correcting operation, in a time zone for which the potential of the power source supply line 105DSL is held at the first potential Vcc_H and the potential of the video signal line 106HS is held at the reference potential Vo (Vofs).

The time period for threshold correction becomes necessarily shorter than one horizontal time period. Therefore, due to the relationship about the capacitance Cs of the storage capacitor 120, and the magnitude of the second potential Vcc_L, and other factors, this one short time period for threshold correction is not enough to hold the precise voltage corresponding to the threshold voltage Vth of the drive transistor 121 in the storage capacitor 120 in some cases. The reason that the threshold correcting operation is preferably carried out plural times is because of coping with the above situation. That is to say, the threshold correcting operation is repetitively carried out with a plurality of horizontal periods prior to the operation for sampling and holding the information corresponding to the signal amplitude Vin in the storage capacitor 120 (signal wiring operation), thereby reliably holding the voltage corresponding to the threshold voltage Vth of the drive transistor 121 in the storage capacitor 120.

In addition, the pixel circuit P of the second comparative example is provided with the mobility correcting function in addition to the threshold correcting function. That is to say, the vertical driving portion 103 causes the sampling transistor 125 to conduct in the time zone for which the video signal line 106HS is held at the signal potential (Vofs+Vin) corresponding to the effective time period of the video signal Vsig. As a result, the vertical driving portion 103 sets the write drive pulse WS to be supplied to the write scanning line 104WS at the active level (at the H level in this embodiment) only for a time period shorter than the above time period. The active time period for the write drive pulse WS (corresponding to the time period for mobility correction as well as the sampling time period) is suitably set, whereby when the information corresponding to the signal amplitude Vin is held in the storage capacitor 120, the mobility p of the drive transistor 121 is simultaneously corrected. A time period for which the horizontal drive portion 106 actually supplies the signal potential (Vofs+Vin) to the video signal line 106HS, thereby setting the write drive pulse WS at the active H level is set as a time period for which the information corresponding to the signal amplitude Vin is written to the storage capacitor 120 (referred to as "a sampling time period" as well).

In particular, at the drive timing in the pixel circuit P of the second comparative example, the write drive pulse WS is set as being active in the time zone (the time period of the signal amplitude Vin) for which the power source supply line 105DSL is held at the first potential Vcc_H as the high potential side, and the video signal Vsig is held within the effective time period. As a result, the time period for mobility correction (meaning the sampling time period as well) depends on a range in which a time width in which the potential of the video signal line 106HS is held at the signal potential (Vofs+Vin) corresponding to the effective time period of the video signal Vsig overlaps the active time period of the write drive pulse WS. In particular, in this embodiment, a width of the active time period of the write drive pulse WS is determined so as to be narrow enough to fall within a time width in which the video signal line 106HS is held at the signal potential. As a result, the time period for mobility correction depends on the write drive pulse WS. Accurately, the time period for mobility correction (meaning the sampling time period as well) is a time period ranging from a time point when the write drive pulse WS rises to turn ON the sampling transistor 125 to a time point when the write drive pulse WS falls to turn OFF the sampling transistor 125.

For the sampling time period, the sampling transistor 125 is caused to conduct (turned ON) while the gate potential Vg of the drive transistor 121 is held at the signal potential (Vofs+Vin). Therefore, for the time period H for write & mobility correction, the drive current Ids is caused to flow through the drive transistor 121 in a state in which the gate terminal G of the drive transistor 121 is fixed at the signal potential (Vofs+Vin). The information corresponding to the signal amplitude Vin is held in the form of being added to the threshold voltage Vth of the drive transistor 121. As a result, a change in threshold voltage Vth of the drive transistor 121 is usually canceled. Thus, the threshold correction is carried out in such a manner. By carrying out the threshold correction, the gate-to-source voltage Vgs held in the hold transistor 120 is expressed by "Vsig+Vth"="Vin+Vth." In addition, since the mobility correction is simultaneously carried out for the sampling time period, at the drive timing in the pixel circuit P of the second comparative example, the sampling time period doubles as the time period for mobility correction (the time period H for write & mobility correction).

Here, when a threshold voltage of the organic EL element 127 is VthEL, a relationship of "Vo−Vth<VthEL" is set. In this case, the organic EL element 127 emits no light because it is reversely biased and is in a cut-off state (high-impedance state). Also, the organic EL element 127 does not show the diode characteristics, but shows the simple capacitance characteristics. Thus, the information corresponding to the drain current (the drive current Ids) caused to flow through the drive transistor 121 is written to a capacitor having a capacitance value of "C=Cs+Cel." Here, the capacitor is obtained by combining the storage capacitor 120 having the capacitance value Cs and the parasitic capacitance (equivalent capacitance), having a capacitance value Cel, parasitic in the organic EL element 127. As a result, the drain current Ids of the drive transistor 121 starts to be caused to flow into the parasitic capacitance Cel of the organic EL element to start to charge the parasitic capacitance Cel with the electricity. As a result, the source potential Vs of the drive transistor 121 rises.

In the timing chart shown in FIG. 7, an amount of source potential Vs risen is expressed by ΔV. The amount of source potential Vs risen, that is, a negative feedback amount ΔV as a mobility correction parameter is subtracted from the gate-to-source voltage "Vgs=Vin+Vth" held in the storage capacitor 120 in the threshold correcting operation, and the gate-to-source voltage is given by "Vgs=Vin+Vth−ΔV." As a result, the negative feedback is carried out in such a way. At this time, the source potential Vs of the drive transistor 121 is given by "−Vth+ΔV" obtained by subtracting the gate-to-source voltage "Vgs=Vin+Vth−ΔV" held in the storage capacitor from the gate potential Vg (=Vin).

In such a manner, the sampling for the information corresponding to the signal amplitude Vin, and the adjustment for the negative feedback amount (mobility correction parameter) ΔV for correction of the mobility p are both carried out at the drive timing in the pixel circuit P of the second comparative example. The write scanning portion 104 can adjust the time width of the time period H for write & mobility correction, and thus can optimize the negative feedback amount, ΔV, of drive current Ids for the storage capacitor 120.

Here, the wording "the negative feedback amount is optimized" means that the mobility correction can be carried out even in any of the levels in the range from the black level to the white level of the video signal potential. The negative feedback amount ΔV applied to the gate-to-source voltage Vgs depends on a time at which the drain current Ids is taken out, that is, the time period H for write & mobility correction. As a result, the negative feedback amount, ΔV, becomes large as this time period is taken longer. The negative feedback amount ΔV is expressed by ΔV=Ids·t/Cel.

As apparent from the above expression of the negative feedback amount ΔV, the larger the drain current Ids as the drain-to-source current of the drive transistor 121, the larger the negative feedback amount ΔV. Conversely, as the drain current Ids of the drive transistor 121 is smaller, the negative feedback amount ΔV is small. In such a manner, the negative feedback amount ΔV is determined depending on the drive current Ids.

In addition, the drive current Ids becomes large, and an absolute value of the negative feedback amount ΔV becomes large as the signal amplitude Vin becomes larger. Therefore, it is possible to realize the mobility correction corresponding to the emission luminance level. In this case, the time period H for write & mobility correction is not necessarily constant. On the contrary, the time period H for write & mobility correction is preferably adjusted in correspondence to the drive current Ids in some cases. For example, it is better that when the drive current Ids is large, the time period t for mobility correction is set as being short, and conversely, when the drive current Ids becomes small, the time period H for write & mobility correction is set as being long.

In addition, the negative feedback amount ΔV is expressed by Ids·t/Cel, and even when the drive current Ids disperses every pixel circuit P due to the dispersion of the mobilities μ, the negative feedback amount ΔV corresponding to the drive currents Ids, respectively, are obtained. Thus, it is possible to correct the dispersion of the mobilities μ of the pixel circuits P. That is to say, when the signal amplitude Vin is set as being constant, the longer the mobility p of the drive transistor 121, the larger the absolute value of the negative feedback amount ΔV. In other words, since the longer the mobility μ, the larger the negative feedback amount ΔV, it is possible to remove the dispersion of the mobilities μ of the pixel circuits P.

In such a manner, both the sampling for the information corresponding to the signal amplitude Vin, and the adjustment for the negative feedback amount ΔV for correction of the dispersion of the mobilities μ are simultaneously carried out for the time period H for write & mobility correction at the drive timing in the pixel circuit P of the second comparative example. Of course, the negative feedback amount ΔV can be optimized by adjusting the time width of the time period H for write & mobility correction.

In addition, the pixel circuit P of the second comparative example is provided with the bootstrap function as well. That is to say, in a stage that the information corresponding to the signal amplitude Vin is held in the storage capacitor 120, the write scanning portion 104 releases the application of the write drive pulse WS to the write scanning line 104WS (that is, sets the write scanning line 104WS at the inactive L level) to set the sampling transistor 125 in a non-conduction state, thereby electrically disconnecting the gate terminal G of the drive transistor 121 from the video signal line 106HS (for the time period I for light emission). When proceeding to the time period I for light emission, the horizontal driving portion 106 returns the potential of the video signal line 106HS back to the reference potential Vo (Vofs) at a subsequent suitable time point. After that, the operation proceeds to a next frame (or a field), and the threshold correction preparing operation, the threshold correcting operation, the mobility correcting operation, and the light emitting operation are repetitively carried out again.

For the time period I for light emission, the gate terminal G of the drive transistor 121 is disconnected from the video signal line 106HS. The gate potential Vg of the drive transistor 121 can rise because the application of the signal potential (Vofs+Vin) to the gate terminal G of the drive transistor 121 is released. The storage capacitor 120 is connected between the gate terminal G and source terminal S of the drive transistor 121, and the bootstrap operation is carried out based on the effect provided by the storage capacitor 120. When the bootstrap gain is assumed to be 1 (ideal value), the gate potential Vg changes in conjunction with the change in source potential Vs of the drive transistor 121. As a result, the gate-to-source voltage Vgs of the drive transistor 121 can be maintained constant.

At this time, the drain current Ids caused to flow through the drive transistor 121 is also caused to flow through the organic EL element 127, so that the anode potential of the organic EL element 127 rises in correspondence to the drive current Ids. An amount of drive current Ids risen is given by Vel. Before long, the organic EL element 127 actually starts to emit a light due to the drive current Ids flowing thereinto because the reverse bias of the organic EL element 127 is released along with the rise of the source potential Vs. The rise (Vel) of the anode potential of the organic EL element 127 at this time is nothing else but the rise of the source potential Vs of the drive transistor 121. Thus, the source potential Vs of the drive transistor 121 is given by "−Vth+ΔV+Vel."

A relationship between the drive current Ids and the gate voltage Vgs can be expressed by Expression (2) by substituting "Vin+Vth−ΔV" into Vgs in Expression (1) representing the transistor characteristics previously stated:

$$Ids=k\mu(Vgs-Vth)^2=k\mu(Vin-\Delta V)^2 \quad (2)$$

where k is given by k=(½) (W/L) Cox.

It is understood from Expression (2) that a term of the threshold voltage Vth is canceled, and thus the drive current Ids supplied to the organic EL element 127 does not depend on the threshold voltage Vth of the drive transistor 121. Basically, the drive current Ids depends on the signal amplitude Vin of the video signal Vsig (for details, the sampling voltage (=Vgs 121) held in the storage capacitor 120 in correspondence to the signal amplitude Vin). In other words, the organic EL element 127 emits a light with the luminance corresponding to the signal amplitude Vin.

In this case, the signal amplitude Vin is corrected with the negative feedback amount ΔV. This correction amount ΔV just acts so as to cancel the effect of the mobility p contained in a coefficient portion of Expression (2). Therefore, the drive current Ids substantially depends on only the signal amplitude Vin. The drive current Ids depends on no threshold voltage Vth. Thus, even when the threshold voltage Vth fluctuates due to the manufacturing processes, no drive current Ids caused to flow between the source and the drain fluctuates, and no emission luminance of the organic EL element 127 also fluctuates.

In addition, the storage capacitor 120 is connected between the gate electrode G and source terminal S of the drive transistor 121. Thus, the bootstrap operation is carried out at first of the time period for light emission based on the effect of the storage capacitor 120. As a result, both the gate potential Vg and source potential Vs of the drive transistor 121 rise while the gate-to-source voltage "Vgs=Vin+Vth−ΔV" of the drive transistor 121 is maintained constant. The source potential Vs of the drive transistor 121 becomes "−Vth+ΔV+Vel", so that the gate potential Vg becomes "Vin+Vel"

At this time, since the gate-to-source voltage Vgs of the drive transistor 121 is held constant, the drive transistor 121 causes the constant current (the drive current Ids) to flow through the organic EL element 127. As a result, the voltage drop occurs, and the potential Vel (=the potential at the node ND121) at the anode terminal A of the organic EL element 127 rises until the current, that is, the drive current Ids in the saturated state can be caused to flow through the organic EL element 127.

Here, when the time period for light emission becomes long, the I-V characteristics of the organic EL element 127 changes accordingly. For this reason, the potential at the node ND121 also changes with a lapse of time. However, even when the anode potential fluctuates due to such temporal deterioration of the organic EL element 127, the gate-to-source voltage Vgs of the drive transistor 121 held in the storage capacitor 120 is usually maintained at "Vin+Vth−ΔV."

The drive transistor 121 operates as the constant current source. As a result, even when the I-V characteristics of the organic EL element 127 changes with time, and the source potential Vs of the drive transistor 121 changes along with this temporal change, the gate-to-source potential Vgs of the drive transistor 121 is held at a constant level (≈Vin+Vth−ΔV) based on the effect provided by the storage capacitor 120. Therefore, the current caused to flow through the organic EL element 127 does not change, and the emission luminance of the organic EL element 127 is held constant accordingly.

The operation (the operation based on the effect of the storage capacitor 120) for the correction with which the gate-to-source voltage of the drive transistor 121 is maintained constant, thereby maintaining the luminance constant irrespective of the change in characteristics of the organic EL element 127 is called the bootstrap operation. By carrying out the bootstrap operation, even when the I-V characteristics of the organic EL element 127 change with time, it is possible to display the image free from the luminance deterioration following the temporal change of the I-V characteristics.

That is to say, the bootstrap circuit, as an example of the drive signal maintaining circuit, for correcting the change in current vs. voltage characteristics of the organic EL element as the example of the electro-optic element, thereby maintaining the drive current constant is configured in the pixel circuit P of the second comparative example and at the drive timing at which the pixel circuit P of the second comparative example is driven. As a result, the bootstrap operation functions. Therefore, the organic EL element 127 continues to emit a light with the luminance corresponding to the pixel signal Vsig of the organic EL element 127 and thus no luminance changes because even when the I-V characteristics of the organic EL element 127 are deteriorated, the constant drain current Ids usually continues to be caused to flow through the drive transistor 121.

In addition, the threshold correcting circuit, as an example of the drive signal maintaining circuit, for correcting the threshold voltage Vth of the drive transistor 121, thereby maintaining the drive current constant is configured in the pixel circuit P of the second comparative example, and at the drive timing at which the pixel circuit P of the second comparative example is driven. As a result, the threshold correcting operation functions. The constant drain current Ids which is free from the influence of the dispersion of the threshold voltages Vth of the drive transistors 121 can be caused to flow through the drive transistor 121 based on the gate-to-source potential Vgs in which the threshold voltage Vth of the drive transistor 121 is reflected.

In particular, although an illustration is omitted here for the sake of simplicity, when the threshold correcting operation is repetitively carried out plural times with the processing cycle of one threshold correcting operation as one horizontal time period, the information corresponding to the threshold voltage Vth can be reliably held in the storage capacitor 120. The difference in threshold voltage Vth between each two pixels is reliably removed, and thus the luminance non-uniformity due to the dispersion of the threshold voltages Vth can be suppressed irrespective of the gradation.

On the other hand, when the threshold voltage Vth is insufficiently corrected because the threshold correcting operation is carried out only once and so forth, a difference in luminance (in drive current Ids) between each different two pixel circuits P occurs in the low gradation region. Therefore, when the threshold voltage is insufficiently corrected, the luminance non-uniformity appears in the low gradation, thereby impairing the image quality.

In addition thereto, the mobility correcting circuit, as an example of the drive signal maintaining circuit, for correcting the mobility p of the drive transistor 121 in conjunction with the operation for writing the information corresponding to the signal amplitude Vin to the storage capacitor 120 by the sampling transistor 125, thereby maintaining the drive current constant is configured at the driving timing in the pixel circuit P of the second comparison example. As a result, the mobility correcting operation functions. The constant drain current Ids which is free from the influence of the dispersion of the carrier mobilities μ of the drive transistors 121 can be caused to flow through the drive transistor 121 based on the gate-to-source potential Vgs in which the carrier mobility p of the drive transistor 121 is reflected.

That is to say, in the pixel circuit P of the second comparative example, the threshold correcting circuit and the mobility correcting circuit are automatically configured by devising the drive timing. Also, the threshold correcting circuit and the mobility correcting circuit each function as the drive signal maintaining circuit for correcting the influence by the threshold voltage Vth and the carrier mobility μ, thereby maintaining the drive current constant for the purpose of preventing the influence which the dispersion of the characteristics of the drive transistors 121 (the dispersion of the threshold voltages Vth and the dispersion of the carrier mobilities μ in this embodiment) exerts on the drive current Ids.

Since not only the bootstrap operation, but also the threshold correcting operation and the mobility correcting operation are carried out, the gate-to-source voltage Vgs maintained by carrying out the bootstrap operation is adjusted based on both the voltage corresponding to the threshold voltage Vth, and the voltage ΔV for the mobility correction. As a result, the emission luminance of the organic EL element 127 is free from not only the influence by the dispersions of the threshold voltages Vth and the mobilities μ of the drive transistor 121, but also the temporal change in characteristics of the organic EL element 127. Therefore, the image can be displayed with the stable gradation corresponding to the amplitude of the signal Vin inputted, and thus the image having the high quality can be obtained.

In addition, the pixel circuit P of the second comparative example can be configured in the form of the source follower circuit using the n-channel drive transistor 121. Therefore, even when the current organic EL element having the anode electrode and the cathode electrode is used as it is, the organic EL element 127 can be driven.

In addition, the pixel circuit P can be configured by using only the n-channel transistors, including the drive transistor 121 and the sampling transistor 125 disposed in the peripheral portion of the drive transistor 121. Also, the amorphous silicon (a-Si) process can be used in manufacture of the TFT. Therefore, the cost of the TFT substrate can be reduced.

Now, in order to cause the threshold correcting function, the mobility correcting function, and the bootstrap function to act irrespective of whether or not the pixel circuit P is provided with the subsidiary capacitor 310, it is necessary to ON/OFF control the various kinds of transistors (the sampling transistor 125 in the pixel circuit P in this embodiment). In order to attain this, the various kinds of scanning lines (the write scanning line 104WS, the power source supply line 105DSL, and the video signal line 106HS in this embodiment) need to be longitudinally and transversely formed in the pixel array portion 102.

However, a rate of the scanning line portion occupying a layout of the pixel circuits P in the display panel portion 100 (hereinafter referred to as "a TFT layout" as well) increases depending on a layout of the various kinds of scanning lines and circuit elements. As a result, it becomes difficult to promote the increasing of the definition. Hereinafter, this problem and measures taken to cope therewith will be concretely described.

Scanning Lines and Intra-Pixel Wirings

Figure 8A:
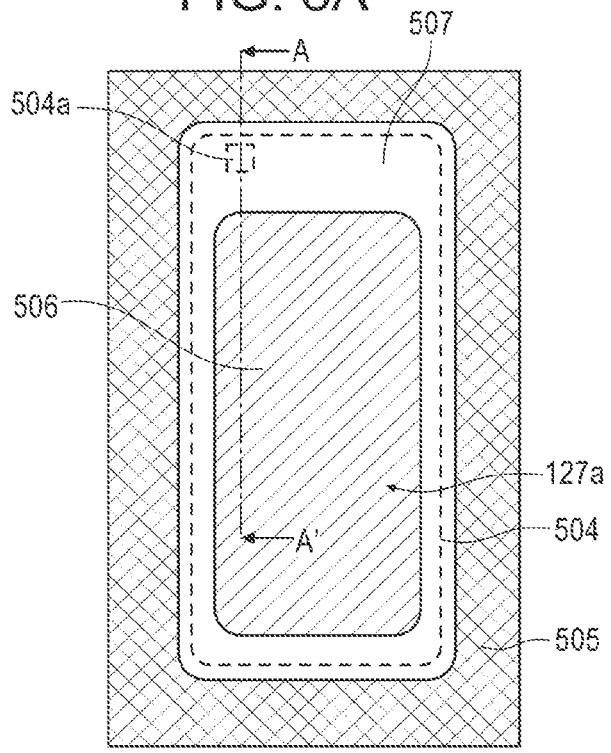
FIGS. 8A and 8B are respectively a top plan view and a cross sectional view taken on line A-A' of FIG. 8A each explaining a disposition of an organic EL element and a subsidiary capacitor.
Figure 8B:
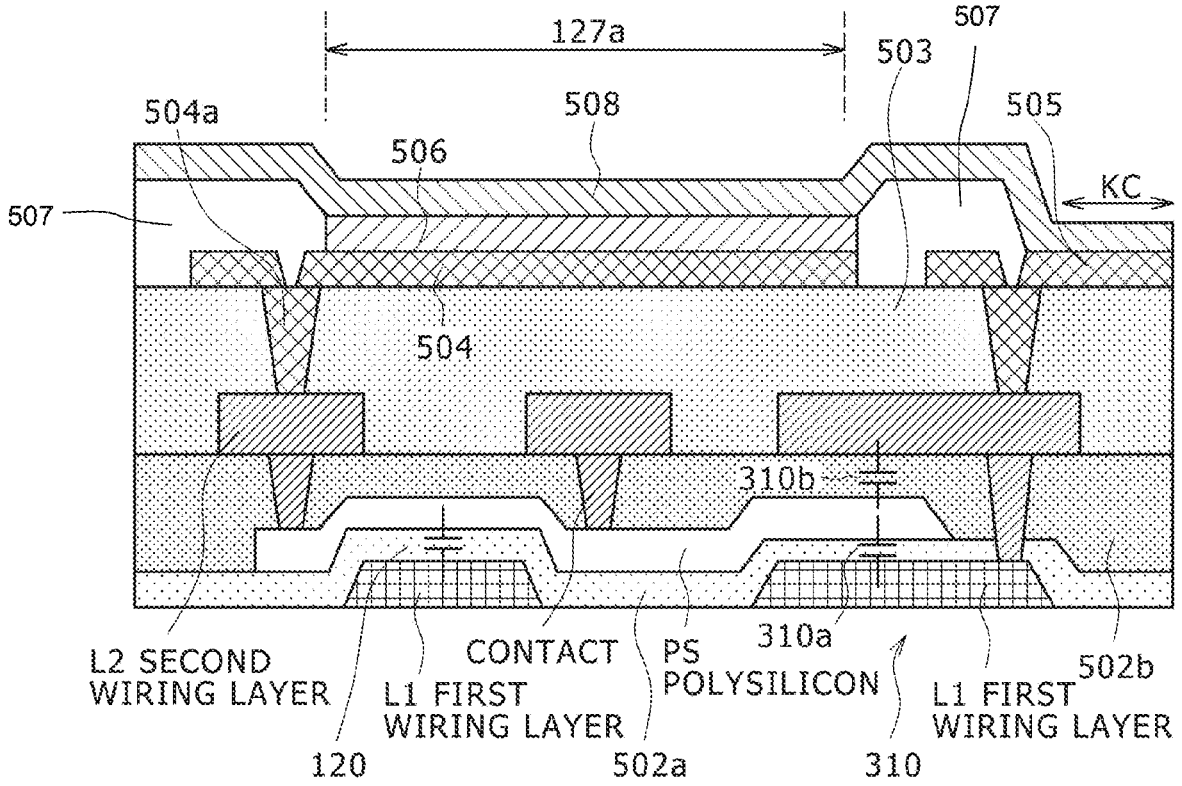
Figure 9:
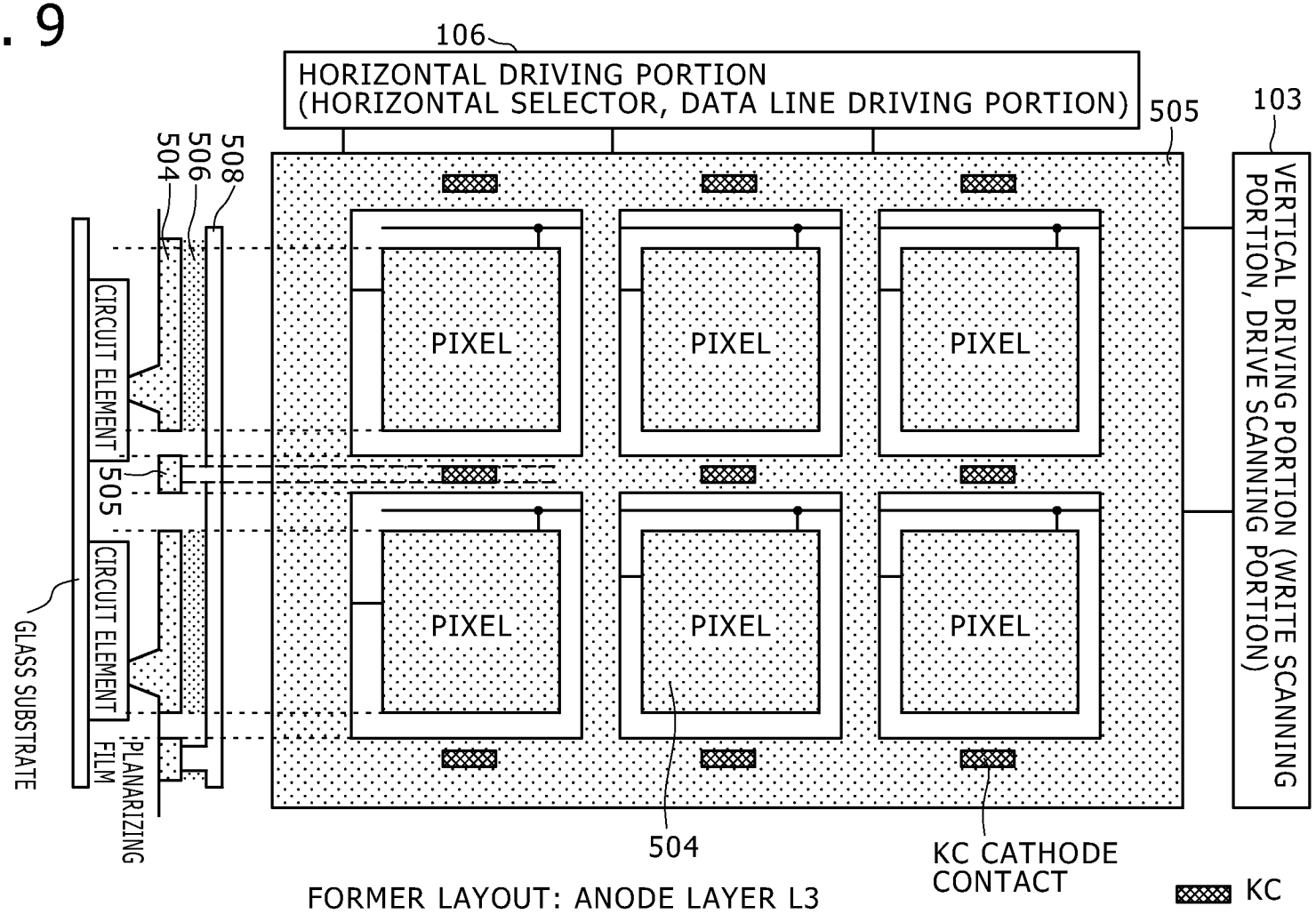
FIG. 9 is a block diagram, partly in cross section, showing a layout of a comparative example of a lower electrode and a subsidiary wiring of an organic EL element.

FIGS. 8A to 13C are respectively views, diagrams and timing charts explaining a wiring form (layout) of the scanning lines (the vertical wirings and the horizontal wirings) of the pixel array portion 102, and terminals and wirings within each of the pixels. Here, FIGS. 8A and 8B are respectively views explaining a dispersion and the like of the organic EL element 127, the subsidiary capacitor 310, and the like. Specifically, FIGS. 8A and 8B showing an outline of a layer structure for one pixel in a general organic EL display device. Here, FIG. 8A is a top plan view for one pixel, and FIG. 8B is a cross sectional view taken on line A-A' of FIG. 8A. Also, FIG. 9 is a block diagram, partly in cross section, showing a layout of the lower electrode and the subsidiary wiring of the organic EL element 127 of a comparative example.

Figure 10A:
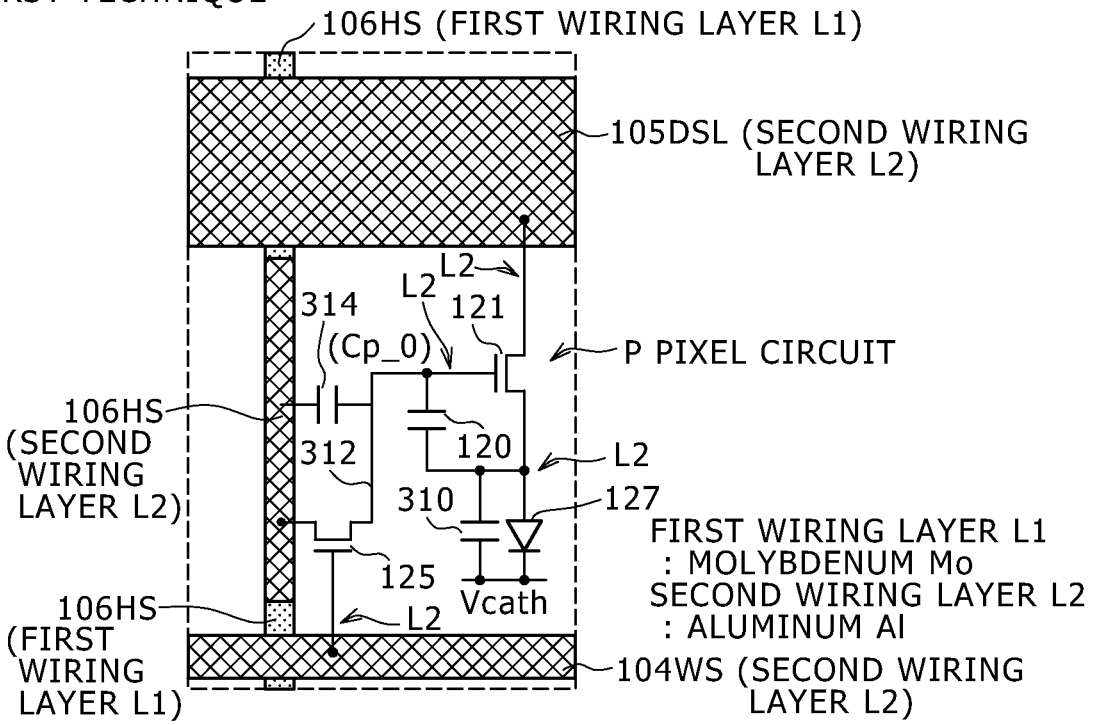
FIGS. 10A to 10D are respectively basic conceptual circuit diagrams showing layouts of pixel circuits according to first to fourth techniques, respectively.
Figure 10B:
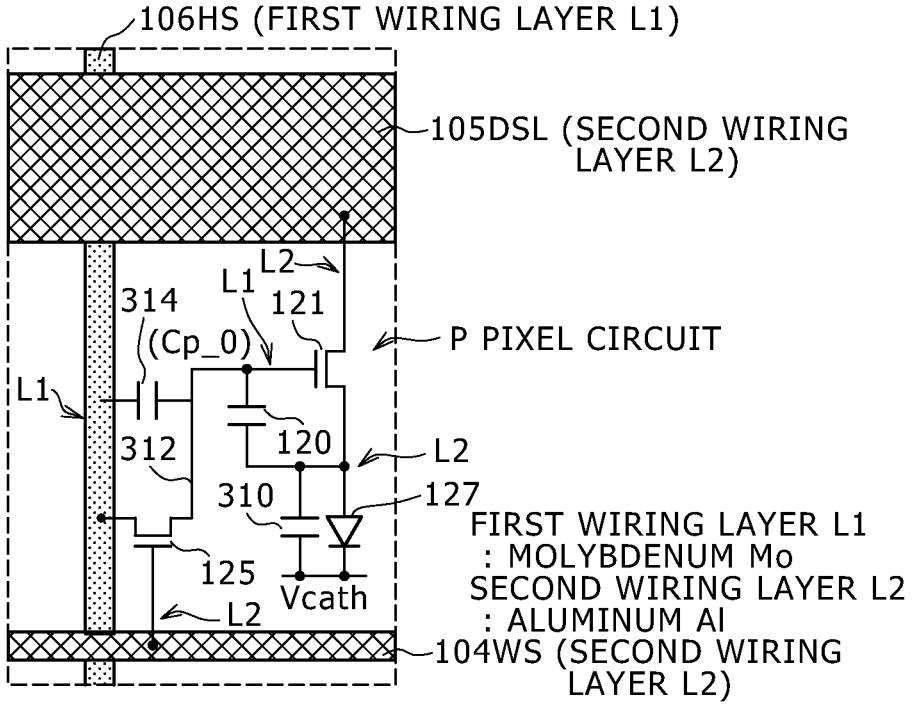
Figure 10C:
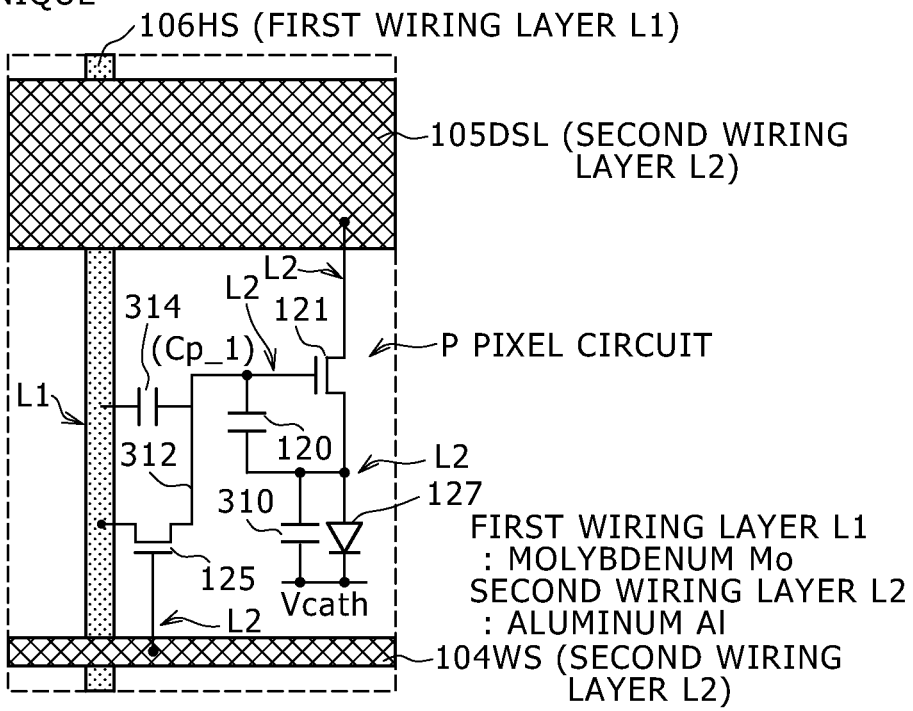
Figure 10D:
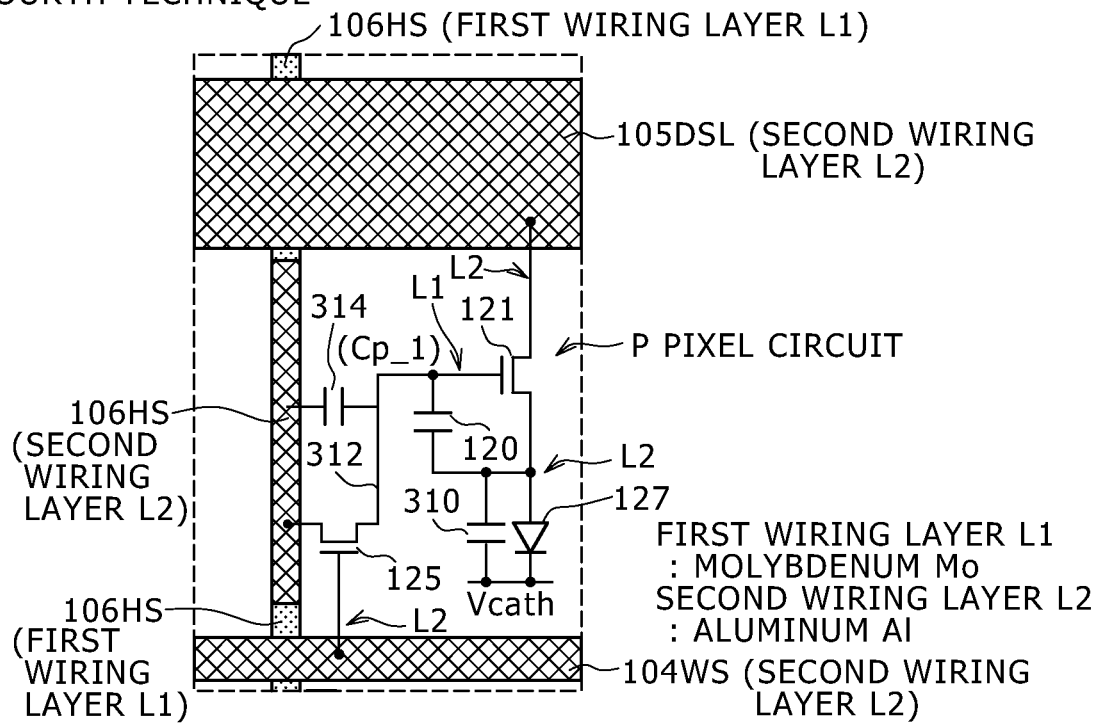
Figure 11:
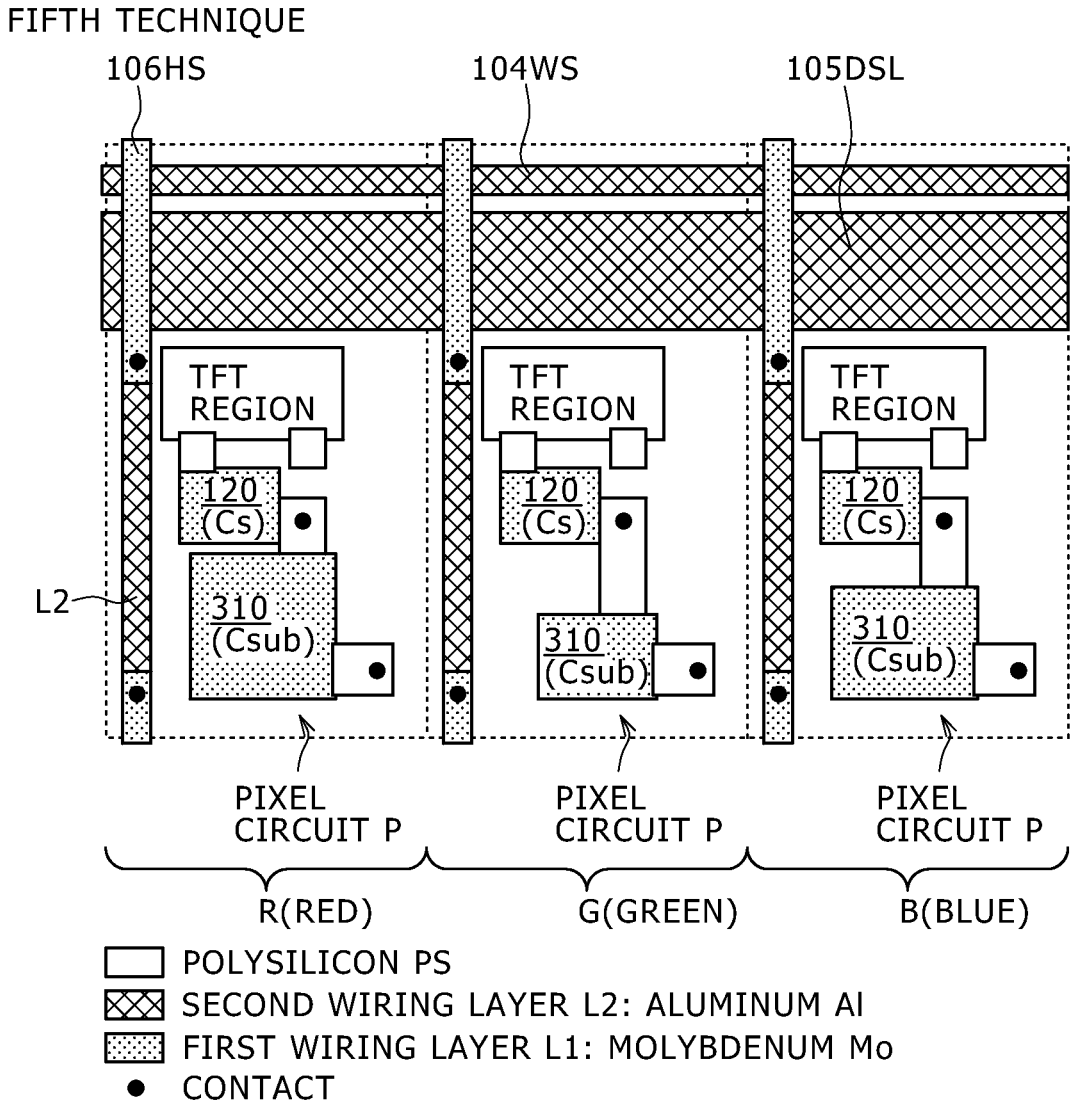
FIG. 11 is a top plan view showing a detailed example of a layout according to a fifth technique.
Figure 12:
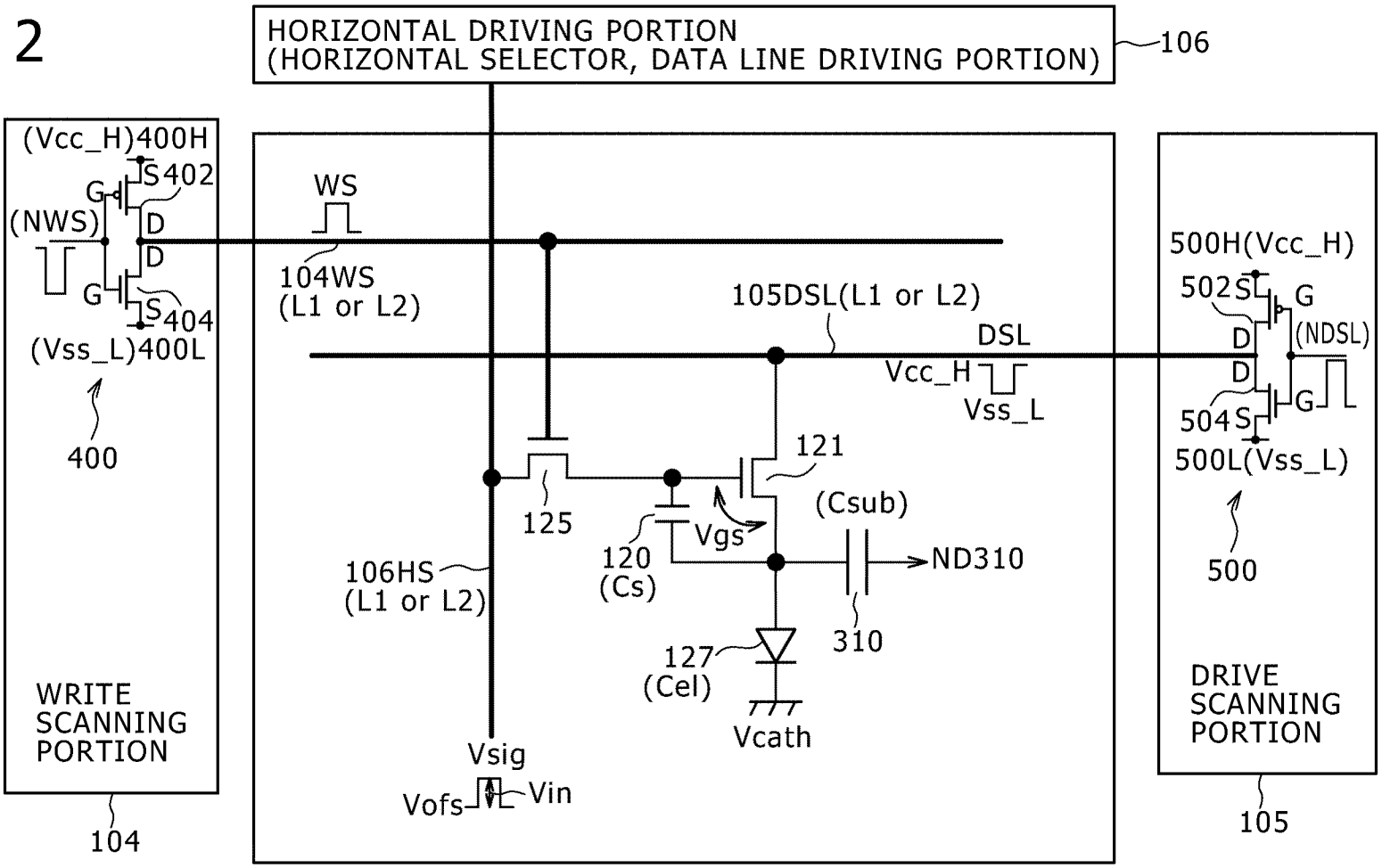
FIG. 12 is a circuit diagram, partly in block, explaining an example of an output circuit of a write scanning portion and an output circuit of a drive scanning portion.
Figure 13A:
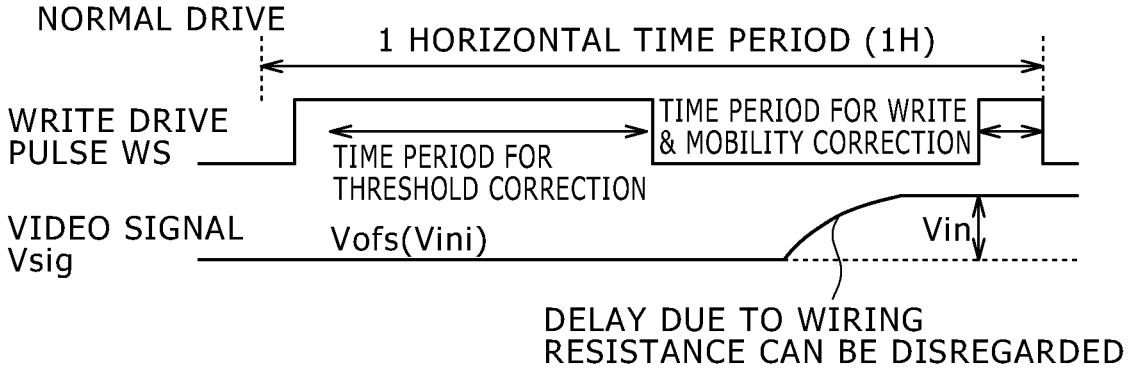
FIGS. 13A to 13C are respectively timing charts explaining a problem when one horizontal scanning time period becomes short.
Figure 13B:
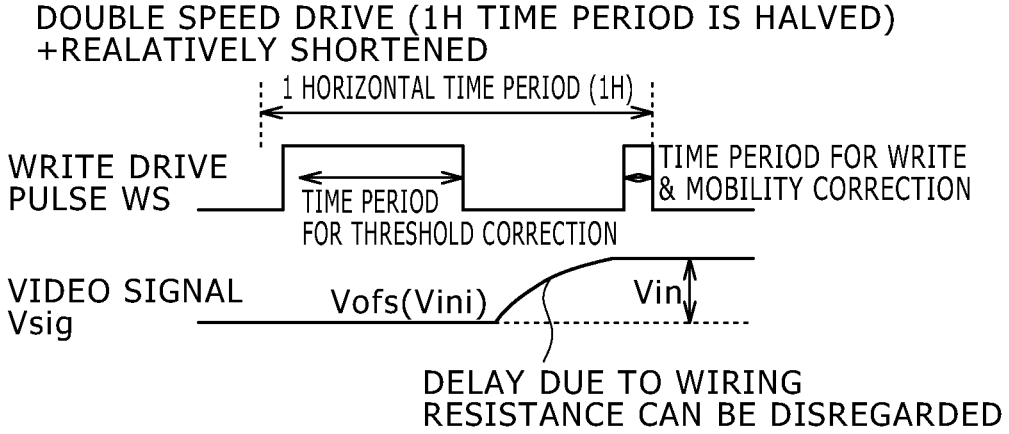
Figure 13C:
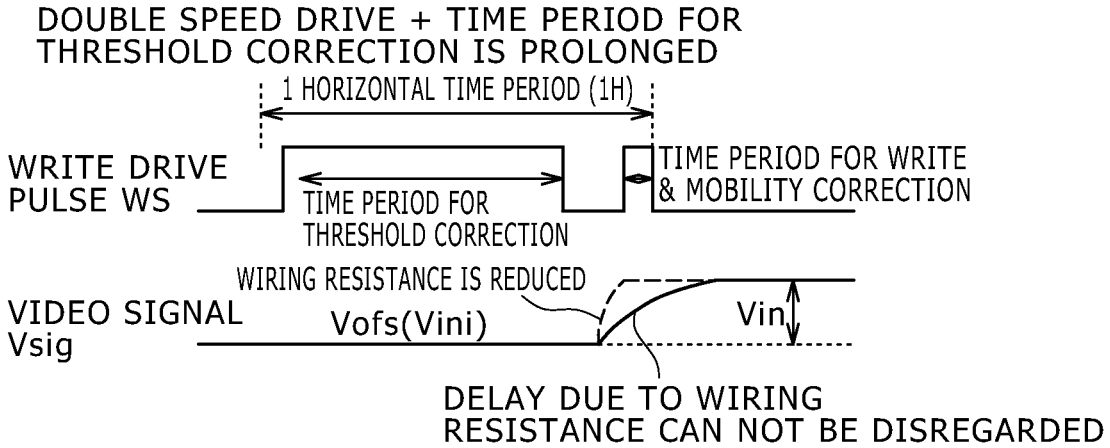

FIGS. 10A to 10D, and FIG. 11 respectively show existing layout examples of the pixel circuit P including the scanning lines. Here, FIGS. 10A to 10D respectively show basic concepts of the layout examples, and FIG. 11 is a view showing a detailed example of the layout using a fifth technique. It is noted that the layouts using first to fourth techniques shown in FIGS. 10A to 10D are examples in each of which the write scanning line 104WS and the power source supply line 105DSL are wired in close to and in parallel with each other between the adjacent pixels, whereas the layout using the fifth technique shown in FIG. 11 is an example in which the write scanning line 104WS and the power source supply line 105DSL are wired in close to and in parallel with each other within the auto-pixel. FIG. 12 is a circuit diagram, partly in block, explaining an example of an output circuit 400 of the write scanning line 104 and an output circuit 500 of the drive scanning portion 105. Also, FIGS. 13A to 13C are respectively timing charts each explaining a problem caused when one horizontal scanning time period is shortened.

As in the case of the top plan view for one pixel shown in FIG. 8A, a lower electrode (for example, an anode electrode) 504 is disposed above a substrate 101, and an opening portion of the organic EL element 127 (hereinafter referred to as "an EL opening portion") is formed above the lower electrode 504. A connection hole (for example, a TFT-anode contact) 504*a* is formed in the lower electrode 504. The lower electrode 504 is connected to an input/output terminal (a source electrode in this embodiment) of the drive transistor 121 disposed below the lower electrode 504 through the connection hoe 504*a*.

The periphery of the lower electrode 504 is covered with an insulating pattern 507 to form the EL opening portion 127*a* which is widely exposed so that only a portion obtained by laminating the lower electrode 504, the organic layer 506, and the upper electrode 508 composing the organic EL element 127 becomes an emission effective region 127*b*.

FIG. 8B shows a cross sectional view taken on line A-A' of FIG. 8A. As shown in FIG. 8B, thin film transistors Q such as the drive transistor 121 and the sampling transistor 125, and the circuit elements such as the storage capacitor 120 (having the capacitance value Cs) and the subsidiary capacitor 310 (having the capacitance value Csub) are disposed in the position corresponding to each of the pixel circuits P on the substrate 101. In this case, the thin film transistors Q and the circuit elements compose the pixel circuit P. Also, internal wirings are disposed in the thin film transistors Q and the circuit elements. Interlayer insulating films 502*a* and 502*b* (made of oxide films) are provided on the first wiring layer L1. It is noted that FIG. 8B shows only a part of the circuit elements.

A source electrode line and a drain electrode line connected to the thin film transistor Q are provided above the interlayer insulating films 502*a* and 502*b*. In addition, conductive layers composing the elements (the thin film transistor Q, and the storage capacitor 120), and conductive layers composing the source electrode line and the drain electrode line form other wirings composing the pixel circuit P.

Also, an interlayer insulating film 503 functioning as an upper planarizing film is provided so as to cover the layers (the second wiring layer L2) such as the source electrode line and the drain electrode line, and the organic EL element 127 is formed on the interlayer insulating film 503. The organic EL element 127 is composed of the lower electrode (such as the anode electrode) 504, the organic layer 506, and the upper electrode (such as the cathode electrode) 508 which are laminated in this order from the lower layer side. The organic EL element 127 has a capacitance component (the parasitic capacitance Cel) because it has a structure in which the organic layer 506 as a dielectric material is sandwiched between the lower electrode 504 and the upper electrode 508.

In particular, the organic layer 506, for example, adopts a multilayer structure made of low molecular system materials. Also, the organic layer 506, for example, includes a hole injecting layer, and a hole transporting layer, a light emitting layer, an electron transporting layer (serving as an electron injecting layer as well) in order from the lower electrode 504 side to the upper electrode 508 side. Also, in the case of the color display adaptive type, materials adapted to display colors are used as the organic materials for the light emitting layer.

The lower electrode 504 is formed in a pattern as the pixel electrode, and is connected to the source electrode 121*s* of the drive transistor 121 through a connection hole 504*a* formed in the interlayer insulating film 503. In addition, the upper electrode 508 facing the lower electrode 504 is formed in the form of a solid film covering all the pixel circuits P.

Structuring the organic EL display device 1 having such a layer structure to adopt so-called top emission system with which an emitted light L1 is taken out from a side opposite to the substrate 101 having the organic EL elements 127 formed in an arrangement is effective in ensuring the opening ratio of the organic EL element 127. In addition, in the case of the organic EL display device 1 adopting the top emission system, the opening ratio of the organic EL element 127 does not depend on the layout of the thin film transistor Q composing the pixel circuit P. For this reason, the pixel circuits P using more plural thin film transistors Q and storage capacitors 120 can be disposed so as to correspond to the pixels, respectively.

The lower electrodes 504 are disposed in a matrix so as to correspond to an arrangement of the pixel circuits P (refer to FIG. 8A). Also, the subsidiary wiring 505 (a second subsidiary wiring) structured in the same layer as that of the lower electrode 504 is wired between each two adjacent pixels of the lower electrode 504. The subsidiary wiring 505 is electrically connected to the cathode wiring of the upper electrode 508.

The first wiring layer L1 firstly provided on the substrate 101 (not shown) is used as a layer as well forming the circuit elements such as the thin film transistors Q (such as the drive transistor 121 and the sampling transistor 125). For example, one electrode of the storage capacitor 120 (having the capacitance value Cs) is formed in the first wiring layer L1, and a counter electrode thereof made of polysilicon is formed between the interlayer insulating films 502*a* and 502*b*. One electrode of the subsidiary capacitor 310 (having the capacitance value Csub) is formed in each of the first wiring layer L1 and the second wiring layer L2, and a counter electrode thereof made of polysilicon is formed between the interlayer insulating films 502*a* and 502*b*.

The electrode in the first wiring layer L1, and the member made of polysilicon form the first subsidiary capacitor 310*a*, and the electrode in the second wiring layer L2 and the member made of polysilicon form the second subsidiary capacitor 310*b*. Also, the electrode in the first wiring layer L1, and the electrode in the second wiring layer L2 are connected to each other through a contact, which results in that the first subsidiary capacitor 310*a* and the second subsidiary capacitor 310*b* are connected in parallel with each other. It is noted that utilization of the second subsidiary capacitor 310*b* is not essential to the present invention, and thus only the first subsidiary capacitor 310*a* composed of the electrode in the first wiring layer L1, and the member made of polysilicon may be provided similarly to the case of the storage capacitor 120. Of course, a configuration may also be adopted such that the subsidiary capacitor 310 itself is not used.

Since this display device 1 is of the top emission type in which the emitted light is taken out from the side opposite to the substrate 101, each of the lower electrodes 504 is made of a material which has a high light-shielding property and a high reflectivity. On the other hand, the upper electrode 508 is made of a material having a light permeation property. Therefore, the wiring resistance of the upper electrode 508 becomes large. Even when the upper electrode 508 is formed in the solid wiring, there is a limit to reduction of the resistance value of the upper electrode 508. The subsidiary wiring 505 is wired in parallel with the upper electrode 508 having the high resistance value in terms of an electrical circuit, which contributes to reduction of the resistance value of the entire cathode wiring. Although an illustration is omitted here for the sake of simplicity, in the substrate 101, a light shielding metallic layer for light leakage and temperature diffusion is provided on the surface of the substrate 101 opposite to the side thereof on which the transistor Q and the organic EL element 127 are disposed.

For example, FIG. 9 shows a layout of a comparative example of the lower electrodes 504 and the subsidiary wirings of the organic EL elements 127. As shown in the figure, the lower electrodes 504 are disposed in a lattice so as to surround the pixel circuits P in correspondence to an arrangement of the pixel circuits P disposed in a matrix. Moreover, the lower electrodes 504 are also disposed in the periphery so as to surround the entire pixel array portion 102. Also, the subsidiary wiring structured in the same layer as that of each of the lower electrodes 504 is wired between each two lower electrodes 504. As previously stated, the subsidiary wiring 505 in the anode layer L3 having the lower electrodes 504 formed therein is connected in suitable portions (a central portion between each two pixels and peripheral central portions corresponding to the pixels, respectively, in the comparative example shown in FIG. 9) to the upper electrode 508 overlying the subsidiary wiring 505 through the cathode contacts KC.

In order to connect the node of the subsidiary capacitor 310 to the cathode wiring of the organic EL element 127, the electrode in the first wiring layer L1 is connected to the electrode in the second wiring layer L2, and is further connected to the subsidiary wiring 505 through the contact, thereby being finally connected to the upper electrode 508.

Now, in the case of the pixel circuit P shown in FIGS. 3 and 4, in the pixel array portion 102, each of the write scanning line 104WS and the power source supply line 105DSL relating to at least the vertical scanning system becomes one (for example, the transverse wiring) of the longitudinal wiring and the transverse wiring. On the other hand, the video signal line 106HS relating to the horizontal scanning system becomes the other (for example, the longitudinal wiring) of the longitudinal wiring and the transverse wiring. In addition, when the cathode potential Vcath of the organic EL element 127 does not correspond to the solid wiring, but corresponds to the normal wiring, the wiring for the cathode potential Vcath (hereinafter referred to as "the cathode wiring Wcath") becomes either the transverse wiring or the longitudinal wiring.

Here, the wirings described above (the write scanning line 104WS, the power source supply line 105DSL, and the video signal line 106HS) extend either in the transverse direction or in the longitudinal direction. Also, these wirings are connected to the corresponding scanning portions (the write scanning portion 104, the drive scanning portion 105, and the horizontal driving portion 106), respectively, which are provided in the periphery of the pixel array portion 102.

When a consideration is made with respect to the horizontal direction of the picture, although a detailed explanatory figure is omitted here for the sake of simplicity, the write driving pulse WS is commonly supplied from the write scanning portion 104 to all the pixel circuits P for one row. Thus, due to an influence which the wiring capacitance and the wiring resistance exert on a waveform of the write drive pulse WS, the waveform blunting becomes larger in the pixel circuit P far from the write scanning portion 104 (hereinafter referred to as "the far-side pixel") than in the pixel circuit P near the write scanning portion 104 (hereinafter referred to as "the near-side pixel"). For this reason, the distribution characteristics of the wiring capacitance and the wiring resistance may exert an influence on each of the operation for the threshold correction and the operation for the mobility correction.

This applies to the power source supply line 105DSL and the video signal line 106HS (or the cathode wiring Wcath). Thus, the distribution characteristics of the wiring capacitance and the wiring resistance may exert an influence on each of the operation for the threshold correction and the operation for the mobility correction.

In consideration of these respects, in general, each of the wirings is distributed as a metallic wiring, made of aluminum (Al) or molybdenum (Mo), having no light permeation property in order to obtain the low resistance value. As previously stated, since the longitudinal wiring and the transverse wiring need to be wired, basically, the metallic wirings having at least two layers (the first wiring layer L1 and the second wiring layer L2) need to be wired due to the overlap in each intersection portion between the longitudinal wiring and the transverse wiring.

When the wirings (the write scanning line 104WS, the power source supply line 105DSL, the video signal line 106HS, and the cathode wiring Wcath) are disposed as the metallic wirings having the two layers, various wiring (layout) forms can be adopted depending on which of the wirings is disposed in the first wiring layer L1, and which of the wirings is disposed in the second wiring layer L2.

For example, both the write scanning line 104WS and the power source supply line 105DSL may be wired as the metallic wirings of one of first wiring layer L1 or the second wiring layer L2. In such a case (shown as a first technique in FIG. 10A), if the video signal line 106HS is wired as the metallic wiring of the same one of the first wiring layer L1 or the second wiring layer L2 as the write scanning line 104WS and the power source supply line 105DSL (the second wiring layer L2 in the figure), then in the pixel circuit P a portion of the video signal line 106HS needs to overlap the write scanning line 104WS and the power source supply line 105DSL in portions in which the video signal line 106HS intersect the write scanning line 104WS and the power source supply line 105DSL. Therefore, at least a portion of the video signal line 106HS needs to be wired as the metallic wiring of the one of the first wiring layer L1 or the second wiring layer L2 other than the one that the write scanning line 104WS and the power source supply line 105DSL are wired in so as to be bridged (the metallic wirings of the different layers needs to be connected to each other through a contact).

In addition, as shown as a second technique in FIG. 10B, the entire horizontal driving portion 106S may be wired as the metallic wiring of the one of the first wiring layer L1 or the second wiring layer L2 other than the one that the write scanning line 104WS and the power source supply line 105DSL are wired in (the first wiring layer L1 in the figure). As a result, it is possible to avoid the bridge with the metallic wiring of the layer in which the write scanning line 104WS and the power source supply line 105DSL are wired (the second wiring layer L2) as in the case of the first technique. In comparison with the first technique, there is an advantage that the load imposed on the video signal line 106HS can be lightened because it is possible to reduce the number of times of the bridge between the video signal line 106HS as the longitudinal wiring, and the metallic wiring as the transverse wiring on the lower layer side.

In any of the first and second techniques, the layout of both the write scanning line 104WS and the power source supply line 105DSL is made in the same direction in the metallic wirings in the same layer. Thus, even when the write scanning line 104WS and the power source supply line 105DSL are wired in parallel with and separately from each other within one pixel (in the upper end and the lower end of the pixel circuit P), they are wired in parallel with and very close to (adjacent to) each other in the same layer in relation to the adjacent pixel circuit P.

In addition, as previously stated, the write scanning line 104WS and the power source supply line 105DSL are both very long because the layout of them is made up to the write scanning portion 104 and the drive scanning portion 105 corresponding to the periphery (panel end portion) of the pixel array portion 102. Therefore, when a space between the wirings is narrow, an area between the wirings facing each other becomes large, and an electrostatic capacitance (parasitic capacitance) defined between the wirings become large accordingly. In addition, this is also feared between the scanning line and the intra-pixel wiring as well as the scanning lines.

For example, as shown in FIGS. 10A and 10B, the two layers of the first wiring layer L1 on the semiconductor substrate 101 side, and the second wiring layer L2 disposed on the upper layer side of the first wiring layer L1 so as to sandwich the insulators (the interlayer insulating films 502 and 503: including the members forming the constituent elements of the pixel circuit P) between the first wiring layer L1 and the second wiring layer L2 are used in forming the scanning lines and the intra-pixel wiring. Here, the second wiring layer L2 is made of a low resistance material such as aluminum (Al). On the other hand, the first wiring layer L1 is made of a material (high resistance material) which, although having a low resistance value, has a larger resistance value than that of the material for the second wiring layer L2. This high resistance material is typified by molybdenum (Mo).

In the pixel circuit P, the information corresponding to the signal amplitude Vin needs to be written from the video signal line 106HS to the storage capacitor 120 through the sampling transistor 125. Thus, the video signal line 106HS preferably has a low impedance. In addition, the power source supply line 105DSL preferably has a low impedance because the power source supply line 105DSL itself needs to have a power source supplying capability for the drive transistor 121. For obtaining the low resistance, each of the video signal line 106HS and the power source supply line 105DSL is wired in the second wiring layer L2.

The video signal line 106HS is disposed as the longitudinal wiring extending in the column direction. On the other hand, the power source supply line 105DSL is disposed as the transverse wiring extending in the row direction because the potential of the power source supply line 105DSL is switched between the first potential Vcc_H and the second potential Vcc_L every horizontal time period. In order to write both the video signal line 106HS and the power source supply line 105DSL in the second wiring layer L2, the video signal line 106HS and the power source supply line 105DSL must necessarily intersect perpendicularly each other. In order to realize the wiring form in which such low resistance lines intersect with each other, it is necessary to utilize the multilayer wiring technique for the second wiring layer L2 as well. Actually, the bridge portion is formed by utilizing the first wiring layer L1.

On the other hand, since the intra-pixel wiring has the short wiring length and the distribution characteristics of the wiring resistance hardly becomes a problem, basically, any of the first wiring layer L1 and the second wiring layer L2 can be adopted. For this reason, it is expected that the intra-pixel wiring is disposed in the same layer as that of the wiring connected to the terminal of the transistor as in the case of the first technique shown in FIG. 10A, or the second technique shown in FIG. 10B. In this case, for example, a line capacitor 314 (having a capacitance value Cp_0) is formed as a parasitic capacitance between the video signal line 106HS and the gate wiring 312 of the drive transistor 121. The reason for this is because when the gate wiring 312 of the drive transistor 121 is formed in the same layer as that of the video signal line 106HS in consideration of a layout efficiency, the gate wiring 312 and the video signal line 106HS are wired in parallel with each other, and as a result, the line capacitor 314 having the relatively large capacitance value Cp_0 is formed based on a plane parallel plate capacitance in the parallel running portion.

On the other hand, with regard to a structure for reducing the line capacitor 314, it is expected that as shown in FIG. 10C or 10D, the video signal line 106HS and the gate wiring 312 of the drive transistor 121 are disposed in the different layers, respectively. For example, as shown as a third technique in FIG. 10C, the video signal line 106HS is disposed in the second wiring layer L2 and the gate wiring 312 of the drive transistor 121 is disposed on the first wiring layer L1. Or, contrary to this case, as shown as a fourth technique in FIG. 10D, the video signal line 106HS is disposed in the first wiring layer L1 and the gate wiring 312 of the drive transistor 121 is disposed on the second wiring layer L2. With any of the third and fourth techniques, the parallel running portions of the gate wiring 312 and the video signal line 106HS are wired in the different layers, respectively, thereby making it possible to reduce the capacitance value of the line capacitor 314.

With regard to the technique for disposing (making a layout of) the various kinds of scanning lines and intra-pixel wirings within the pixel circuit P, the various techniques can be adopted in the manner as described above. Here, with the general layout technique, the line widths of the various kinds of scanning lines and intra-pixel wirings are mainly determined from the viewpoint of the line resistance. For example, since the power source supply line 105DSL especially functions as a power source line through which the drive transistor 121 is operated, it is made thicker than any of other scanning lines (such as the write scanning line 104WS and the video signal line 106HS). Also, the remaining scanning lines (such as the write scanning line 104WS and the video signal line 106HS) are made to have optimal line thicknesses, respectively, in consideration of balance with the line resistance. The intra-pixel wiring is made to have a suitable line thickness because the line resistance thereof does not become a problem so much.

Describing more concretely, in the pixel circuit P in the second comparison example or in this embodiment, the potential of the power source line (the power source supply line 105DSL) for the drive transistor 121 is formed in the form of a pulse, and is switched between the first potential Vcc_H and the second potential Vcc_L. As a result, as shown in FIG. 12, the power source drive pulse DSL supplied from the drive scanning portion 105 is transmitted over to the power source supply line 105DSL.

As shown in FIG. 12, both the write scanning portion 104 and the drive scanning portion 105 switch the potentials of the write scanning lines 104WS and the power source supply lines 105DSL belonging to the respective rows between the H level and the L level, thereby controlling the gate terminals G of all the sampling transistors 125 or all the light emission controlling transistors 122 for one row all at once. For this reason, portions of the write scanning portion 104 and the drive scanning portion 105 which are connected to the write scanning line 104WS and the power source supply line 105DSL are provided with an output circuit 400 and an output circuit 500, respectively, each having the sufficient drive capability. Although only the output circuits 400 and 500 for one row are shown in the figure, practically, the output circuits 400 and 500 are provided so as to correspond to the write scanning lines 104WS and the power source supply lines 105DSL belonging to the respective rows. The write scanning portion 104 and the drive scanning portion 105 are provided in an outer edge (so-called frame portion) of the pixel array portion 102. Also, although an illustration is omitted here for the sake of simplicity, the first potential Vcc_H and the second potential Vss_L (Vcc_H>Vss_L) are supplied from a power source circuit which is provided outside the display panel portion 100 and which has a sufficiently small output impedance.

Since the output circuits 400 and 500 in this embodiment have the same configuration, hereinafter, the output circuit 400 will be described on behalf of both the output circuits 400 and 500. The output circuit 400 on the write scanning portion 104 side, as an example, is configured in a way that a p-channel transistor 402 and an n-channel transistor 404 are connected in series between a supply terminal 400H for the first potential Vcc_H, and a supply terminal 400L for the second potential Vss_L. A source terminal S of the p-channel transistor 402 is connected to the supply terminal 400H for the first potential Vcc_H, and a source terminal S of the n-channel transistor 404 is connected to the supply terminal 400L. Drain terminals D of the p-channel transistor 402 and the n-channel transistor 404 are commonly connected to each other, and a node between the drain terminals D thereof is connected to the write scanning line 104WS. The output circuit 400 configures a complementary metal oxide semiconductor (CMOS) inverter as a whole.

Gate terminal G of the p-channel transistor 402 and the n-channel transistor 404 are commonly connected to each other, and a write drive pulse NWS at the active L level is supplied to a node between the gate terminal G thereof. When the write drive pulse NWS is at the active L level, the n-channel transistor 404 is turned OFF, and the p-channel transistor 402 is turned ON. As a result, the first potential Vcc_H is supplied to the write scanning line 104WS. On the other hand, when the write drive pulse NWS is at the inactive H level, the p-channel transistor 402 is turned OFF, and the n-channel transistor 404 is turned ON. As a result, the second potential Vss_L is supplied to the write scanning line 104WS.

On the other hand, in the output circuit 500 on the drive scanning portion 105 side, gate terminals G of a p-channel transistor 502, and an n-channel transistor 504 are commonly connected to each other, and a scanning drive pulse NDSL is supplied to a node between the gate terminals G thereof. When the scanning drive pulse NDSL is at the L level, the n-channel transistor 504 is turned OFF, and a p-channel transistor 502 is turned ON. As a result, the first potential Vcc_H is supplied to the power source supply line 105DSL. On the other hand, when the scanning drive pulse NDSL is at the H level, the p-channel transistor 502 is turned OFF, and an n-channel transistor 504 is turned ON. As a result, the second potential Vss_L is supplied to the power source supply line 105DSL. As can be understood from these operations, each of the output circuits 400 and 500 functions as an inverter type buffer.

The panel power source is at the first potential Vcc_H in the phase of light emission of the organic EL element 127. As a result, the p-channel transistor 502 of the output circuit 500 in the final stage for the power source drive pulse DSL is turned ON, and the power source voltage of the power source drive pulse DSL (the first potential Vcc_H) is supplied to the pixel circuit P. Although an emission current in one pixel is several micron-amperes, for example, since about 1,000 pixels are disposed in the horizontal direction, a total emission current is several milli-amperes. For this reason, in order to suppress the voltage drop caused by the wiring resistance of the power source supply line 105DSL, for example, as shown in FIGS. 10A and 10B, FIGS. 10C and 10D, or FIG. 11, the layout of the power source supply line 105DSL is made to have a larger line thickness than that of any of other scanning lines. As a result, a rate of the power source supply line 105DSL occupying the TFT layout within the panel becomes large, which results in that it becomes difficult to promote the increasing of the definition of the panel.

In addition, when the high definition promotion and the high-speed drive are realized for the panel while the pixel circuit P shown in FIGS. 3 and 4, and the drive timing shown as the driving system of the pixel circuit P in FIG. 7 are both maintained as they are, the problem about the line resistances of the scanning lines is exposed with a more complicated relation. Timing charts explaining that problem are shown in FIGS. 13A to 13C. In order to realize both the threshold correcting operation and the mobility correcting operation in the pixel circuit P with the 2TR drive configuration as in the case of explanation based on the drive timing shown in FIG. 7, as shown in FIG. 13A, the write drive pulse WS is made active twice for one H time period, thereby turning ON the sampling transistor 125. In this case, the threshold correcting operation is carried out at the first round of the ON timing, and both the signal voltage writing operation and the mobility correcting operation are simultaneously carried out at the second round of the ON timing.

Here, when the one horizontal scanning time period is short (the one horizontal scanning time period is halved in the double speed drive) as in the case of the double speed drive, the write drive pulse WS is made active twice for one horizontal scanning time period thus halved, thereby turning ON the sampling transistor 125. In this case, the threshold correcting operation needs to be carried out at the first round of the ON timing, and both the signal voltage writing operation and the mobility correcting operation need to be simultaneously carried out at the second round of the ON timing.

At this time, when as shown in FIG. 13B, the first round of the ON time period, and the second round of the ON time period are simply set as being relatively short in accordance with the shortening of the one horizontal scanning time period, for example, an absolute time of the time period for threshold correction becomes short. For this reason, the voltage corresponding to the threshold voltage of the drive transistor 121 cannot be sufficiently held in the storage capacitor 120 only by carrying out one threshold correcting operation. As a result, it becomes essential to carry out repetitively the threshold correcting operation with a plurality of horizontal periods. Thus, the entire control becomes complicated.

In addition, in order to solve this problem, it is thought that as shown in FIG. 13C, a first round of the ON time period is prolonged as much as possible so as to approach the same level as that of the previous ON time period. However, simply prolonging the first round of the ON time period results in that a timing at which the video signal Vsig is switched from the reference potential Vo over to the signal potential (Vofs+Vin) is delayed accordingly. Thus, this potential change has a delay due to the line resistance of the video signal line 106HS. Also, an influence of the delay cannot be disregarded due to the shortening of the one horizontal scanning time period. As a result, this causes the situation in which the operation for writing the information corresponding to the signal amplitude Vin to the storage capacitor 120, and the mobility correcting operation cannot be properly carried out. That is to say, the delay phenomenon of the change in potential of the video signal line 106HS due to the line resistance of the video signal line 106HS cannot be disregarded as the one horizontal scanning time period becomes shorter. In order to solve this problem, the line resistance of the video signal line 106HS needs to be reduced as the one horizontal scanning time period becomes shorter. As an example, the video signal line 106HS needs to be made of aluminum (Al) and to be wired in the second wiring layer L2.

However, when the video signal line 106HS is wired in the second wiring layer L2 in such a manner, the following drawback is caused. That is to say, the line resistance is reduced all the more because one of the transverse wiring and the longitudinal wiring needs to overlap the portion in which the video signal line 106HS intersects with the write scanning line 104WS on the power source supply line 105DSL as the transverse wirings as in the case of either the first technique shown in FIG. 10A or the fourth technique shown in FIG. 10D. This is a drawback.

Improvement Technique: First Embodiment

Figure 14:
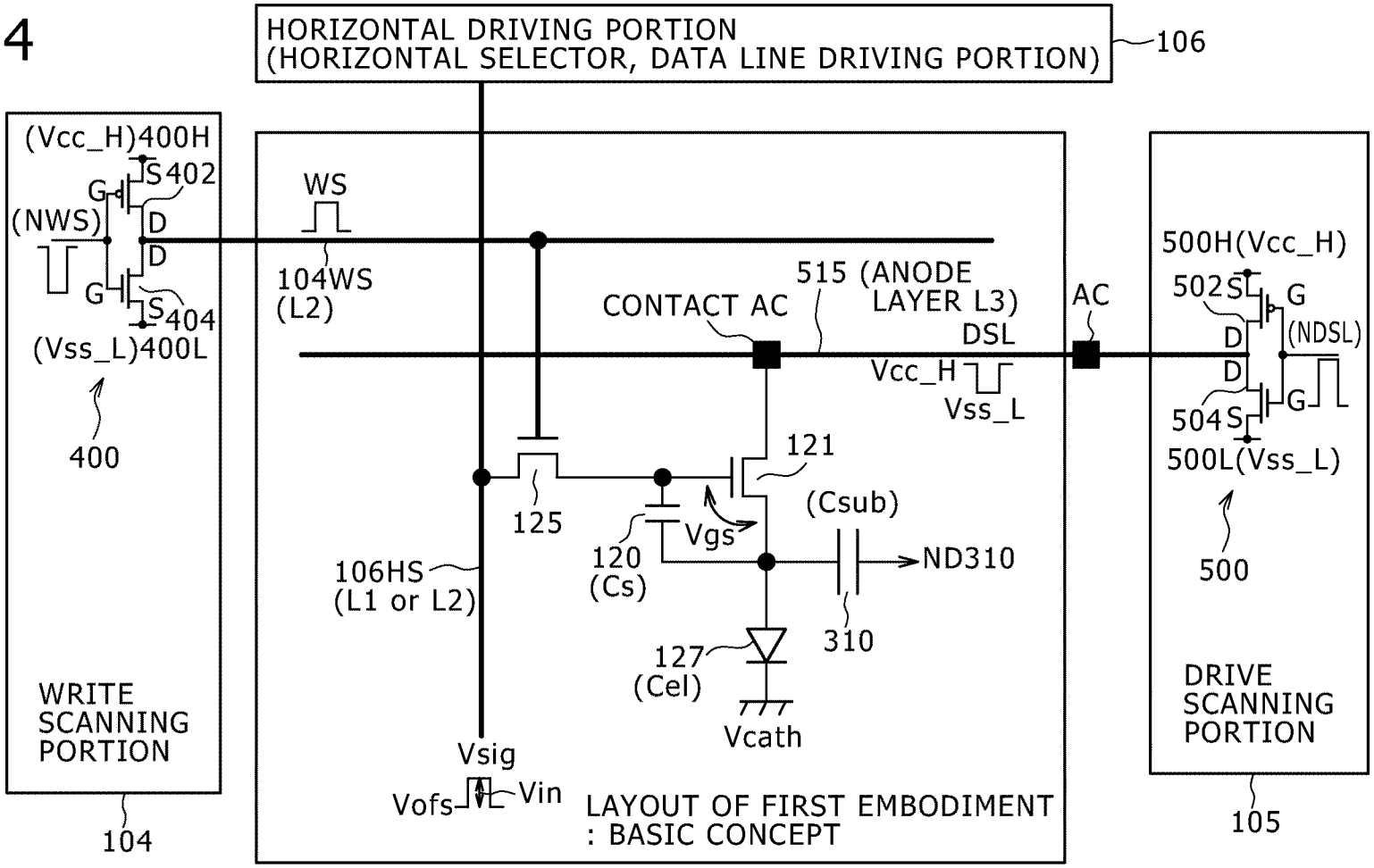
FIG. 14 is a circuit diagram, partly in block, showing a basic concept of a layout of a first example of a periphery of the pixel circuit.
Figure 15:
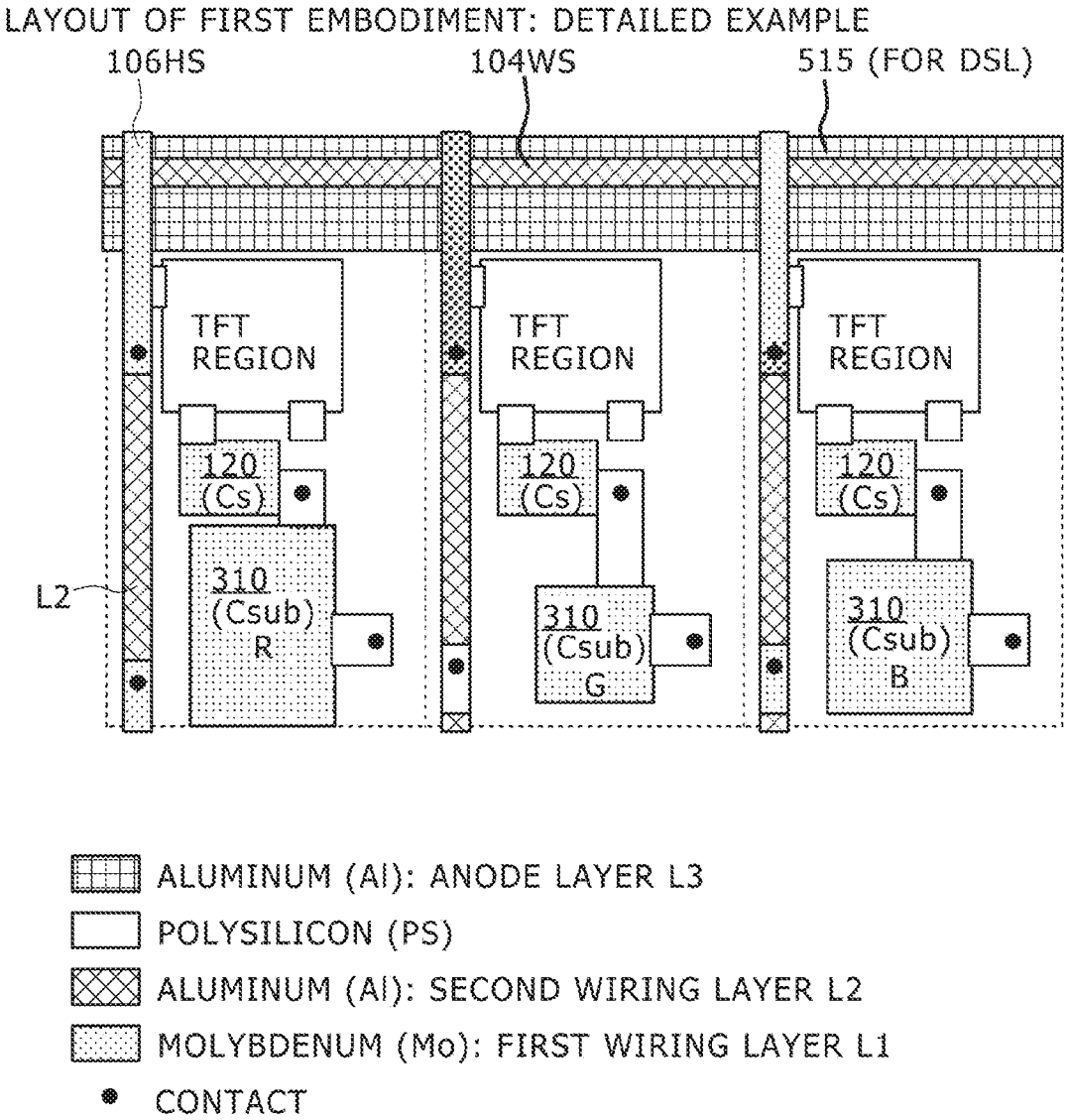
FIG. 15 is a top plan view of a detailed example corresponding to the first example shown in FIG. 14.
Figure 16:
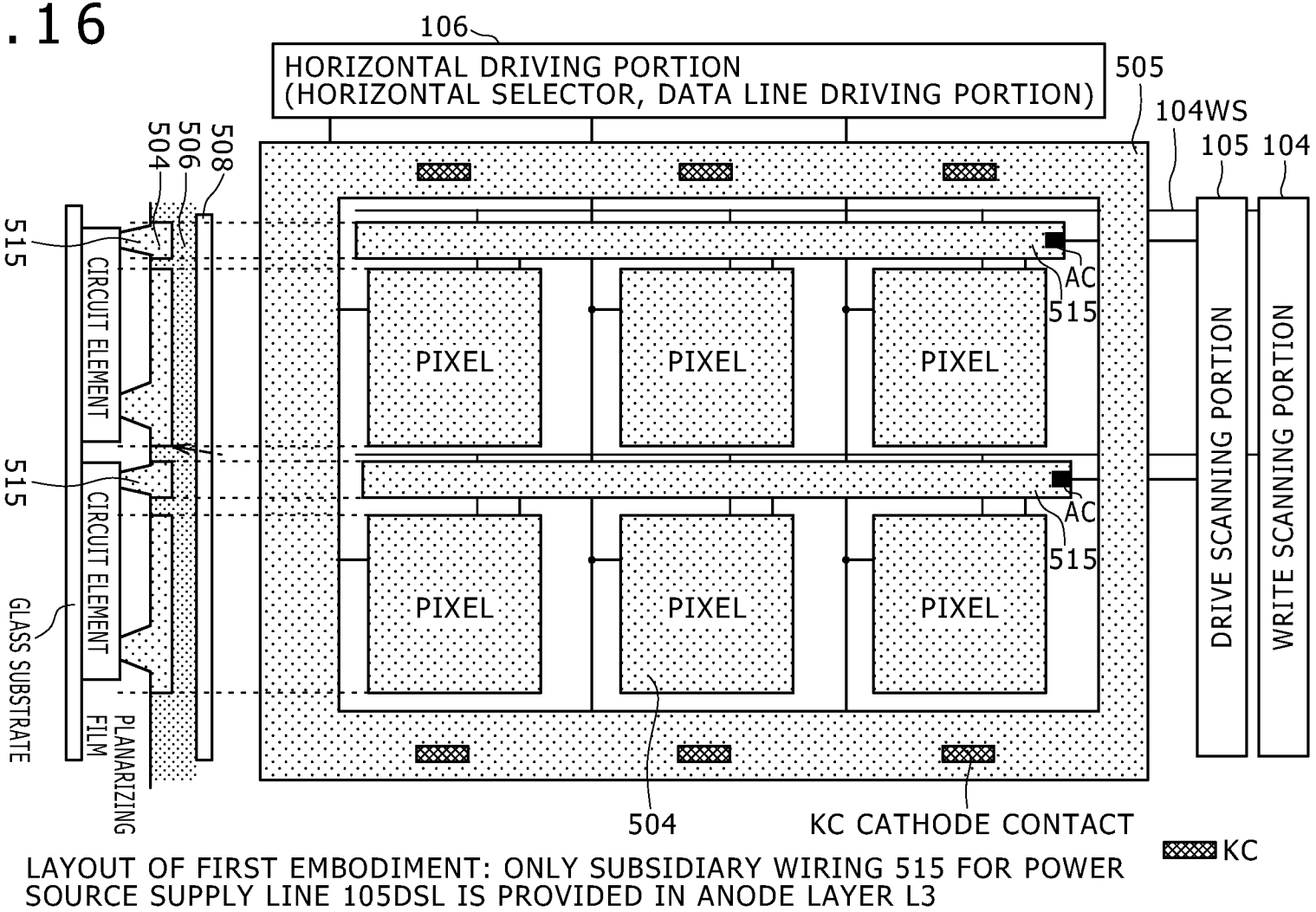
FIG. 16 is a block diagram, partly in cross section, showing a layout of a subsidiary wiring provided in the same layer as that of a lower electrode of an organic EL element corresponding to the first example shown in FIG. 14.

FIGS. 14, 15 and 16 are respectively a diagram, and views explaining a first embodiment of a circuit arrangement (layout) in which an area rate of the scanning lines occupying the TFT layout can be reduced. Here, FIG. 14 shows a basic concept of a layout, of a first embodiment, in the periphery of the pixel circuit P. FIG. 15 is a top plan view of a detailed example (a vertical relationship of the wiring is disregarded) corresponding to FIG. 14. Also, FIG. 16 is a block diagram, partly in cross section, showing a layout of a subsidiary wiring provided in the same layer as that of the lower electrode 504 of the organic EL element 127 corresponding to FIG. 14.

A point of the improvement technique of this embodiment, including a second embodiment which will be described later, features that with regard to the wiring for which especially the small wiring resistance is required, a subsidiary wiring 515 (first subsidiary wiring) is disposed in the same layer as that of the lower electrode 504 of the organic EL element 127. For example, it is expected that the subsidiary wiring 515 is used as the power source wiring of the pixel circuit P, or the various kinds of drive pulse wirings for the write drive pulse WS, the power source pulse DSL, and the video signal line 106HS.

As a result, a space occurs in the TFT pixel layout, and when the previous pixel pitch (pixel size) is maintained, an increase in number of circuit elements, and an increase in capacitance or the like are readily made possible. In addition, it is possible to reduce a layout area of the scanning lines in the first wiring layer L1 and the second wiring layer L2. Thus, when the element size is maintained in the previous state, the promotion of the high definition of the panel can be made because the pixel pitch (pixel size) can be reduced as compared with the previous case.

It is noted that disposing the subsidiary wiring 515 in the anode layer L3 results in that a part of or the entire subsidiary wiring 505 for the cathode wiring is removed. For example, when the panel area is small, even if the entire subsidiary wiring 505 is removed, the resistance value of the upper electrode 508 (cathode wiring) does not become a problem. In addition, in the case where the high-definition pixel structure is obtained by utilizing the top emission system, the subsidiary wiring 505 is merely disposed so as to surround the entire pixel array portion 102 in order to increase the opening ratio, and the layout is not used in which the subsidiary wiring 505 is wired in a lattice, in a column or in a row within the pixel array portion 102 (display area) in some cases. When the panel area is large and thus the resistance value of the upper electrode 508 becomes a problem, a part of the subsidiary wiring 505 has only to be left.

Here, with regard to the subsidiary wiring 515 disposed in the same layer as that of the lower electrode 504 of the organic EL element 127, adoption of the first technique is expected such that the existing wirings of the first wiring layer L1 and the second wiring layer L2 are removed, and only the subsidiary wiring 515 is provided in the anode layer L3 having the lower electrode 504 disposed therein. In addition, similarly to the case of the subsidiary wiring 505 for the cathode wiring in the layout of the comparative example shown in FIGS. 8A and 8B, or FIG. 9, adoption of the second technique is also expected such that the existing wiring of the first layer L1 or the second wiring layer L2, and the subsidiary wiring 515 are disposed in parallel relation to each other. The first embodiment is different from the second embodiment in that the first technique is adopted.

Figure 17:
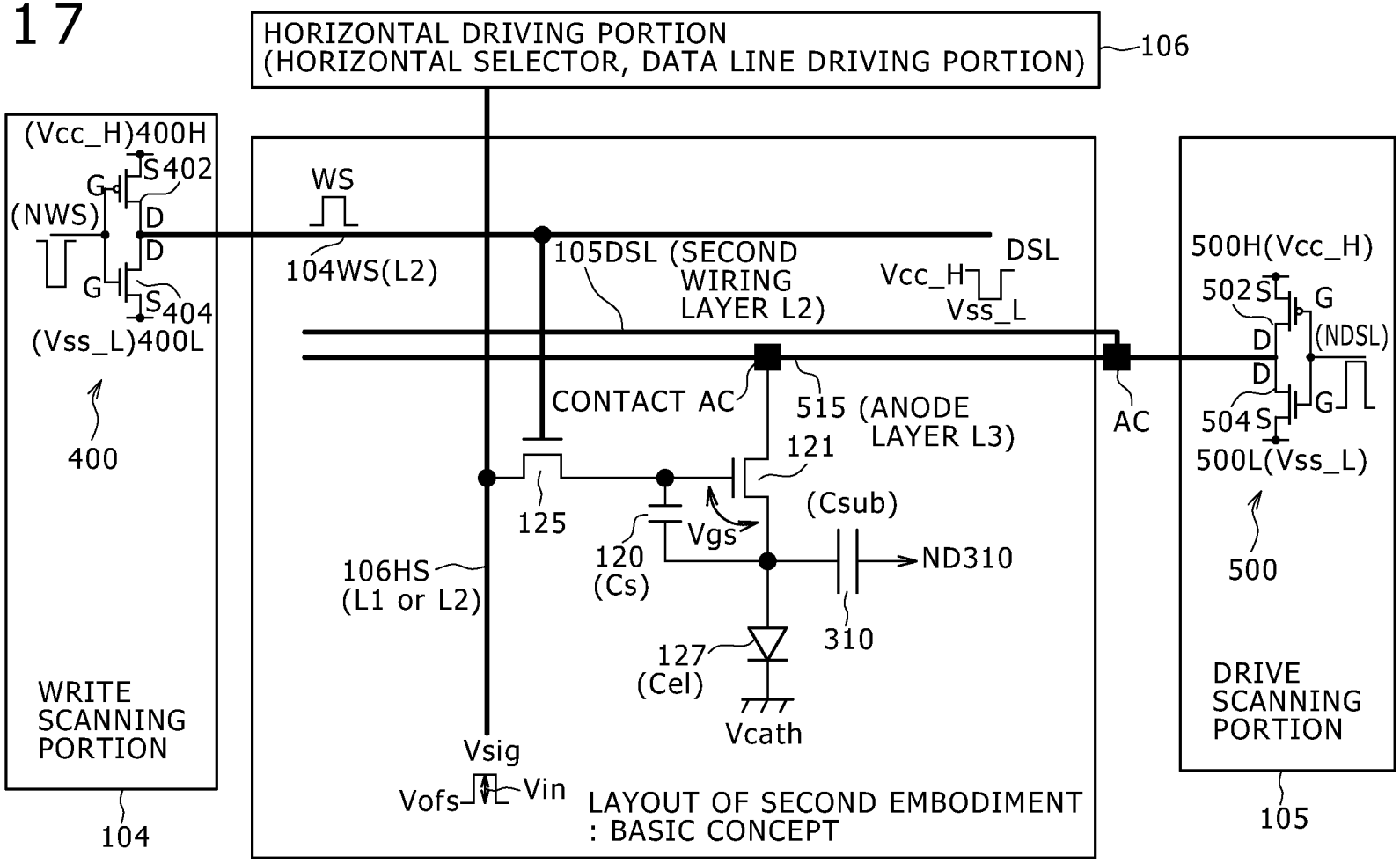
FIG. 17 is a circuit diagram, partly in block, showing a basic concept of a layout of a second example of the periphery of the pixel circuit.

That is to say, when the scanning line is wired in the anode layer L3 based on the subsidiary wiring 515 in the improvement technique in this embodiment, the scanning line may be disposed in parallel relation to the existing scanning lines of the wiring layers L1 and L2, the subsidiary wiring 505 of the cathode wiring may be left, or only the subsidiary wiring 515 may be disposed. FIG. 14 or FIG. 17 which will be described later schematically shows such states in the circuit diagram.

For example, in the improvement technique of the first embodiment, the lattice-like wiring of the anode layer L3 used as the subsidiary wiring 505 for the cathode wiring in the comparative example is used as the subsidiary wiring 515 for the power source supply line 105DSL. It is noted that since in the case of the first embodiment, the power source supply line 105DSL provided in the wiring layers L1 and L2 in the previous case is perfectly removed, the subsidiary wiring is substantially no longer the as the subsidiary wiring 515.

As a result, as shown in FIG. 15, the layout area for the power source supply line 105DSL can be reduced from the TFT layout within the pixel circuit P. Also, the layout of other elements or the like can be made in an area obtained by reducing the layout area.

The power source supply line 105DSL is connected between the drive scanning portion 105 and the pixel array portion 102 through the contact 516 as usual. In this case, the output is made from the buffer (the transistors 502 and 504) provided in the output circuit 500 in the peripheral portion of the display panel portion 100 through the first and second wiring layers L1 and L2. Also, the drive scanning portion 105 and the pixel array portion 102 are connected through both the power source supply line 105DSL provided as the subsidiary wiring 515 in the anode layer L3 in the outer edge of the pixel array portion 102, and a contact 516. The subsidiary wiring 515 (the power source supply line 105DSL) within the pixel array portion 102 contacts the drain wiring (internal wiring) of the drive transistor 121 provided in the wiring layer L1 or L2 in each of the pixel circuits P.

With such a layout structure, the portion in which the layout cannot be made in the related art can be used as the layout for the elements. As a result, an increase in number of elements, an increase in size of the drive transistor 121, or increases in capacitance values of the storage capacitor 120 and the subsidiary capacitor 310 are readily made possible. In addition, the promotion of the high definition of the panel is also made possible by using such a wiring structure.

Improvement Technique: Second Embodiment

Figure 18:
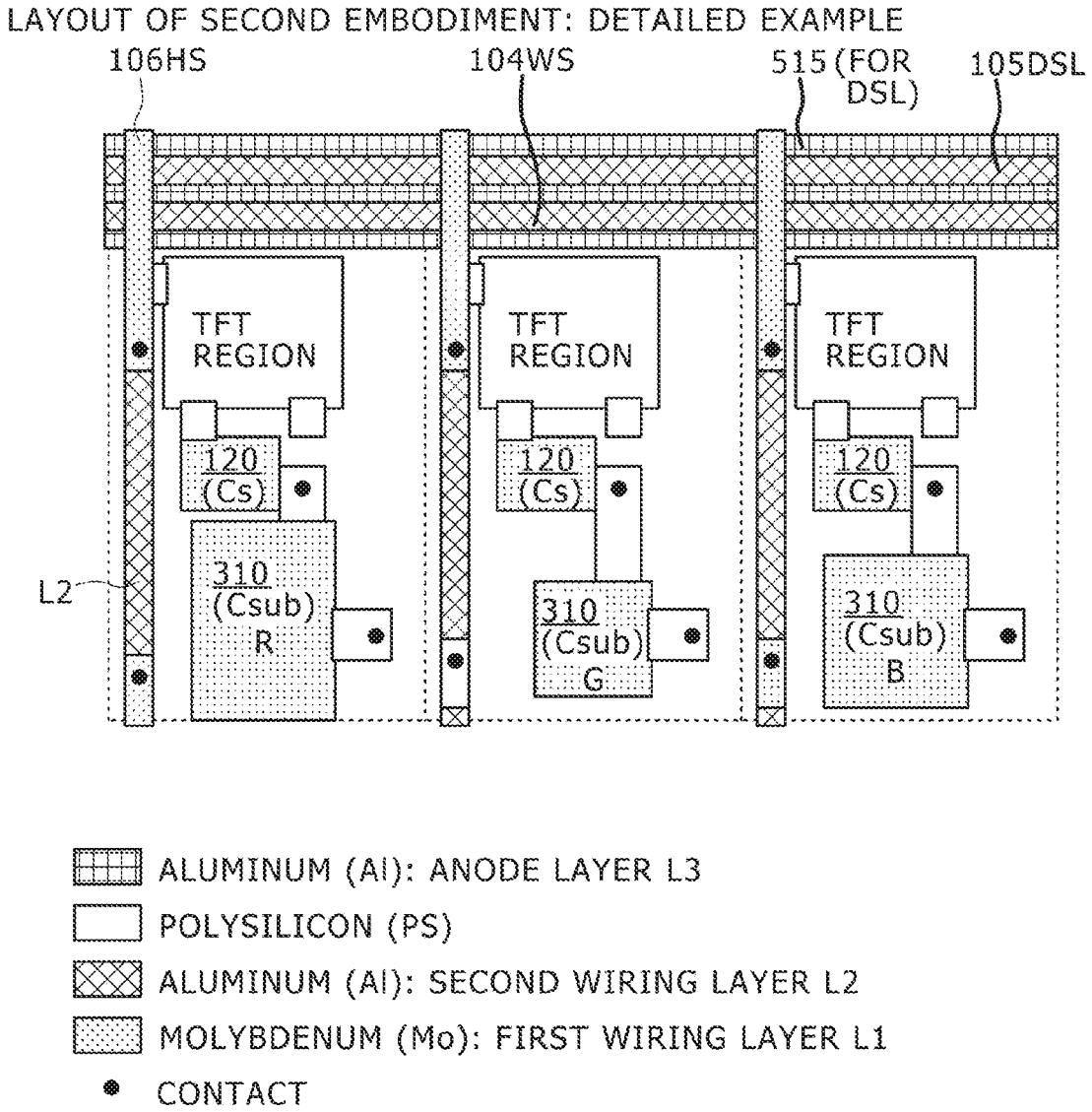
FIG. 18 is a top plan view of a detailed example corresponding to the second example shown in FIG. 17.
Figure 19:
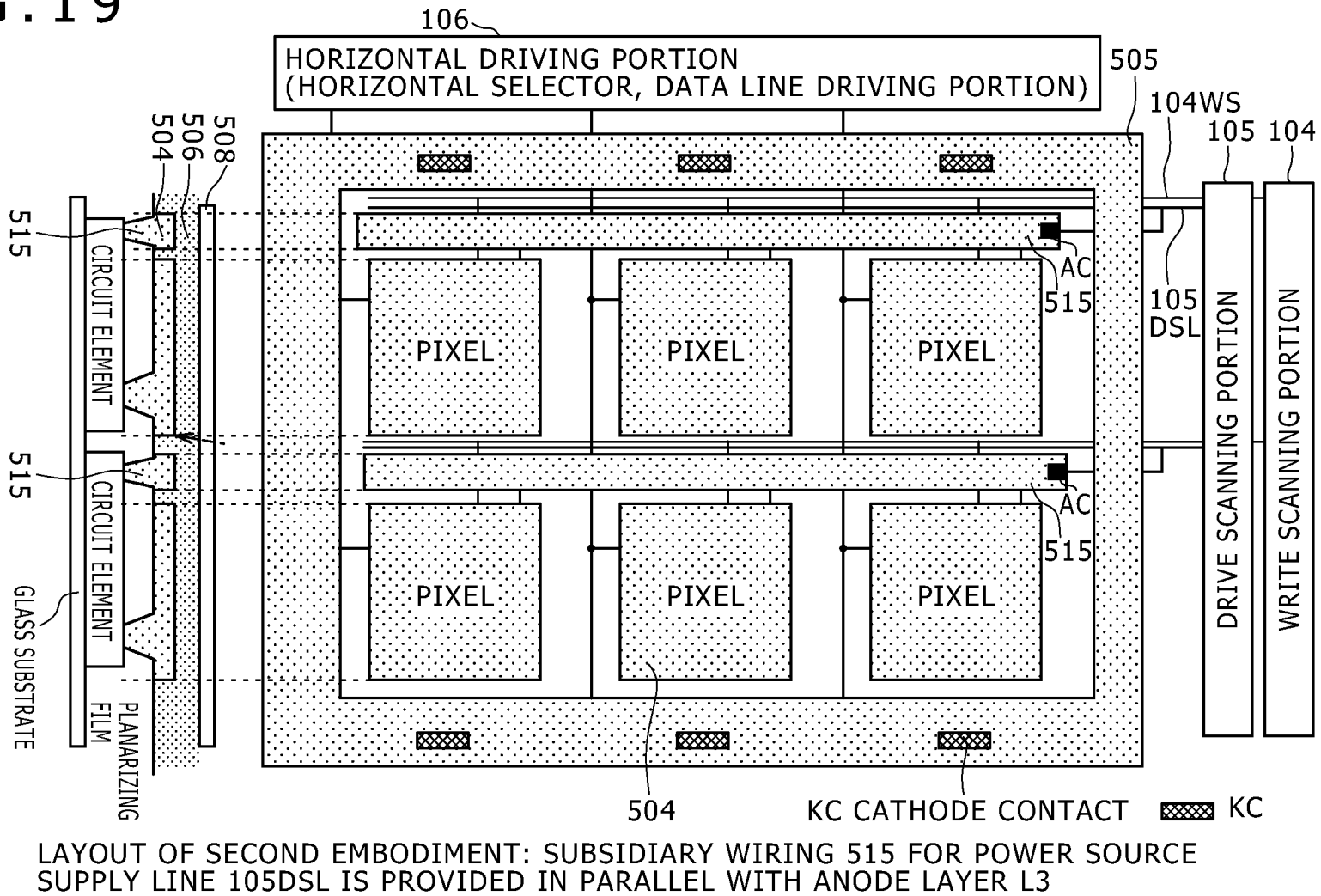
FIG. 19 is a block diagram, partly in cross section, showing a layout of a subsidiary wiring provided in the same layer as that of a lower electrode of an organic EL element corresponding to the second example shown in FIG. 17 (part 1)
Figure 20:
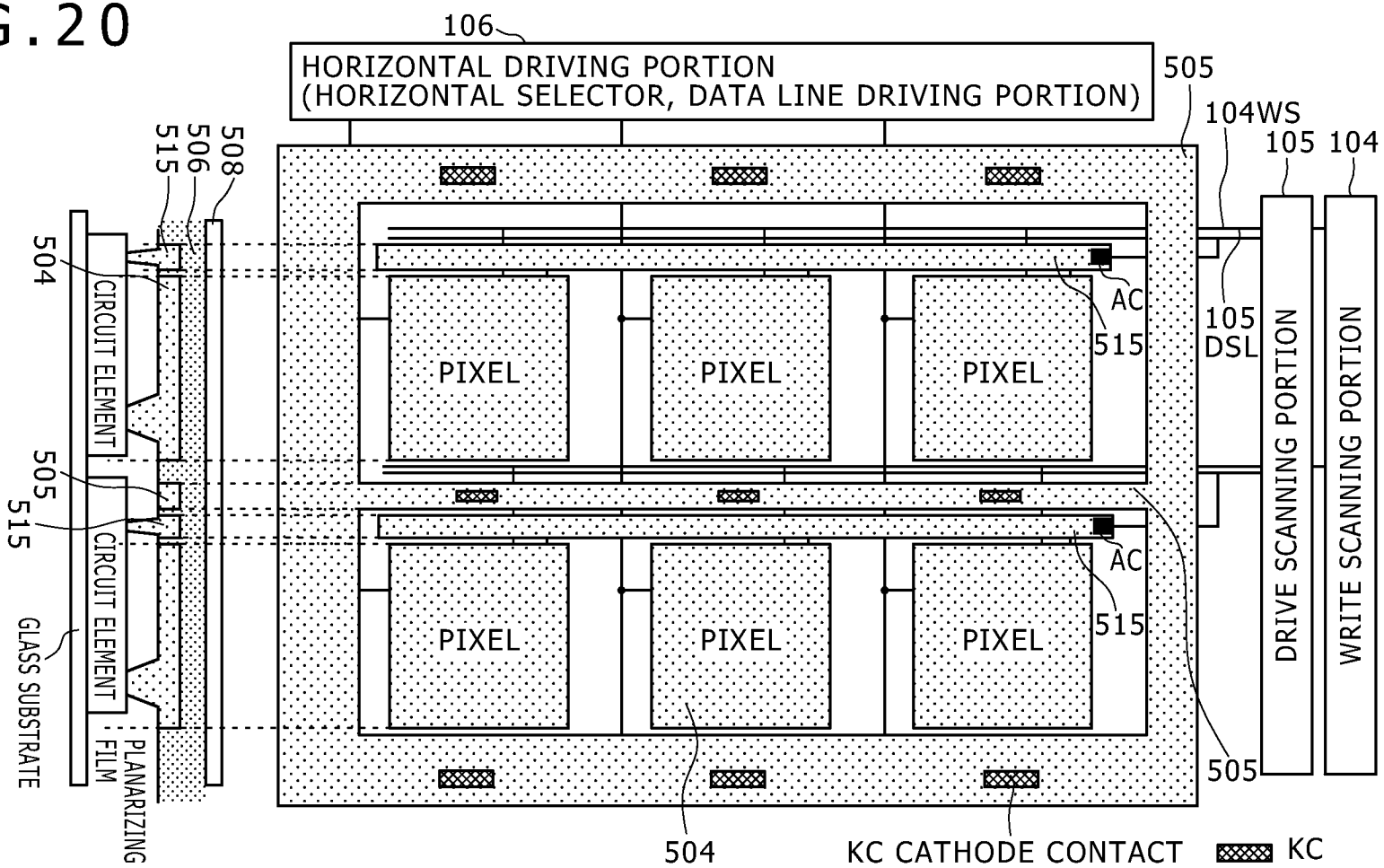
FIG. 20 is a block diagram, partly in cross section, showing a layout of a subsidiary wiring provided in the same layer as that of a lower electrode of an organic EL element corresponding to the second example shown in FIG. 17 (part 2).

FIGS. 17 to 20 are respectively a diagram, and views explaining a second embodiment of a circuit arrangement (layout) in which an area rate of the scanning lines occupying the TFT layout can be reduced. Here, FIG. 17 is a circuit diagram, partly in block, showing a basic concept of a layout of the second embodiment in the periphery of the pixel circuit P, FIG. 18 is a top plan view of a detailed example (a vertical relationship of the wirings is disregarded) corresponding to FIG. 17. Also, FIGS. 19 and 20 are respectively block diagrams, partly in cross sections, showing layouts of the subsidiary wirings each provided in the same layer as that of the lower electrode 504 of the organic EL element 127 corresponding to FIG. 17.

Similarly to the case of the first embodiment, a point of the improvement technique of this embodiment features that with regard to the wiring for which especially the small wiring resistance is required, a subsidiary wiring 515 is disposed in the same layer as that of the lower electrode 504 of the organic EL element 127. In comparison with the first embodiment described above, the second embodiment adopts a second technique with which the existing wirings of the first wiring layer L1 and the second wiring layer L2, and the subsidiary wiring 515 are disposed in parallel relation to each other. FIG. 17 schematically shows this state on the circuit diagram.

For example, in the improvement technique as well of the second embodiment, the lattice-like wiring of the anode layer L3 which is used as the subsidiary wiring 505 for the cathode wiring in the comparative example is used as the subsidiary wiring 515 for the power source supply line 105DSL. It is noted that in the case of the second embodiment, the subsidiary wiring 515 is disposed in parallel relation to the power source supply line 105DSL provided in the wiring layer L1 or L2. At this time, as shown in FIG. 19, the previous subsidiary wiring 505 for the cathode wiring can be perfectly removed from the anode layer L3 to be used as the subsidiary wiring 515 for the power source supply line 105DSL.

Or, as shown in FIG. 20, by paying attention to the respect that the power source supply line 105DSL is disposed in parallel relation to the second wiring layer L2, a structure may also be adopted such that the subsidiary wiring 505 narrower than that in the previous case is provided in the anode layer L3 in parallel relation to the subsidiary wiring 515 for the power source supply line 105DSL. The width of the subsidiary wiring 515 needs to be made narrower than that in the first embodiment because the subsidiary wiring 505 is provided in the anode layer L3. However, the disadvantage of narrowing the line width can be supplemented with the power source supply line 105DSL because the power source supply line 105DSL is also provided in the second wiring layer L2 in parallel relation to the subsidiary wiring 515 in terms of the electrical circuit.

As a result, the layout area for the power source supply line 105DSL can be reduced from the TFT layout within the pixel circuit P all the more because in the second embodiment as well, as shown in FIG. 18, it is possible to narrow the width of the power source supply line 105DSL provided in the wiring layer L1 or L2. Thus, the layout of other elements or the like can be made in a portion obtained by reducing that layout area.

Although the present invention has been described so far based on the embodiment, the technical scope of the present invention is by no means limited to the scope described in the above embodiment. Various changes or improvements can be added to the embodiment described above without departing from the gist of the invention, and the embodiments having such changes or improvements added thereto are also contained in the technical scope of the present invention.

In addition, the embodiment described above does not limit the invention disclosed in the appended claims, and all combinations of the features described in the embodiment are not necessarily essential to the means for solving the problems by the invention. The various stages of the invention are contained in the embodiment described above, and thus the various inventions can be extracted based on suitable combinations of a plurality of constituent requirements disclosed herein. Even when several constituent requirements are deleted from all the constituent requirements disclosed in the embodiment, the constitution in which the several constituent requirements are deleted can be extracted in the form of the invention.

For example, although the case example in which the power source supply line 105DSL is applied as the subsidiary wiring 515 of the anode layer L3 in the first or second embodiment of the improvement technique, the objective wiring is by no means limited to the power source supply line 105DSL, and thus all the wirings can be each directed to the wirings. For example, the subsidiary wiring 515 can be used as the wiring for the write drive pulse WS or the wiring for the video signal line 106HS. Thus, the subsidiary wiring 515 may be applied to the wiring for which especially, the small wiring resistance is required for the purpose of obtaining the satisfactory image characteristics. The reason for this is because when the wiring is desired to be disposed based on the wiring layer L1 or L2 in the case where the small wiring resistance is required for obtaining the satisfactory image characteristics, the wiring width becomes thick, so that the layout rate of the wirings occupying the TFT layout becomes large and thus it becomes difficult to realize the promotion of the high definition for the panel.

For example, when the video signal line 106HS is made of aluminum (Al) and is wired in the anode layer L3, the video signal line 106HS as the longitudinal wiring, and the write scanning line 104WS and the power source supply line 105DSL each as the transverse wiring are prevented from intersecting with each other in the same layer. As a result, there is offered an advantage that the wiring resistance of the video signal line 106HS can be made sufficiently small. The video signal line 106HS is effective in application to the case where the one horizontal scanning time period becomes short as in the case of the double speed drive described with reference to FIG. 13B or 13C.

In addition, with regard to the method of thinking, the technique with which the wiring for which the small wiring resistance is required is wired in the subsidiary wiring 515 of the anode layer L3 can be applied to the configuration as well in which the power source supply terminal (drain terminal) side of the drive transistor 121 is made to have a constant voltage as in the case of the 5TR drive configuration or the like described in Japanese Patent Laid-Open No. 2006-215213.

However, it is right in thinking that in the case of the configuration in which the power source supply terminal (drain terminal) side of the drive transistor 121 is made to have a constant voltage, the request therefore is hardly made in terms of the practical aspect. The reason for this is because it is unnecessary to dispose the wiring therefore as the transverse wiring as long as there is adopted the configuration in which the power source supply terminal (drain terminal) side of the drive transistor 121 is made to have a constant voltage. That is to say, the reason for this is that since the wiring concerned can be disposed as the longitudinal wiring similarly to the case of the video signal line 106HS in parallel relation to the video signal line 106HS, it is unnecessary to form any of the bridges, and the wiring concerned and the video signal line 106HS can be each made of aluminum (Al) and can be wired in the second wiring layer L2 in parallel relation to each other, thereby making both the wiring resistances of them sufficiently small.

In this respect, the technique with which the wiring for which the small wiring resistance is required is wired in the subsidiary wiring 515 of the anode layer L3 is effective in application to the configuration in which the power source supply line 105DSL and the video signal line 106HS must be wired as the transverse wiring and the longitudinal wiring, respectively, that is, the configuration in which the potential at the power source supply terminal of the drive transistor 121 is made to transit between the first potential and the second potential i.e., the configuration in which the power source voltage is used as the switching pulse.

Change of Drive Timing

In addition, even when the pixel circuits P are identical to one another, the various changes can be made from an aspect of the drive timing. For example, the various changes can be made while the timing at which the potential of the power source supply line 105DSL transits from the second potential Vcc_L to the first potential Vcc_H is made to fall within a time period of the reference potential Vo (Vofs) as the non-effective time period of the video signal Vsig.

For example, although an illustration is omitted here for the sake of simplicity, the method of setting the timing period H for write & mobility correction can change as an example of the change for the drive timing shown in FIG. 7. Specifically, a timing t15V at which the video signal Vsig transits from the reference potential Vo (Vofs) to the signal potential (Vofs+Vin) is shifted to the second half side of one horizontal time period with respect to the drive timing shown in FIG. 7. As a result, the time period of the signal amplitude Vin, that is, the signal potential (Vofs+Vin) as the effective time period is narrowed.

In addition, in the phase of completion of the threshold correcting operation (in the phase of completion of the time period E for the threshold correction), firstly, a time period for which the horizontal driving portion 106 supplies the signal potential (Vofs+Vin) to the video signal line 106HS (t16) while the write drive pulse is held at the active H level, thereby setting the write drive pulse WS at the inactive L level (t17) is set as a write time period for which the pixel signal Vsig is written to the storage capacitor 120. The information corresponding to the signal amplitude Vin is added to the threshold voltage Vth of the drive transistor 121 to be held in the storage capacitor 120. As a result, since the change in threshold voltage Vth of the drive transistor 121 is usually canceled, the threshold correcting operation is necessarily carried out. By carrying out the threshold correcting operation, the gate-to-source voltage Vgs of the drive transistor 121 held in the storage capacitor 120 becomes "Vsig+Vth." In addition, at the same time, the mobility correcting operation is carried out for a signal write time period ranging from t16 to t17. That is to say, a timing from t16 to t17 acts as the time period for mobility correction as well as the signal write time period.

It is noted that for the time period from t16 to t17 for which the mobility correcting operation is carried out, the organic EL element 127 emits no light because it is in the reverse biasing state. For the time period from t16 to t17 for which the mobility correcting operation is carried out, the drive current Ids is caused to flow through the drive transistor 121 while the potential at the gate terminal G of the drive transistor 121 is fixed at the level of the video signal Vsig. The drive timing shown in FIG. 7 applies to the following operation.

In the case as well of the drive timing of the change, the switching operation for supplying the voltage of the power source to the drain terminal D of the drive transistor 121 is perfectly identical to that at the drive timing shown in FIG. 7. As a result, the suppression effect for the luminance non-uniformity (especially, a longitudinal cross-talk) can be enjoyed similarly to the case of the embodiment described above.

The write scanning portion 104, the drive scanning portion 105, and the horizontal driving portion 106 can optimize the time period for mobility correction by adjusting a relative phase difference between the video signal Vsig which is supplied from the horizontal driving portion 106 to the video signal line 106HS, and the write drive pulse WS which is supplied from the write scanning portion 104 to the write scanning line 104WS. Also, the time period for mobility correction can be adjusted by adjusting the capacitance value Csub of the subsidiary capacitor 310.

However, the time period G for preparation for write & mobility correction does not exist, and thus a timing from t16V to t17 W becomes the time period H for write & mobility correction. For this reason, there is the possibility that a difference in waveform characteristics due to the influence of dependency of the wiring resistances and the wiring capacitances of the write scanning line 104WS and the video signal line 106HS on the distance exerts an influence on the time period H for write & mobility correction. The sampling potential and the time period for mobility correction are each different between the side near the write scanning portion 104 of the screen, and the side far therefrom (that is, between the left-hand side and the right-hand side of the screen). As a result, a drawback is feared such that the luminance different occurs between the left-hand side and right-hand side of the screen, and is visually recognized as the shading.

Change of Pixel Circuit

In addition, a change can be made from an aspect of the pixel circuit P. For example, since "the principle of duality" is established in terms of the circuit theory, the pixel circuit P can be changed from this viewpoint. In this case, although an illustration is omitted here for the sake of simplicity, firstly, the pixel circuit P shown in FIGS. 3 and 4 is configured by using the re-channel transistors, whereas in the change, the pixel circuit P is configured by using the p-channel transistors. Thus, the change is made in accordance with the principle duality such that the polarity of the signal amplitude Vin with respect to the reference potential Vo (Vofs) for the video signal Vsig, and the magnitude relationship of the power source voltage are inverted, and so forth in accordance with that configuration.

For example, in the pixel circuit P of the change made in accordance with the principle duality, the configuration is described as follows. That is to say, the storage capacitor 120 is connected between a gate terminal G and a source terminal S of a p-channel drive transistor (hereinafter referred to as "a p-channel drive transistor 121*p*). Also, the source terminal S of the p-channel drive transistor 121*p* is directly connected to the cathode terminal K of the organic EL element 127. The anode terminal A of the organic EL element 127 is set at the anode potential Vanode as the reference potential. The anode potential Vanode is connected to the reference power source (high potential side), common to all the pixels, for supplying the reference potential.

A drain terminal D of the p-channel drive transistor 121*p* is connected to the power source potential Vss_L on the low voltage side in order to cause the drive current Ids to flow through the organic EL element 127 so that the organic EL element 127 emits a light. A p-channel sampling transistor (hereinafter referred to as "a p-channel sampling transistor 125*p*") is disposed in an intersection portion between the video signal line 106HS and the write scanning line 104WS. A gate terminal G of the p-channel sampling transistor 125*p* is connected to the write scanning line 104WS extending from the write scanning portion 104, a drain terminal D (or a source terminal S) thereof is connected to the video signal line 106HS, and the source terminal S (or the drain terminal D) thereof is connected to a node between the gate terminal G of the p-channel drive transistor 121*p* and one terminal of the storage capacitor 120. The write drive pulse WS at the active L level is supplied from the write scanning portion 104 to the gate terminal G of the p-channel sampling transistor 125*p*.

The threshold correcting operation, the mobility correcting operation, and the bootstrap operation can be carried out in the organic EL display device as well of the change in which each of the transistors is made to be of the p-channel type in accordance with application of the principle of duality similarly to the case of the organic EL display device in which each of the transistors is made to be of the n-channel type.

Of course, the subsidiary capacitor 310 is added every pixel circuit P, which results in that the write gain and the bootstrap gain can be adjusted, the time period of mobility correction can be adjusted, or the white balance can be obtained in the case of the color display.

The improvement technique of the first or second embodiment in which the power source line or the scanning line is wired as the subsidiary wiring 515 in the anode layer L3 is applied to even such a pixel circuit P, which results in that the layout rate of these wirings occupying the TFT layout can be reduced, an increase in number of circuit elements, an increase in capacitance, and the like can be made, or the high definition promotion for the panel can be realized.

It is noted that although the change of the pixel circuit P described herein is obtained by adding the change complying with "the principle of duality" to the configuration shown in FIGS. 3 and 4, the technique for the circuit change is by no means limited thereto. Whether or not the pixel circuit adopts the 2TR drive configuration is no object as long as it is provided with the functions, for maintaining the drive current constant, such as the threshold correcting function, the mobility correcting function and the bootstrap function (i.e., the drive signal maintaining circuit for realization thereof). Thus, the number of transistors may be three or more. Each of the improvement techniques of the examples described above can be applied to all the changes stated herein. The idea of the embodiment that the layout rate of the wiring for the scanning lines in the wiring layers L1 and L2 occupying the TFT layout can be reduced, thereby realizing the increase in number of circuit elements, the increase in capacitance, or the high definition promotion for the panel can be applied to the various changes.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array portion having a plurality of scanning lines, a plurality of signal lines, and a plurality of pixels disposed in a matrix, each of the plurality of pixels including a drive transistor for controlling a drive current, a sampling transistor, an electro-optic element, and a storage capacitor for holding information corresponding to a signal potential supplied from one of the plurality of signal lines via the sampling transistor, wherein each electro-optic element of the plurality of pixels has a lower electrode, an organic layer and an upper electrode laminated on the lower electrode in order, the plurality of scanning lines are disposed in a first layer and the plurality of signal lines are disposed in a second layer, the lower electrode is disposed in a third layer, a first electrode of the capacitor is disposed in a fourth layer, and the fourth layer is a semiconductor layer of the driving transistor and the sampling transistor, a gate electrode of the driving transistor and the sampling transistor are disposed in the first layer, a second electrode of the capacitor is disposed in the second layer, a first wiring is disposed in the second layer and the first wiring is electrically connected between the capacitor and the electro-optic element, the signal lines extend in a first direction and the scanning lines extend in a second direction perpendicular to the first direction.

2. The display device of claim 1, wherein the second layer is located between the first layer and the third payer.

3. The display device of claim 1, wherein the plurality of pixels include a first pixel, a second pixel and a third pixel, a size of the capacitor is different between the first pixel and the second pixel.

* * * * *